US008627537B2

(12) United States Patent
Mercier

(10) Patent No.: US 8,627,537 B2
(45) Date of Patent: Jan. 14, 2014

(54) HAIRBRUSH, METHODS OF USE, AND METHODS OF MANUFACTURING THE SAME

(75) Inventor: Michel Mercier, Hertzliya (IL)

(73) Assignee: Michel Mercier Ltd., Tel Aviv (IL)

( * ) Notice: Subject to any disclaimer, the term of this patent is extended or adjusted under 35 U.S.C. 154(b) by 430 days.

(21) Appl. No.: 12/903,203

(22) Filed: Oct. 12, 2010

(65) Prior Publication Data

US 2011/0167580 A1 Jul. 14, 2011

Related U.S. Application Data

(60) Provisional application No. 61/250,057, filed on Oct. 9, 2009, provisional application No. 61/297,814, filed on Jan. 24, 2010, provisional application No. 61/298,205, filed on Jan. 25, 2010, provisional application No. 61/298,398, filed on Jan. 26, 2010, provisional application No. 61/367,447, filed on Jul. 25, 2010, provisional application No. 61/367,793, filed on Jul. 26, 2010.

(30) Foreign Application Priority Data

Oct. 11, 2010 (GB) ..... 1017114.8

(51) Int. Cl.
*A46B 9/02* (2006.01)

(52) U.S. Cl.
USPC ..... 15/160; 15/186; 15/DIG. 5; 132/120

(58) Field of Classification Search
USPC ..... 15/159.5, 160, 186, 187, 188; 132/120, 132/137, 138, 141, 142, 148, 150, 152, 159
See application file for complete search history.

(56) References Cited

U.S. PATENT DOCUMENTS

| | | | |
|---|---|---|---|
| 216,408 | A | 6/1879 | Hill |
| 2,607,064 | A | 9/1948 | Emmet |
| D166,124 | S | 3/1950 | Pearce |
| D166,086 | S | 10/1950 | Le Febvre |
| D168,916 | S | 2/1953 | Snyder |
| D168,917 | S | 2/1953 | Snyder |

(Continued)

FOREIGN PATENT DOCUMENTS

| | | |
|---|---|---|
| BE | 1007329 | 5/1995 |
| EP | 0904711 | 3/1999 |

(Continued)

OTHER PUBLICATIONS

PCT Search report of PCT/US2010/052404 (related case) mailed Jul. 28, 2011.

(Continued)

*Primary Examiner* — Mark Spisich
*Assistant Examiner* — Michael Jennings
(74) *Attorney, Agent, or Firm* — Marc Van Dyke, 4th Dimension IP

(57) ABSTRACT

Embodiments of the present invention relate to a hairbrush for detangling human or animal hair. In some embodiments, the hairbrush includes a field of bristles where bristle height is substantially random and substantially independent of position on the hairbrush. In some embodiments, within the bristle field, the bristle width and/or the bristle material may vary between bristles—for example, substantially randomly with respect to position and/or in a manner that is correlated with bristle height.

22 Claims, 40 Drawing Sheets

(56) References Cited

U.S. PATENT DOCUMENTS

| | | | | |
|---|---|---|---|---|
| D169,131 | S | 3/1953 | Kay | |
| 2,707,793 | A * | 5/1955 | Zabel | 15/226 |
| 2,799,037 | A * | 7/1957 | Grogan | 15/172 |
| 2,889,567 | A | 6/1959 | Solomon | |
| 3,047,898 | A * | 8/1962 | Levite | 15/207.2 |
| 3,949,765 | A | 4/1976 | Vallis | |
| 4,121,314 | A | 10/1978 | Nathe | |
| 4,161,050 | A | 7/1979 | Sasaki et al. | |
| 4,287,898 | A | 9/1981 | Konesky | |
| 4,325,392 | A | 4/1982 | Iten | |
| 4,417,595 | A | 11/1983 | Okumura et al. | |
| 4,475,563 | A | 10/1984 | Martin | |
| 4,500,939 | A | 2/1985 | Gueret | |
| 4,694,525 | A | 9/1987 | Yamamoto | |
| 5,638,608 | A | 6/1997 | Dorber | |
| 5,755,242 | A | 5/1998 | Denebeim | |
| 6,226,811 | B1 | 5/2001 | Fagan | |
| 6,308,717 | B1 | 10/2001 | Vrtaric | |
| 7,156,105 | B2 * | 1/2007 | Gueret | 132/218 |
| D543,705 | S | 6/2007 | Leung | |
| 8,181,304 | B1 * | 5/2012 | Kamath | 15/160 |
| 2002/0004964 | A1 * | 1/2002 | Luchino et al. | 15/167.1 |
| 2002/0011251 | A1 * | 1/2002 | Gueret | 132/218 |
| 2003/0009838 | A1 | 1/2003 | Nakamura | |
| 2004/0003478 | A1 * | 1/2004 | Mink | 15/160 |
| 2004/0200021 | A1 * | 10/2004 | Fong | 15/207.2 |
| 2004/0221863 | A1 * | 11/2004 | Chen | 132/120 |
| 2004/0237233 | A1 * | 12/2004 | Dragan et al. | 15/104.94 |
| 2005/0055788 | A1 | 3/2005 | Chang | |
| 2005/0210614 | A1 | 9/2005 | Chang | |
| 2009/0083925 | A1 * | 4/2009 | Mathiez | 15/207.2 |
| 2010/0101594 | A1 | 4/2010 | Pulfrey | |
| 2010/0269841 | A1 * | 10/2010 | Honnefeller et al. | 132/120 |

FOREIGN PATENT DOCUMENTS

| | | |
|---|---|---|
| EP | 1078585 | 2/2001 |
| EP | 1757201 | 2/2007 |
| GB | 1469552 | 4/1977 |
| GB | 2244232 | 11/1991 |
| GB | 2447692 | 9/2008 |
| JP | 09065790 | 3/1997 |
| JP | 2003033226 | 2/2003 |
| KR | 100742997 | 8/2007 |
| WO | 8800446 | 1/1988 |
| WO | WO8800446 | 1/1988 |

OTHER PUBLICATIONS

PCT Search opinion of PCT/US2010/052404 (related case) mailed Jul. 28, 2011.

PCT Preliminary patentability opinion of PCT/US2010/052404 (related case) mailed Jul. 28, 2011.

EPO claims filed Mar. 30, 2012.

EPO search report for EP2485620 issued Feb. 21, 2013.

Selected items of GB2474364 (parallel case in the UK, granted Aug. 16, 2011) downloaded from UKIPO's IPSum Online Patent Service on May 25, 2012.

* cited by examiner

All numbers are in *mm*

Ratio SD/Mean = 0.15

Closest Distance
Distribution for Inner Field

Height Neighborhood
Histogram for Inner Bristles

Ratio SD/Mean = 0.06

Ratio SD/Mean = 0.37

Closest Distance
Shortest Bristle
Population

Ratio SD/Mean = 0.28

Closest Distance
Short Bristle Population

Ratio SD/Mean = 0.34

Closest Distance
Tall Bristle Population

Ratio SD/Mean = 0.35

Closest Distance
Tallest Bristle Population

| woman | NUMBER Brush A | HAIRS SHED Brush B | BRUSHING Brush A | TIME Brush B |
|---|---|---|---|---|
| RL | 35 | 10 | 198 | 40 |
| HG | 40 | 15 | 214 | 57 |
| VG | 45 | 15 | 214 | 57 |
| LM | 10 | 5 | 120 | 60 |
| GI | 9 | 0 | 60 | 30 |
| AB | 30 | 18 | 120 | 60 |
| HL | 15 | 2 | 69 | 35 |
| KM | 35 | 10 | 82.8 | 35 |
| NB | 45 | 15 | 142.8 | 40 |
| AB | 15 | 8 | 162 | 47 |
| MM | 25 | 10 | 138 | 60 |
| KK | 30 | 15 | 154.2 | 57 |
| LK | 15 | 5 | 120 | 30 |
| MZ | 20 | 8 | 84 | 40 |
| YD | 50 | 15 | 214.8 | 60 |
| SG | 20 | 10 | 120 | 30 |
| ML | 10 | 3 | 202.8 | 40 |
| YG | 15 | 5 | 150 | 47 |
| AS | 30 | 15 | 154.2 | 50 |
| RM | 15 | 3 | 60 | 20 |
| AS | 20 | 5 | 94.2 | 60 |
| YG\ | 20 | 10 | 120 | 40 |
| AL | 25 | 10 | 94.2 | 30 |
| HZ | 20 | 8 | 214.2 | 60 |
| BG | 20 | 10 | 93.6 | 55 |
| SN | 15 | 6 | 78 | 37 |
| MM | 18 | 10 | 120 | 58 |
| **AVG** | **23.96296** | **9.111111111** | **133.140741** | **45.74074** |

FIG. 14

1139 objects distance in mm 194 objects 198 objects 418 objects

329 objects

HAIRBRUSH, METHODS OF USE, AND METHODS OF MANUFACTURING THE SAME

CROSS-REFERENCE TO RELATED APPLICATIONS

This patent application claims the benefit of (i) U.S. Provisional Patent Application No. 61/250,057 filed on Oct. 9, 2009; (ii) U.S. Provisional Patent Application No. 61/297,814 filed on Jan. 24, 2010; (iii) U.S. Provisional Patent Application No. 61/298,205 filed on Jan. 25, 2010; (iv) U.S. Provisional Patent Application No. 61/298,398 filed on Jan. 26, 2010; (v) U.S. Provisional Patent Application No. 61/367,447 filed on Jul. 25, 2010 (vi) U.S. Provisional Patent Application No. 61/367,793 filed on Jul. 26, 2010 and (vii) GB 1017114.8 filed on Oct. 11, 2010, all of which are incorporated by reference in their entirety.

BACKGROUND AND RELATED ART

Embodiments of the present invention relate to hairbrushes, methods of using a hairbrush and methods of manufacturing a hairbrush.

The following issued patents and patent publications provide potentially relevant background material, and are all incorporated by reference in their entirety: GB 2,447,692; US 2005/055788; PCT/GB2008/000580; US 2005/210614; U.S. Pat. No. 4,161,050; EP 1,757,201; GB 1,469,552; U.S. Pat. No. 4,121,314; EP 1,078,585; BE 1007329, JP2003033226, EP 0904711, JP2003033226, U.S. Pat. No. 216,408; U.S. design Pat. D166,124; U.S. design Pat. D166,086; U.S. design Pat. D168,916; U.S. design Pat. D168,917; U.S. design Pat. D169,131; U.S. Pat. No. 6,226,811; US 2002/0004964; U.S. design Pat. D543,705; U.S. Pat. Nos. 3,949,765; 4,475,563; 4,694,525; 5,755,242; 6,308,717; WO 88/000446; U.S. Pat. Nos. 4,500,939; 2,889,567; 2,607,064; 4,287,898; and US 2005/0210614.

SUMMARY OF EMBODIMENTS

Embodiments of the present invention relate to a hairbrush for detangling human or animal hair that include a field of bristles comprising at least 100, or at least 150 or at least 200 or at least 250 bristles where a variety of heights a represented—for example, at least five heights that significantly differ from each other. The heights/lengths of bristles of the bristle field (i) vary in a substantially random manner and (ii) are substantially independent of bristle location on the bristle-retaining surface.

Optionally, but in some embodiments preferably, the bristles are not of uniform width—instead, a variety of bristles widths (for example, three of more distinct bristle widths that significantly different from each other) are represented in the field of bristles. Alternatively or additionally, the bristles may be constructed of materials of different flexibilities. Optionally, but in some embodiments preferably, the longer/taller bristles are on average thicker than the shorter bristles and/or the longer/taller bristles are constructed of less flexible material than the shorter bristles.

A novel hairbrush according to various feature(s) disclosed herein was constructed and tested against a conventional 'control' hairbrush. In particular, hair on one half of the head (i.e. the left half or the right half) was detangled using the novel brush while hair on the other half of the head was detangled using the control brush. While the hair was detangled, hair was shed or pulled out of the user's head. The hair shed using the conventional and control brush (i.e. when detangling hair regions of comparable size) was collected separately and the quantity of hair shed was measured and compared.

It was found that the novel hairbrush providing feature(s) disclosed herein was able to detangle human hair (even wet hair and/or hair that has not properly been treated with conditioner) in a manner that was surprisingly painless and/or in a manner that surprisingly inflected significantly less pain than when using a conventional hairbrush. Furthermore, it was found that the amount of hair shed when detangling using the novel brush was significantly less than the amount of hair shed when detangling the control brush (i.e. once again, when detangling regions of hair of comparable size).

It is noted that during these tests/experiments, the user's actual hair was actually detangled—this was not a situation where one of the brushes merely 'massaged the user's hair' without detangling or while detangling only outermost layers of hair.

Not wishing to be bound by theory, it is noted that mammalian hair strands are not of uniform length and is not of uniform thickness—instead, on the head of a single person (or on the body of a single animal) some hair strands are longer, some hair strands are shorter, some hair strands are thicker and some hair strands are thinner. Furthermore, this spatial fluctuation in hair length and/or hair thickness tends to not follow any discernable spatial pattern—instead, in many human or animal subjects, this fluctuation tends to be mostly or completely random/stochastic.

By employing a hairbrush that has at least some of these random properties (i.e. a hairbrush including a field of bristles where the bristle length and/or bristle thickness and/or bristle material flexibility varies substantially randomly), it is possible to detangle hair in a reduced pain manner. Not wishing to be bound by theory, it is postulated that the reduced pain hair detangling and/or reduced shedding hair that was observed is due, at least in part, to the fact that there is a certain amount of mechanical 'compatibility' between the hairbrush's stochastic properties and the stochastic properties of human/mammalian hair, to provide a hair detangling technique that is significantly less painful and/or uproots significantly fewer hair strands.

It is noted that each bristles of the 'field of bristles' where bristle heights vary in a substantially random manner and are substantially independent of location are independently deployed—i.e. each bristle is separately or individually deployed to the hairbrush surface. These individually deployed bristles are in contrast to bundles of bristles or tufts of bristles.

For the present disclosure, bristle height and length are used synonymously.

For the present disclosure, bristle width and bristle thickness are used synonymously to refer to the characteristic width dimension. For the non-limiting case where the bristle cross section is a circle (i.e. substantially cylindrical bristles), this width is a diameter of the circle.

For the present disclosure, when bristle heights/lengths of a field of bristles 'vary in a substantially random manner that is substantially independent of bristle location on the bristle-retaining surface,' (i) it is possible to view the bristles together as a coherent unit or 'field' and (ii) there is no visually determinable (i.e. other than randomness) pattern for bristle length/height of the bristles of the field of bristles.

A hairbrush comprises a bristle-retaining surface and a bristle field of at least 100 bristles that are individually deployed to the bristle-retaining surface such that bristle heights vary in a substantially random manner and are substantially independent of bristle location on the bristle-retaining surface is now disclosed. The bristle field providing the following properties: (i) height properties such that at least 5 different heights that significantly differ from each other are represented; (ii) width properties such that each bristle has a width that is at least 0.5 mm; and (iii) bristle end properties such that at least 60% of the bristles have a rounded end.

A hairbrush comprises a bristle-retaining surface and a bristle field of at least 100 bristles that are individually deployed to the bristle-retaining surface such that a distal end surface defined by ends of bristles of the bristle field is irregularly and substantially randomly shaped. The bristle field provides the following properties: (i) height properties such that at least 5 different heights that significantly differ from each other are represented; (ii) width properties such that each bristle has a width that is at least 0.5 mm; and (iii) bristle end properties such that at least 60% of the bristles have a rounded end.

A hairbrush comprises a bristle-retaining surface and a bristle field of at least 100 bristles that are individually deployed to the bristle-retaining, an average height of the bristle field being defined as HEIGHT_AVG, a height standard deviation of the bristle field being defined as HEIGHT_SD. The field of bristles providing height properties, width properties and bristle end properties such that: (i) according to the width properties, each bristle has a width that is at least 0.5 mm; (ii) according to the bristle end properties, at least 60% of the bristles of the field have a rounded end; and (iii) according to the height properties: A) the bristle field provides at least 5 different heights that significantly differ from each other are represented; B) the bristle field includes at least one height outlier subset (HOS) having a count that is at least 10% of the total bristle count of the bristle field, the height outlier subset HOS being selected from the group consisting of: I) a very-tall-bristles (VTB) subset of bristles whose height exceeds a sum of HEIGHT_AVG and HEIGHT_SD; and II) a very-short-bristles (VSB) subset of bristles whose height is less than a difference between HEIGHT_AVG and HEIGHT_SD, wherein bristles of the bristle field are individually deployed to the bristle-retaining surface so that there is a contrast between the deployment of the bristle field as a whole and the deployment of at least one height outlier subset HOS, such that while the bristles of bristle field as a whole are deployed at substantially a constant density within a selected area SA of the bristle-retaining surface, the bristles of the height outlier subset HOS are scattered at irregular and non-periodic locations within the selected area SA.

In some embodiments, i) the bristle field further provides width variation properties such that a ratio between a bristle width standard deviation and a bristle width average is at least 0.07 and such that there a is positive correlation between bristle height and bristle thickness for bristles of the bristle field such that, on average, taller bristles of the field are thicker than shorter bristles; and ii) bristles of the bristle field are each deployed substantially normally to a respective local plane of bristle-retaining surface.

In some embodiments, bristles of the bristle field are deployed at a substantially constant density on the bristle-retaining surface.

In some embodiments, the range of heights for the bristle field substantially is between about 3.5 mm and about 16 mm.

In some embodiments, bristles of the bristle field are deployed at a substantially constant density of at least 4 bristles/cm^2 on the bristle-retaining surface.

In some embodiments, the range of heights for the bristle field substantially is between about 3.5 mm and about 16 mm.

In some embodiments the bristle field further provides width variation properties such that a ratio between a bristle width standard deviation and a bristle width average is at least 0.07 and such that there a is positive correlation between bristle height and bristle thickness for bristles of the bristle field such that, on average, taller bristles of the bristle field are thicker than shorter bristles.

In some embodiments bristles of the bristle field are each deployed substantially normally to a respective local plane of bristle-retaining surface.

In some embodiments bristles of the bristle field are deployed at a substantially constant density that is at least 4 bristles/cm^2.

In some embodiments the range of heights for the bristles field substantially is between about 3.5 mm and about 16 mm.

In some embodiments a ratio between a ratio between a height standard deviation and the average height is at least 0.075

In some embodiments the average bristle thickness for the field exceeds 0.85 mm.

In some embodiments the average height of the bristles of the field is at least about 8.5 mm.

In some embodiments bristles of the bristle field are deployed at a density that is at most 12 bristles/cm^2.

In some embodiments the average height of the bristles of the bristle field is at most about 12 mm.

In some embodiments the average height of the bristles of the bristle field is between 8 mm and 14 mm.

In some embodiments the field of bristles are deployed within the selected area so that: i) at least 80% of the bristles substantially reside on a constant lattice; and ii) at least 2% of the bristles of the field reside in positions that reside away from the lattice.

In some embodiments bristles of the field are deployed so that they are substantially parallel to each other.

In some embodiments i) an average height of the bristle field is defined as HEIGHT_AVG, a height standard deviation of the bristle field is defined as HEIGHT_SD; ii) the bristle field includes a very-short-bristles (VSB) subset of bristles whose height is less than a difference between HEIGHT_AVG and HEIGHT_SD, iii) a majority of bristles of the very-short-bristles (VSB) subset of bristles has a height that is at least 5 mm and/or that is at least 0.33*HEIGHT_AVG.

In some embodiments at least 10% of bristles of the bristle field have a height between 5 mm and 9 mm, at least 25% of the bristles have a height that is between 9 mm and 13 mm, and at least 10% of the bristles have a height that is between 13 mm and 18 mm.

In some embodiments i) each bristle b of the field of bristles is associated with a respective nearest bristle distance describing the respective closest distance $d_{CLOSEST}$ (b) between bristle b and a different bristle of the bristle field $b_{CLOSEST}$ that is closer to the bristle b than any other bristle of the bristle field ($d_{CLOSEST}$ (b)=DISTANCE(b, $b_{CLOSEST}$)), thereby establishing a one-to-one mapping between each bristle b of the bristle field and a closest distance $d_{CLOSEST}$ (b) to form a set of numbers CLOSEST_BRISTLE_DISTANCE whose members are the closest distances $d_{CLOSEST}$ (b) for the field of bristles; and ii) an SD/AVG ratio between a standard deviation of the set of numbers CLOSEST_BRISTLE_DISTANCE and an average value of the set of numbers CLOSEST_BRISTLE_DISTANCE is at most 0.25.

In some embodiments the SD/AVG ratio is at most 0.2 and/or at least 0.075 and/or SD/AVG ratio is at least 0.1.

In some embodiments i) each bristle b of the field of bristles is associated with a respective nearest bristle distance describing the respective closest distance $d_{CLOSEST}$ (b)

between bristle b and a different bristle of the bristle field $b_{CLOSEST}$ that is closer to the bristle b than any other bristle of the bristle field ($d_{CLOSEST}$ (b)=DISTANCE(b, $b_{CLOSEST}$)), thereby establishing a one-to-one mapping between each bristle b of the bristle field and a closest distance $d_{CLOSEST}$(b) to form a set of numbers CLOSEST_BRISTLE_DISTANCE whose members are the closest distances $d_{CLOSEST}$(b) for the field of bristles; and ii) values of a first subset of CLOSEST_BRISTLE_DISTANCE whose cardinality is between 50% and 95% of a cardinality of CLOSEST_BRISTLE_DISTANCE are all equal to a representative closest distance value RCDV within a tolerance of at most 10%; iii) values of a second subset of CLOSEST_BRISTLE_DISTANCE whose cardinality is at least at least 10% of a cardinality of CLOSEST_BRISTLE_DISTANCE are associated with closest distance values that all deviate from the representative value RCDV by at least 15%, In some embodiments the bristles are constructed of plastic.

In some embodiments i) the field of bristles is an inner field of bristles deployed within a selected area SA of the bristle retaining surface; ii) the hairbrush further comprises an outer field of bristles deployed outside of the selected area SA bristles on the perimeter of the selected area such that the outer field of bristles substantially surrounds the selected area SA; iii) the outer bristle field of bristles provides the following properties: A) a bristle count that is at least 15% of the count of the inner field; and B) an bristle average height that is at most 30% of the average height of bristles of the inner field.

In some embodiments at least 80% of bristles of the field of bristles have a height that is at least 6 mm and at most 18 mm.

In some embodiments i) a majority of bristles that are deployed within the selected area are situated at locations that are substantially on a regular lattice; and ii) a minority of at least 2% of the bristles are located in off-lattice locations that are away from the positions defined by the regular lattice.

In some embodiments, a height of at least 80% or at least 90% of the bristles of the field of bristles is at least 6 mm.

In some embodiments, a height of at least 80% or at least 90% of the bristles of the field is at most 20 mm.

In some embodiments, a ratio between a ratio between a height standard deviation and the average height is at least 0.075.

In some embodiments, a thickness of at least 80% or 90% of the bristles of the inner field is at least 0.7 mm or at least 0.8 mm or at least 0.85 mm.

In some embodiments, a thickness of at least 70% or at least 80% or at least 90% or least 95% of the bristles of the inner field is at least 0.75 mm and/or at most 2.5 mm.

Some embodiments relate to hairbrushes that have a 'paddle' form factor and/or are relatively flat. Some embodiments relate to hairbrush that are 'fan-type' or have a cylindrical shape. Some embodiments relate to hairbrushes with a form factor typical of human hairbrushes. Other embodiments relate to hairbrushes with a form factor typical of pet hairbrushes.

A hairbrush comprises a bristle-retaining surface and a bristle field of at least 100 bristles that are deployed to the bristle-retaining surface such that bristle widths vary in a substantially random manner and are substantially independent of bristle location on the bristle-retaining surface, the bristle field providing the following properties: (i) height properties such that at least 5 different heights that significantly differ from each other are represented; (ii) width variation properties such that a ratio between a bristle width standard deviation and a bristle width average is at least 0.07; (iii) width properties such that at least 80% of the bristles of the bristle field has a width that is at least 0.5 mm; and (iv) bristle end properties such that at least 60% of the bristles have a rounded end.

In some embodiments, there a is positive correlation between bristle height and bristle thickness for bristles of the bristle field such that, on average, taller bristles of the field are thicker than shorter bristles.

In some embodiments, bristles of the bristle field are each deployed substantially normally to a respective local plane of bristle-retaining surface.

In some embodiments, bristles of the bristle field are each deployed substantially normally to a respective local plane of bristle-retaining surface.

In some embodiments, at least 80% of the bristles have a height that is between 5 mm and 20 mm.

In some embodiments, a ratio between a height standard deviation and the average height of the bristle field is at least 0.075

In some embodiments, the average bristle thickness for the field exceeds 0.85 mm.

In some embodiments, at least 80% of the bristles of the field have a thickness between 1 mm and 2 mm.

In some embodiments, a ratio between a bristle width standard deviation and a bristle width average is at least 0.12.

In some embodiments, for a majority of the bristles of the bristle field, a ratio between a bristle length and a bristle width is at least 5 and at most 10.

A hairbrush comprises a bristle-retaining surface and a bristle field of at least 100 bristles that are deployed to the bristle-retaining surface such that: i) at least 80% of the bristles of the field have a height that is between 5 mm and 20 mm; ii) a ratio between a height standard deviation and the average height of the bristle field is at least 0.075 iii) at least 20% of the bristles have a height between 9 mm and 14 mm; iv) a bristle density for the field is at least 3 bristles/cm^2 and at most 20 bristles/cm^2; v) for at least one arbitrary vector v, for a word length selected from the group consisting of 3 and 4, for a MAPPING physical property that is height, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has a LEVEL N variety where N is an integer selected from the group consisting of 1, 2, 3, 4 and 5.

A hairbrush comprises a bristle-retaining surface and a bristle field of at least 100 bristles that are deployed to the bristle-retaining surface such that: i) at least 80% of the bristles of the field have a height that is between 5 mm and 20 mm; ii) a ratio between a height standard deviation and the average height of the bristle field is at least 0.075; iii) at least 20% of the bristles have a height between 9 mm and 14 mm; iv) a bristle density for the field is at least 3 bristles/cm^2 and at most 20 bristles/cm^2; v) for at least one arbitrary vector v, for a word length of 4, for a MAPPING physical property that is height, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has at least a LEVEL 2 variety.

In some embodiments, a ratio between a bristle width standard deviation and a bristle width average for the bristle field is at least 0.07.

In some embodiments, the ratio between a height standard deviation and the average height of the bristle field is at least 0.012.

A hairbrush comprising a bristle-retaining surface and a bristle field of at least 100 bristles that are deployed to the bristle-retaining surface such that: i) at least 80% of the bristles of the field have a height that is between 5 mm and 20 mm; ii) a ratio between a height standard deviation and the average height of the bristle field is at least 0.075 iii) at least 20% of the bristles have a height between 9 mm and 14 mm; iv) a bristle density for the field is at least 3 bristles/cm^2 and at most 20 bristles/cm^2; v) a ratio between a bristle width standard deviation and a bristle width average for the bristle field is at least 0.07; vi) for at least one arbitrary vector v, for a word length selected from the group consisting of 3 and 4, for a MAPPING physical property that is width/thickness, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has a LEVEL N variety where N is an integer selected from the group consisting of 1, 2, 3, 4 and 5.

A hairbrush comprises a bristle-retaining surface and a bristle field of at least 100 bristles that are deployed to the bristle-retaining surface such that: i) at least 80% of the bristles of the field have a height that is between 5 mm and 20 mm; ii) a ratio between a height standard deviation and the average height of the bristle field is at least 0.075; iii) at least 20% of the bristles have a height between 9 mm and 14 mm; iv) a bristle density for the field is at least 3 bristles/cm^2 and at most 20 bristles/cm^2; v) a ratio between a bristle width standard deviation and a bristle width average for the bristle field is at least 0.07; vi) for at least one arbitrary vector v, for a word length of 4, for a MAPPING physical property that is width/thickness, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has at least a LEVEL 2 variety.

In some embodiments, a ratio between a bristle width standard deviation and a bristle width average for the bristle field is at least 0.1.

In some embodiments, the majority is a substantial majority that is at least 70%.

A hairbrush comprises a bristle-retaining surface and a bristle field of at least 100 bristles that are individually deployed to the bristle-retaining surface such that: i) at least 80% of the bristles of the field have a height that is between 5 mm and 20 mm; ii) a ratio between a height standard deviation and the average height of the bristle field is at least 0.075; iii) at least 20% of the bristles have a height between 9 mm and 14 mm; iv) a bristle density for the field is at least 3 bristles/cm^2 and at most 20 bristles/cm^2; v) for at least one arbitrary vector v, for a word length selected from the group consisting of 3 and 4, for a MAPPING physical property that is height, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has a LEVEL N variety where N is an integer selected from the group consisting of 1, 2, 3, 4 and 5.

A hairbrush comprises a bristle-retaining surface and a bristle field of at least 100 bristles that are individually deployed to the bristle-retaining surface such that: i) at least 80% of the bristles of the field have a height that is between 5 mm and 20 mm; ii) a ratio between a height standard deviation and the average height of the bristle field is at least 0.075; iii) at least 20% of the bristles have a height between 9 mm and 14 mm; iv) a bristle density for the field is at least 3 bristles/cm^2 and at most 20 bristles/cm^2; v) for at least one arbitrary vector v, for a word length of 4, for a MAPPING physical property that is height, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has at least a LEVEL 2 variety.

A hairbrush comprises a bristle-retaining surface and a bristle field of at least 100 bristles that are individually deployed to the bristle-retaining surface such that: i) at least 80% of the bristles of the field have a height that is between 5 mm and 20 mm; ii) a ratio between a height standard deviation and the average height of the bristle field is at least 0.075; iii) at least 20% of the bristles have a height between 9 mm and 14 mm; iv) a bristle density for the field is at least 3 bristles/cm^2 and at most 20 bristles/cm^2; v) a ratio between a bristle width standard deviation and a bristle width average for the bristle field is at least 0.07; vi) for at least one arbitrary vector v, for a word length selected from the group consisting of 3 and 4, for a MAPPING physical property that is width/thickness, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has a LEVEL N variety where N is an integer selected from the group consisting of 1, 2, 3, 4 and 5.

A hairbrush comprises a bristle-retaining surface and a bristle field of at least 100 bristles that are individually deployed to the bristle-retaining surface such that: i) at least 80% of the bristles of the field have a height that is between 5 mm and 20 mm; ii) a ratio between a height standard deviation and the average height of the bristle field is at least 0.075; iii) at least 20% of the bristles have a height between 9 mm and 14 mm; iv) a bristle density for the field is at least 3 bristles/cm^2 and at most 20 bristles/cm^2; v) a ratio between a bristle width standard deviation and a bristle width average for the bristle field is at least 0.07; vi) for at least one arbitrary vector v, for a word length of 4, for a MAPPING physical property that is width/thickness, for an inner radius of a neighborhood-defining annulus that is 2 mm and an outer radius of a neighborhood defining annulus that is 12 mm, for an ordering direction that is CLOCKWISE, for a substantially co-linear bristle tolerance that is 20 degrees, at least a majority that is at least 50% of the bristles of the bristle field are members of a 40-set that is a sub-set of the bristle field having 40 members that has at least a LEVEL 2 variety.

A hairbrush comprises a bristle-retaining surface and a bristle field of at least 100 bristles that are individually deployed to the bristle-retaining surface such that bristle heights vary in a substantially random manner and are substantially independent of bristle location on the bristle-retaining surface, the bristle field providing the following properties: (i) height properties such that at least 5 different heights that significantly differ from each other are represented; ii) width properties such that at least 80% of the bristles of the bristle field has a width that is at least 0.5 mm; and iii) bristle end properties such that at least 60% of the bristles have a rounded end.

A hairbrush comprises a bristle-retaining surface and a bristle field of at least 100 bristles that are individually deployed to the bristle-retaining surface such that a distal end surface defined by ends of bristles of the bristle field is irregularly and substantially randomly shaped, the bristle field providing the following properties: (i) height properties such that at least 5 different heights that significantly differ from each other are represented; (ii) width properties such that at least 80% of the bristles of the bristle field has a width that is at least 0.5 mm; and (iii) bristle end properties such that at least 60% of the bristles have a rounded end.

A hairbrush comprises a bristle-retaining surface and a bristle field of at least 100 bristles that are individually deployed to the bristle-retaining, an average height of the bristle field being defined as HEIGHT_AVG, a height standard deviation of the bristle field being defined as HEIGHT_SD, the field of bristles providing height properties, width properties and bristle end properties such that: (i) according to the width properties, at least 80% of the bristles of the field has a width that is at least 0.5 mm; (ii) according to the bristle end properties, at least 60% of the bristles of the field have a rounded end; and (iii) according to the height properties: the bristle field provides at least 5 different heights that significantly differ from each other are represented; the bristle field includes at least one height outlier subset (HOS) having a count that is at least 10% of the total bristle count of the bristle field, the height outlier subset HOS being selected from the group consisting of: a very-tall-bristles (VTB) subset of bristles whose height exceeds a sum of HEIGHT_AVG and HEIGHT_SD; and a very-short-bristles (VSB) subset of bristles whose height is less than a difference between HEIGHT_AVG and HEIGHT_SD, wherein bristles of the bristle field are individually deployed to the bristle-retaining surface so that there is a contrast between the deployment of the bristle field as a whole and the deployment of at least one height outlier subset HOS, such that while the bristles of bristle field as a whole are deployed at substantially a constant density within a selected area SA of the bristle-retaining surface, the bristles of the height outlier subset HOS are scattered at irregular and non-periodic locations within the selected area SA.

In some embodiments, the bristles are individually deployed to the bristle-retaining surface.

A hairbrush comprising a bristle-retaining surface and a bristle field of at least 100 bristles that are deployed to the bristle-retaining surface the bristles being constructed of a variety of materials having different flexibilities, each bristle being constructed of a respective material, bristle material flexibility per bristle varying in a substantially random manner and is substantially independent of bristle location on the bristle-retaining surface, the bristle field providing the following properties: (i) at least 70% of the bristles have a height between 5 mm and 25 mm; (ii) a ratio between a height standard deviation and the average height of the bristle field is at least 0.075; (iii) the variation of bristle material flexibilities among different bristles is equivalent to the variation of bristle flexibility for a fixed height that is the average height of the field that would be obtained if a ratio between a bristle width standard deviation and a bristle width average was at least 0.07; (iv) width properties such that at least 80% of the bristles of the bristle field has a width that is at least 0.5 mm; and (v) bristle end properties such that at least 60% of the bristles have a rounded end.

In some embodiments, at least 90% of the bristles have a height between 5 mm and 25 mm.

In some embodiments, the height standard deviation and the average height of the bristle field is at least 0.12.

In some embodiments, the variation of bristle material flexibilities among different bristles is equivalent to the variation of bristle flexibility for a fixed height that is the average height of the field that would be obtained if a ratio between a bristle width standard deviation and a bristle width average was at least 0.07.

In some embodiments, at least a coverage majority that is at least 50% of a bristle-covered portion of the bristle retaining surface is covered with bristle field having one or more of random or semi-random height properties, random or semi-random width properties, and random or semi-random material flexibility properties.

In some embodiments, the coverage majority is substantial majority whose size is selected from at least 60%, at least 70%, at least 90% and at least 95%.

In some embodiments, for the field of bristles, the tallest 20% of the bristles of the field has an average height denoted by H1 and an average thickness denoted by T1; the shortest 20% of the bristles of the field has an average height denoted by H2 and an average thickness denoted by T2, and a ratio between T1 and T2 is at least 1.1.

In some embodiments, the ratio between T1 and T2 is at least 1.2.

In some embodiments, the ratio between T1 and T2 is at least 1.3.

In some embodiments, the ratio between H1 and H2 is at least 1.3 and/or at most 2.

BRIEF DESCRIPTION OF THE DRAWINGS

FIG. 14 illustrates results of testing a hairbrush.

DETAILED DESCRIPTION OF EMBODIMENTS

The claims below will be better understood by referring to the present detailed description of example embodiments with reference to the figures. The description, embodiments and figures are not to be taken as limiting the scope of the claims. It should be understood that not every feature of the presently disclosed methods and apparatuses is necessary in every implementation. It should also be understood that throughout this disclosure, where a process or method is shown or described, the steps of the method may be performed in any order or simultaneously, unless it is clear from the context that one step depends on another being performed first. As used throughout this application, the word "may" is used in a permissive sense (i.e., meaning "having the potential to'), rather than the mandatory sense (i.e. meaning "must").

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

By employing a hairbrush whose "bristle end" surface defined by the ends of the bristles have uneven, non-periodic, properties (for example, having semi-random or random properties), it is possible to detangle hair in a relatively 'low-pain' or 'no-pain' manner. In tests conducted under the supervision of the present inventor, it was discovered that this use of a 'low-pain' or 'no-pain' hairbrush (i.e. constructed according to presently-disclosed feature(s) and combinations thereof) significantly reduces the amount of time required to detangle human or animal hair (for example, longer hair) and significantly reduces the amount of pain associated with hair detangling, even for wet hair and/or wet hair that has not been treated with conditioner.

Figure 1A:
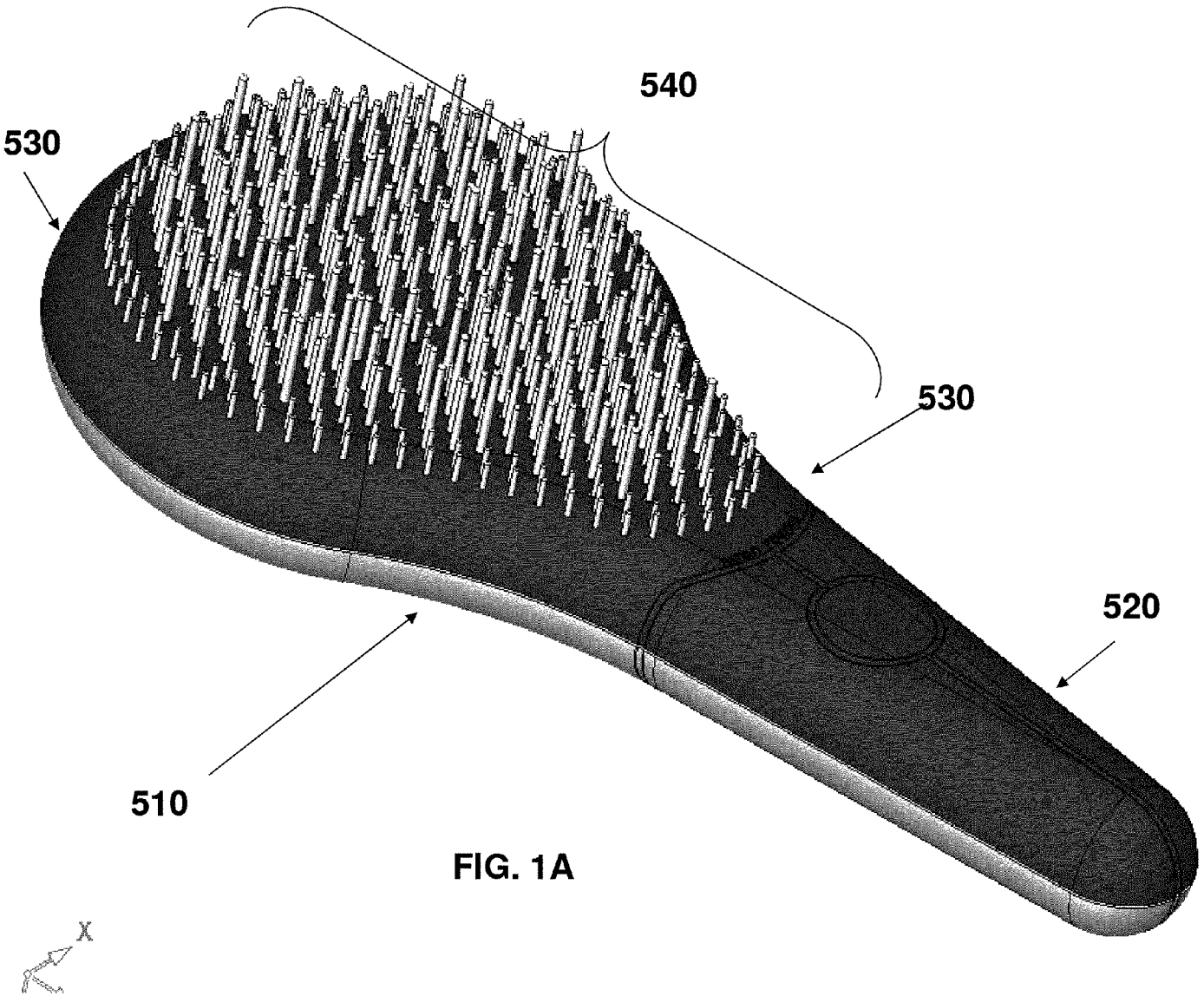
FIGS. 1A-2B illustrate an exemplary hairbrush according to some embodiments.

FIGS. 1-2 are drawings of one non-limiting example of such a novel 'low-pain detangling' hairbrush.

Not wishing to be bound by any particular theory, it is noted that that the lengths of human hair are typically not equal, and typically vary in some sort of random or semi-random fashion, despite the fact that the average hair length may be the same throughout the head or throughout regions thereof. The present inventor has postulated that it is possible to facilitate relatively low-pain and/or no-pain hair detangling by varying bristle lengths and/or thicknesses and/or material flexibilities in a substantially random manner over the bristle-retaining surface of the hairbrush in a manner that mimics, at least in part, the random or semi-random variations of hair length and/or of hair thickness.

Thus, according to this line of reasoning, the hair brush and in particular the shape of the "bristle end" surface defined by the distal ends has a certain amount of disorder or entropy and is therefore 'compatible' with the hair to be tangled. Furthermore, this bristle geometry (as opposed to a situation where the bristle lengths are constant or vary in some 'ordered' manner) may be useful for distributing tension or pulling force associated with detangling hair, reducing the amount of tension in any single location.

Throughout the text and FIGS. a number of possible features are disclosed. It is to be appreciated that (i) not every feature is required in every embodiment; and (ii) any combination of features (i.e. all features or any subset of features including combinations not explicitly listed in the present document) may be provided in any given embodiment.

FIGS. 1-2 illustrate a hairbrush according to some embodiments of the present invention. Hairbrush 500 includes a brush body 510 and bristles deployed on a region 540 of bristle-retaining surface 530 of the brush body 510. In addition, the brush body includes a handle 520.

The more central portion of region 540 is labeled as 560, while the 'edge portion' of region 540 is labeled as 570. An 'inner field' of bristles resides in this more central portion 560; an 'outer field' of bristles' resides in the edge portions 570.

Reference is made to FIG. 2. In FIG. 2, the "bristle end surface" (illustrated by the broken, dotted line) defined by the distal ends of bristles is illustrated. The term bristle end surface" 550 does not require any extra material to be present other than the bristles themselves—instead, this term describes the surface which may be interpolated from the ends of the bristles.

One salient feature of this bristle end surface 550 within the more central portion 560 of bristle-retaining surface 530 is that the bristle end surface 550 is irregularly shaped substantially without any observable periodicity and with clearly observable stochastic/random properties.

Not wishing to be bound by theory, it is believed that the hair itself may define a "hair surface" defined by the ends of the hair and/or the portions of hair strands that are 'highest' above the surface of the skull. This "hair surface" (NOT SHOWN) also may provide a certain level of semi-randomness or randomness or disorder or entropy, especially when the hair is tangled. It is postulated that because the distal end surface 550 provides these non-periodic/semi-random/random properties (similar to the 'hair surface'), this facilitates better penetration of the bristles themselves into the hair surface in a manner that does not induces strong pulling forces or tension.

Figure 1B:
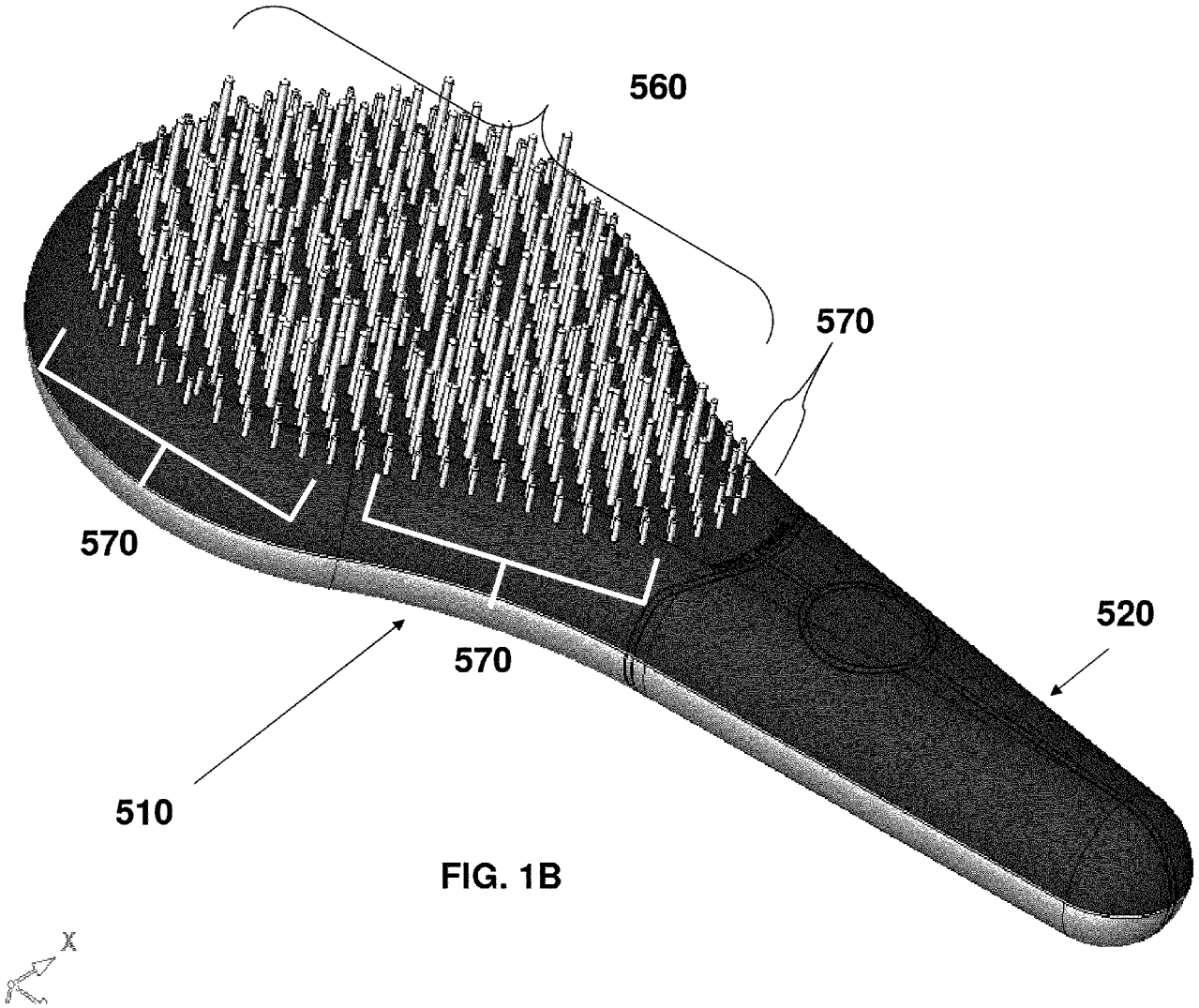
Figure 2A:
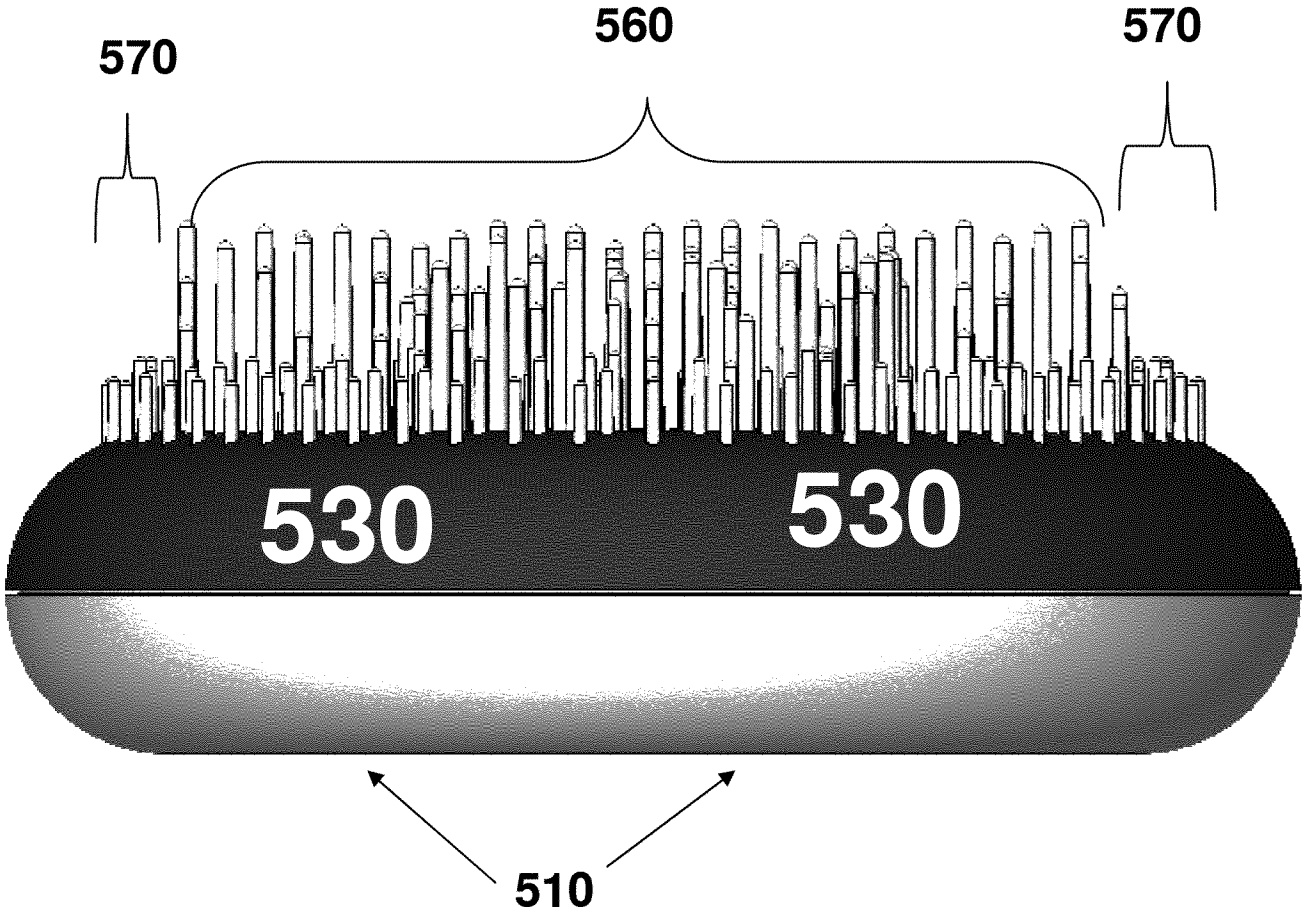

As can be observed from FIGS. 1B and 2A, in the region 570 near the edge of bristle retaining surface bristles are much shorter than in the more central region 560. This optional 'outer field of bristles' (in contrast to the inner field of bristles whose bristles reside in the more central 560 region) may in some embodiments facilitate the penetration of the bristles of the inner field into the user's hair in a relatively 'smooth' manner. For example, many users brush their hair with a brush stroke so that the outer region 570 of the hairbrush near the edge encounters/contacts the hair before the inner region 560 of the brush. In this case, first the shorter bristles of the outer region will first encounter the hair first, and then the more 'aggressive' longer bristles (e.g. for hair detangling) will immediately follow.

One salient feature of the hairbrush of FIGS. 1-2 is that the majority of the 'bristle-populated' or 'bristle-covered' portion of the hairbrush (in the example of FIGS. 1-2 this is the regions 560 and 570) is configured so that some sort of random pattern is dominant in this 'majority'—i.e. a substantially random height pattern and/or substantially random width pattern and/or substantially bristle material flexibility pattern. For the case of FIG. 1B, this is a substantial majority, as the area of the outer field 570 is much less than the area of the inner field 560. For the case of FIG. 9, this is substantially the entire area. In different embodiments, this 'majority' may be a substantial majority that is at least 60% or at least 70% or at least 80% or at least 90% or at least 95% or substantially 100%.

For the case of variation of material flexibilities, the bristles may be constructed of materials of different flexibilities (e.g. some bristles are constructed of one type of material such as one type of plastic, other bristles are constructed of another type of material having a different flexibility such as another type of plastic, yet other bristles are constructed of another type of material having a yet different flexibility such as another type of plastic, etc—at least 2 or at least 3 or at least 4 or at least 5 or any number of bristle materials may one used).

Throughout the present disclosure, the term 'inner field' of bristles may refer to any field of bristles, whether or not there are additional fields of bristles that co-reside on the surface of the hairbrush. Thus, the field of bristles having random height properties may or may not be provided together with additional bristles.

It is appreciated that the hairbrush of FIGS. 1-2 is only intended as illustrative and not as limiting—however, in some embodiments, a given hairbrush may provided one or more common features with the hairbrush of FIGS. 1-2 including but not limited to features describing bristle lengths properties and/or features describing bristle width properties and/or features describing a relationship between bristle location and bristle length and/or width.

Below is an abbreviated list of some physical parameters related to the non-limiting example of FIGS. 1-2, and in particular to the field of bristles in the central region (referred to as the 'inner field of bristles'). An additional list is provided below, after the definitions section. It is appreciated that any combination of features may be provided:

(i) bristle count—in the example of FIGS. 1-2, the inner field of bristles has about 300 bristles. In different embodiments, the inner field of bristles (or of the 'field having the random height and/or width and/or material properties') may comprise at least 50 bristles or at least 100 bristles or at least 150 bristles or at least 200 bristles or at least 250 bristles. Preferably, each of these bristles has a thickness that is at least 0.5 mm (or a thickness that is at least 0.75 mm or at least 0.85 mm or at least 1 mm depending on the embodiments) and/or a height that is at least 5 mm (or at least 4 mm or at least 6 mm or at least 7 mm depending on the embodiment).

(ii) bristle height—for bristles of the inner field (or of the 'field having the random height and/or width and/or material properties'), there is a variation of bristle heights, and bristles of different heights (i.e. at least 5 or at least 8 or at least 10 or at least 12) that significantly differ from each other may be provided. In some embodiments, the average bristle height of the bristle field whose heights varies substantially randomly (e.g. 'inner field' in area 560) may be on the order of magnitude of 1 cm—for example, between 7 mm and 18 mm—for example, between 8.5 mm and 15 mm or between 8 mm and 14 mm. An additional discussion of 'bristle height' features is provided below with reference to FIGS. 5, 7 10-12.

As will be discussed below, various other properties relating to bristle height may be provided—for example, relating to a height distribution function for bristles of the 'field of bristles' (i.e. having random height properties). As is clearly visible to from FIGS. 1-2 (and from FIG. 5 which provides a height histogram), the heights within the inner field (or of the 'field having the random height and/or width and/or material properties) are by no means uniform—instead there is a noticeable and significant 'spread' amount of the heights.

(iii) bristle thickness—in some embodiments, the bristle thickness for bristles of the inner field (or of the 'field having the random height and/or width and/or material properties) is on the order of magnitude of about 1.2 mm—for example, between 0.8 mm and 2 mm. However, the actual bristle thickness may depend on the bristle material used. An additional discussion of 'bristle thickness' features is provided below with reference to FIG. 6.

(iv) bristle orientation features—as will be observed from the figures, the bristles of the 'inner field' (or of the 'field having the random height and/or width and/or material properties') will typically 'stand up straight'—i.e. be oriented substantially normally to the local plane of the bristle-retaining surface 530 and/or substantially co-linear with the local normal of the bristle surface (for example, within tolerances of 30 degrees or 20 degrees or 10 degrees.)

This may be the case for any shape/topology of bristle-retaining surface 530—for example, flat (as illustrated in FIGS. 1-2) or rounded or even a cylindrical fan brush. In some embodiments, the bristles of the 'field having the random height and/or width and/or material properties' are substantially parallel to each other (or locally parallel to each other).

(v) bristle shape features—as will be observed from the figures, the bristles are all substantially straight (rather than bent or crooked). In addition, bristles of the inner field 560 and/or outer field 570 of bristles (or any field providing the 'random height and/or width and/or material flexibility properties) may have a substantially round end. For example, a substantially majority of bristles of the 'field' that is at least 60% or 75% or 85% or 90%. This may be useful for providing a more comfortable effect when the bristles contact the scalp.

In some embodiments, a majority bristles or a substantially majority of at least 60% or at least 70% or at least 80% or at least 90%) of bristles of the 'inner field' (or any field within the 'selected area') are substantially straight.

(v) bristle density—as may be observed from the figures, within the central portion of the brush, the density of bristles tends to be substantially constant, though not exactly constant. For embodiments relating to the 'substantially constant bristle density,' there will tend not to be sizable regions within the 'inner field' (or of the 'field having the random height and/or width and/or material properties') that are devoid of bristles or regions where bristles are clearly 'overcrowded' compared to other regions.

(vi) material/attachment means—] the bristles may be constructed from a plastic material and attached to the bristle-retaining surface of the brush. One example of bristles that are 'attached' or 'deployed' to the bristle-retaining surface is where the bristles are glued to or stapled to or fastened the 'brush surface' of 'bristle retaining surface.' In another example, the bristles may integrally formed with the brush surface. For example, the brush surface and the bristles may be constructed of the same material—it is possible to product a special mold that conforms to the shape of the bush surface and the bristles—the geometric properties of this mold may determine the 'length properties' or 'thickness properties' or 'bristle density properties' or any other geometric properties of the bush including the bristles. This 'integrally formed' brush is another example of bristles that are 'attached' or 'deployed' to the bristle retaining surface.

Figure 2B:
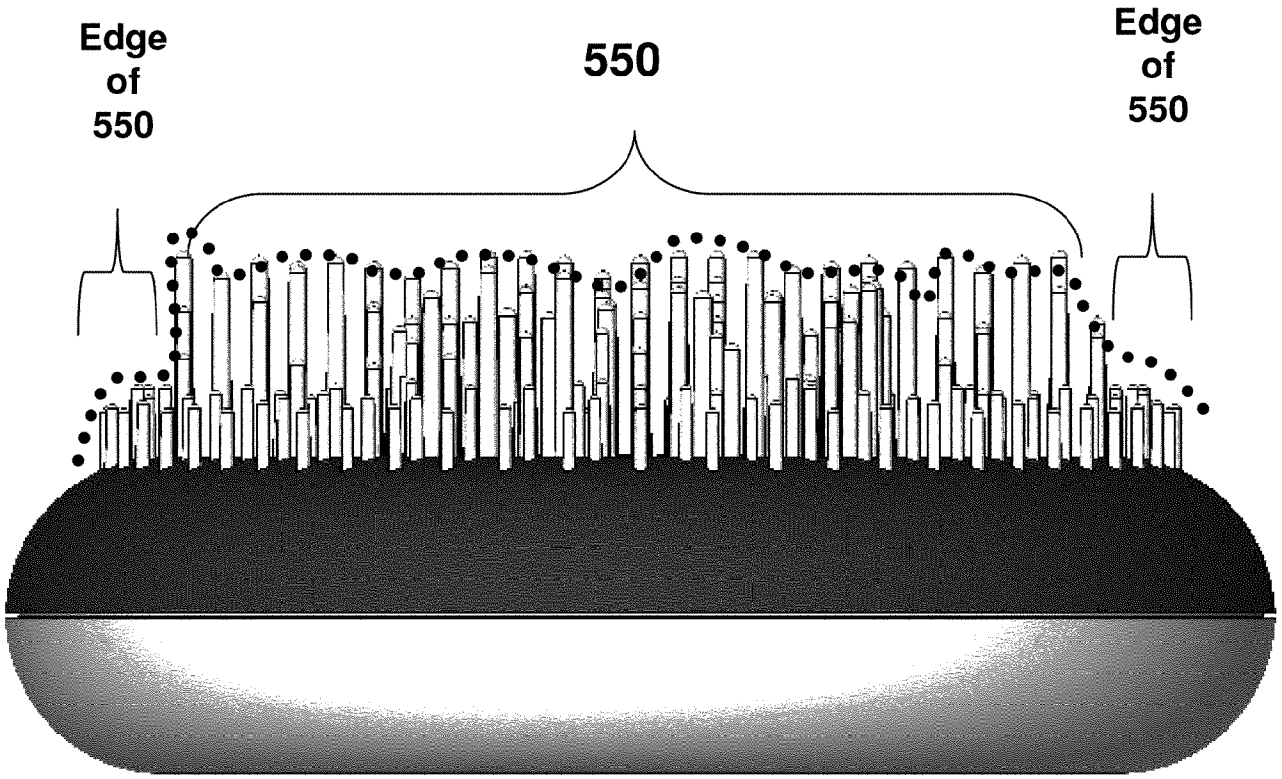

(vii) uniform local-average height—one feature that is clearly observable from FIG. 2B is that within the 'inner region' even if there is significant variation among the heights over individual bristles, the local-average height of each bristle may vary to a much lesser extent. In some embodiments, throughout the region of the 'field having the random height and/or width and/or material properties,' the local averaged height of each bristle along with the neighboring significant bristles (i.e. neighboring bristles whose height is significant—for example, at least 30%) may fluctuate to a much lesser extent than the heights of the bristles themselves. Thus, in the event that the distal bristle surface 550 is smoothed in a neighborhood (for example, having a radius of around 7.5 mm and/or a radius equal to the average bristle height within a tolerance of 50% or 40% or 30% or 20% or 10%), it may be found that the 'neighborhood-smoothed' distal bristlal surface is substantially constant.

Definitions

For convenience, in the context of the description herein, various terms are presented here. To the extent that definitions are provided, explicitly or implicitly, here or elsewhere in this application, such definitions are understood to be consistent with the usage of the defined terms by those of skill in the pertinent art(s). Furthermore, such definitions are to be construed in the broadest possible sense consistent with such usage.

Embodiments of the present invention relate to bristle fields where bristles are deployed to the hairbrush surface such that bristle heights 'vary in a substantially random manner that is substantially independent of bristle location on the bristle-retaining surface.'

For the present disclosure, when bristle heights/lengths of a field of bristles 'vary in a substantially random manner that is substantially independent of bristle location on the bristle-retaining surface,' (i) it is possible to view the bristles together as a coherent unit or 'field' (ii) there is no visually determinable (i.e. other than randomness) pattern for bristle length/height of the bristles of the field of bristles; and (iii) it is thus visually clear that the bristles of the bristle field have a 'substantially random' height pattern.

It is appreciated that additional optional objects or features that do not obscure/cancel the visibly-observable 'substantially random' height pattern of bristles of the 'field of bristles' described in the previous paragraph may be provided. In one example, the hairbrush topology may be other than the flat topology illustrated in FIGS. 1-2.

In another example, there may be additional bristles beyond that at least 100 or at least 150 or at least 200 or at least 250 bristles of the 'field of bristles.' for example, located in an outer field or in any other location on the bristle-retaining surface. In a particular example, the additional bristles may be 'short' bristles that are substantially shorter the bristles of inner field having the 'random height properties' or 'thin' bristles or may have any other geometry. However, for embodiments providing the substantially random height properties, these additional optional objects or features would not obscure/cancel the visibly-observable 'substantially random' height pattern of bristles.

Thus, bristles of the outer field of the edge 570 in FIGS. 1-2 may or may not have the 'random height properties'—however, it is clear that their presence (or the presence of any other 'additional' bristles in any location) does not obscure the random height property observable in the 'inner field.'

The term 'substantially random' implies that the height pattern (or width or flexibility pattern) does not need to be exactly mathematically random pattern as long as these visible patterns described above are present.

When a physical and/or statistical property of a 'field of bristles' having random height and/or width and/or material stiffness features (or any other group of bristles or field of bristles) is discussed, it is clear that this refers to only to the field of bristles that provide that 'random height properties' and not to any additional bristles. Such physical and/or statistical properties may relate to bristle density or height or thickness or material or any other property. Certain measured physical and/or statistical properties for the 'field of bristles' hairbrush of FIGS. 1-2 are discussed with respect to various figures.

Embodiments of the present invention relate to the case where the bristles of the 'field of bristles' having the observable height and/or thickness and/or material flexibility pattern are "individually deployed' to not deployed in tufts or bristles or bundled of bristles. Instead, the bristles are individually deployed to the bristle-retaining surface—i.e. each bristle is separately deployed to the bristle-retaining surface.

Thus, as is illustrated in FIGS. 1-2, the bristles and/or their 'bases/bottoms/proximal ends' are spaced from each other and are not 'bunched together' as is known in the art for 'bundles of bristles' or 'tufts of bristle.' Instead, they are each 'individually' deployed as illustrated in the figures.

Another salient feature of bristles that are not deployed as tufts or bundles (but are rather independently deployed) is the fact that the bristles may be parallel to each other. In some embodiments, a majority or most (i.e. at least 70% or at least 80% or at least 90%) of the bristles of a population are all 'locally parallel'—i.e. parallel to all neighboring bristles of the population—e.g. all bristles of the population of bristles closer than 1 cm or closer than 0.5 cm. Thus, even for the case of bristles deployed to a cylindrical brush, it may be said that these bristles which are not deployed in tufts or bundles are locally parallel.

When a distal bristle surface has a shape that 'varies in a substantially random manner,' this refers to a situation where there is no visually determinable (i.e. other than the randomness) pattern for bristle distal surface. Once again, there may be additional bristles (which may or may not have stochastic height properties) present other than the 'field bristles' that form the bristle distal surface (for example, much shorter bristles than the field bristles of the 'mostly random or irregular or non-periodic' portion of the distal bristle surface. However, the additional bristles would not nullify the clearly-observable random-like or irregular surface shape pattern of the bristle distal surface 550 (or a portion thereof).

Some embodiments relate to the case where a number of different heights (i.e. at least 5 or at least 8 or at least 10 or at least 12) 'significantly differ from each other' are provided or represented within a field of bristles. The term 'significantly different' heights for bristles refers is relative to functionality of brushing the hair, as opposed to very small (e.g. microscopic) height variations, for example, due to the manufacturing process. These significantly different heights are clearly visible to the user who views the brush with his/her naked eye—see FIGS. 1-2. In examples relating to FIGS. 1-2 (and as is discussed in more detail with reference to FIG. 5 which is a height histogram of the inner field), the 'range' of the at least five different heights that are substantially different from each other is one the order of magnitude of at least several mm.

When a bristle is 'substantially stiff' this means that even if the bristle is mostly stiff, there may still be some flexibility—for example, to make brushing a less painful experience. Thus, the term 'substantially stiff' refers to 'stiff enough to serve its purpose'—to penetrate into the hair region and to detangle hair.

A 'bristle' is will have enough of a thickness and be constructed of a material in order to serve this purpose. In some embodiment, the bristle may has a thickness/width that is at least 0.5 mm (i.e. for the case of plastic).

Figure 3A:
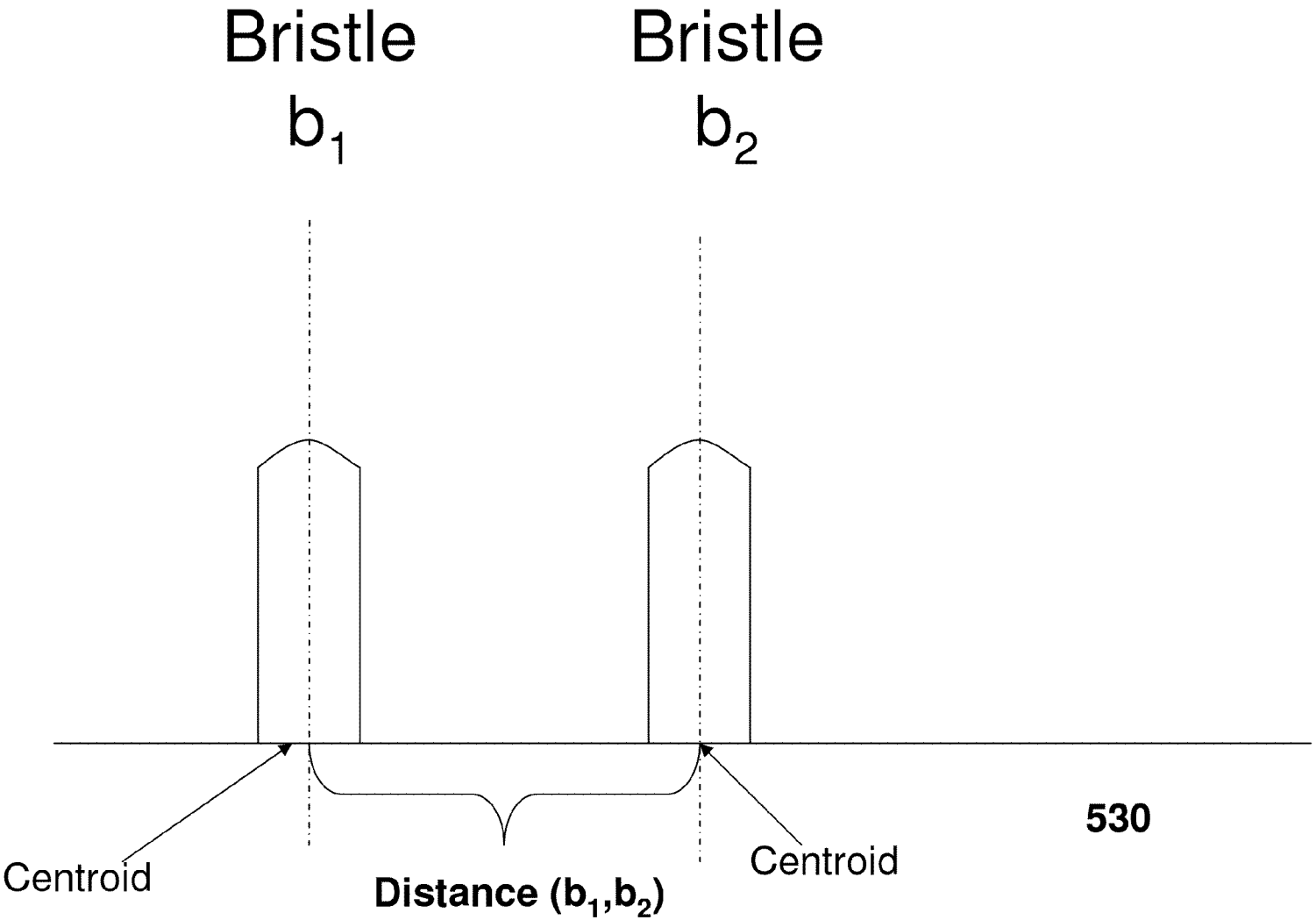
FIGS. 3A-3B illustrates the distance between a pair of bristles in some embodiments.
Figure 3B:
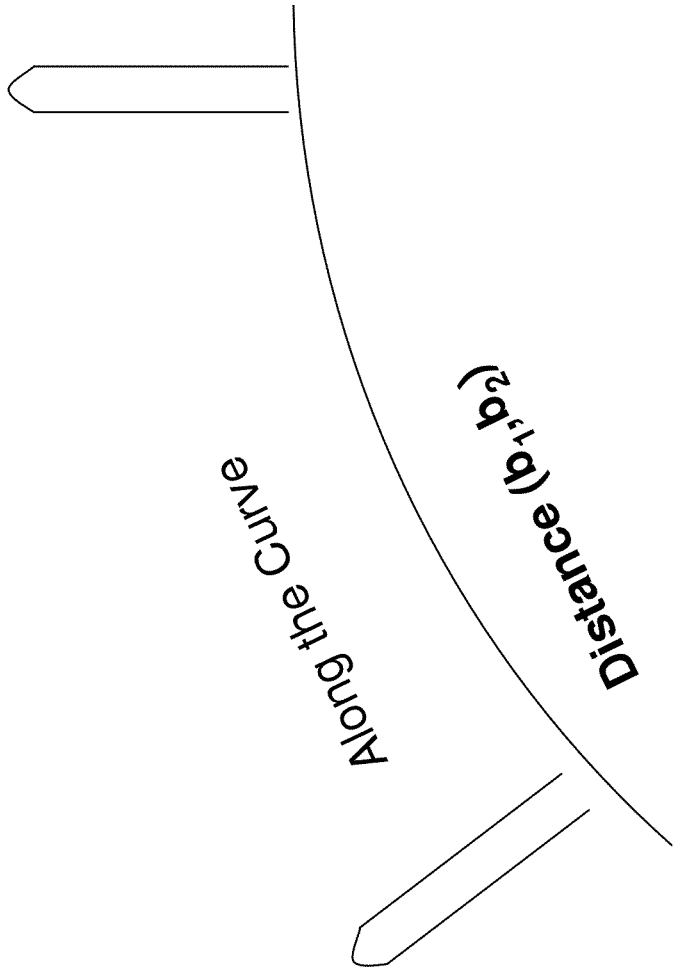

Referring to FIGS. 3A-3B, it is noted that the 'distance between bristles' (denoted in FIGS. 3A-3B as DISTANCE ($b_1$, $b_2$) between bristles $b_1$ and $b_2$) relates to the distance between their centroids at their respective 'bottom/base/root/proximal ends of bristles' along the surface 530 of the hairbrush.

The 'location' of a bristle is the location is the center/centroid of the bristle on the brush surface (i.e. at a 'height' above local the brush surface of 'zero). The 'distance between bristles' refers to the center-center distance.

The term 'bristle-retaining surface' is not intended to limit to a particular type of surface but is merely intended to provide a name for the surface to which bristles are deployed.

For the present disclosure, when bristle widths/thicknesses of a field of bristles 'vary in a substantially random manner that is substantially independent of bristle location on the bristle-retaining surface,' (i) it is possible to view the bristles together as a coherent unit or 'field' (ii) there is no visually determinable (i.e. other than randomness) pattern for bristle length/height of the bristles of the field of bristles; and (iii) it is thus visually clear that the bristles of the bristle field have a 'substantially random' height pattern.

Below is a list of various features categorized by 'feature types' describing features that may be provided by bristles of the inner field of bristles 560. Any feature pertaining to an 'inner field of bristles' may, in one or more embodiments, relate to a field of bristles having random height and/or random width and/or random material flexibility properties, regardless of whether or not an 'outer field' is present. In different embodiments, any combination of features may be provided.

A Discussion of FIG. 4—Count Features and Density Features

Figure 4A:
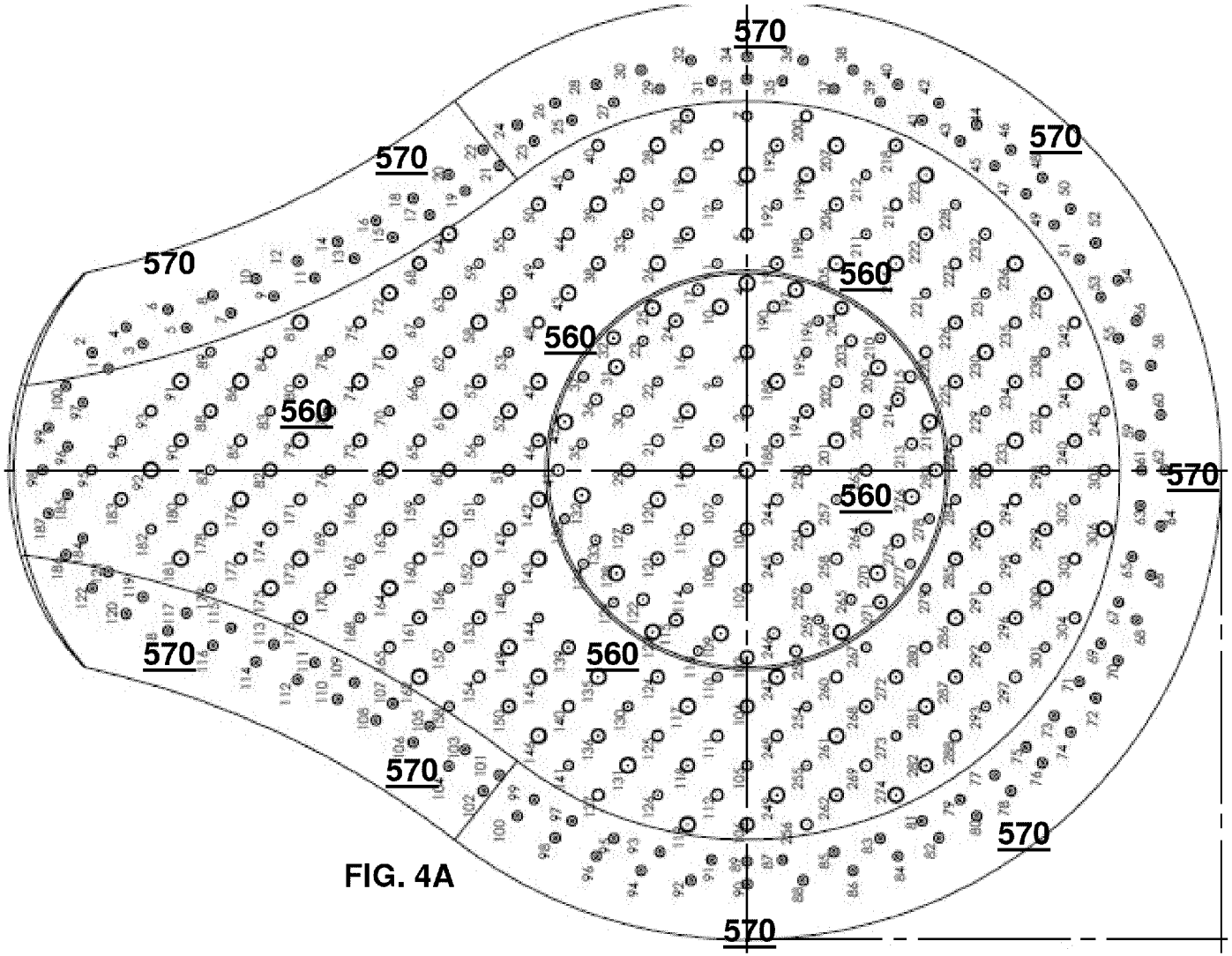
FIGS. 4A-4D illustrates locations of various bristles of a hairbrush of FIGS. 1-2 in some embodiments.
Figure 4B:
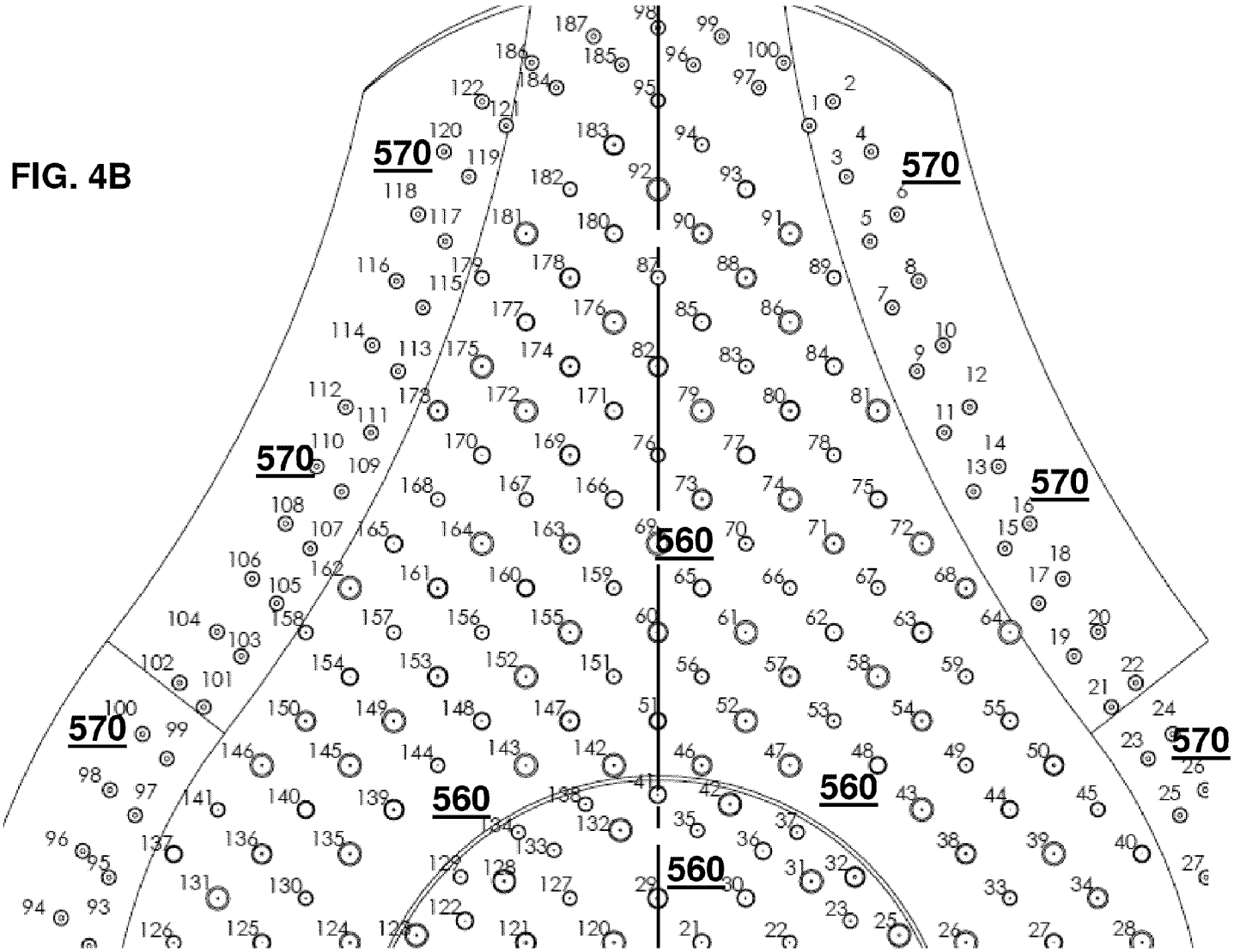
Figure 4C:
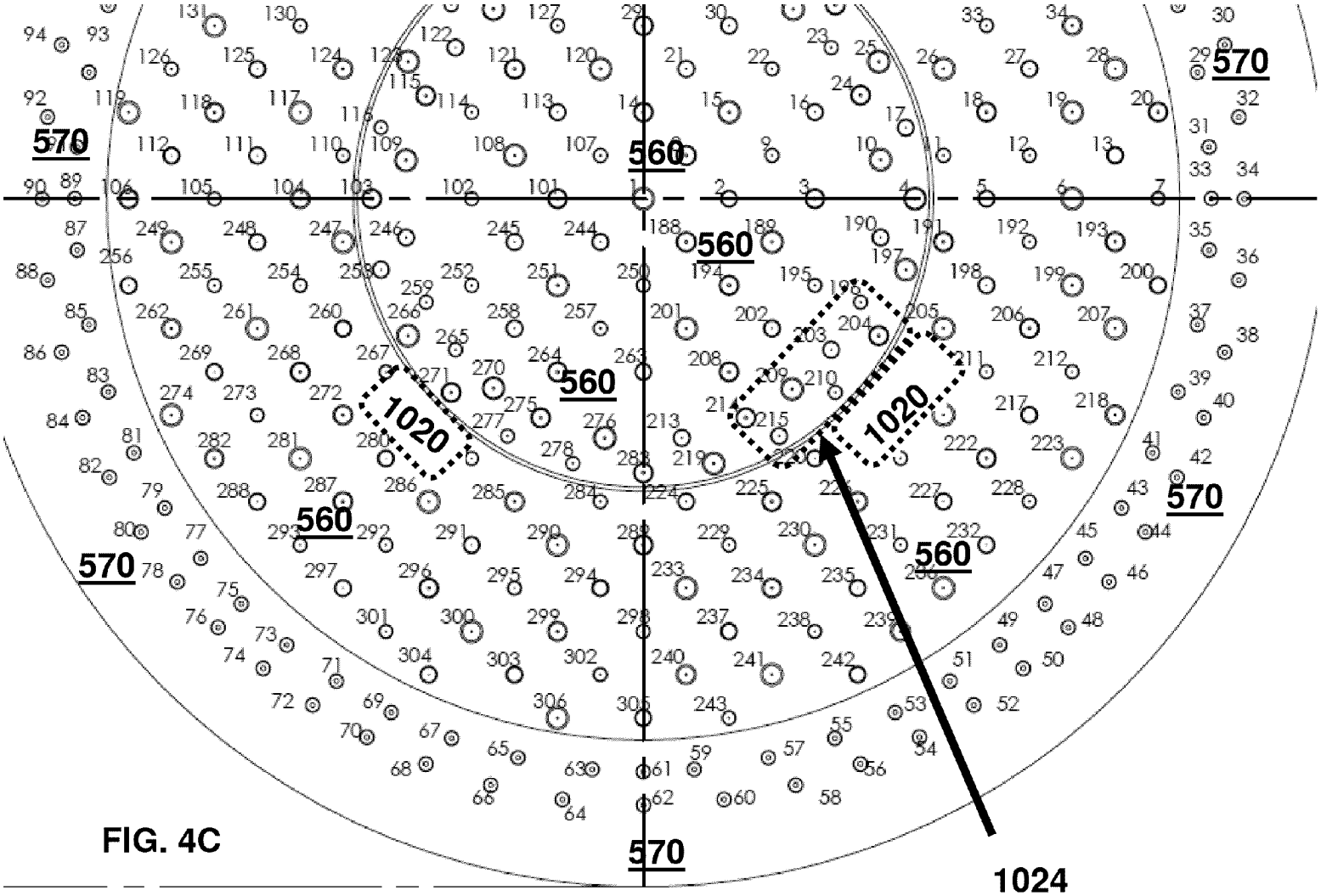
Figure 4D:
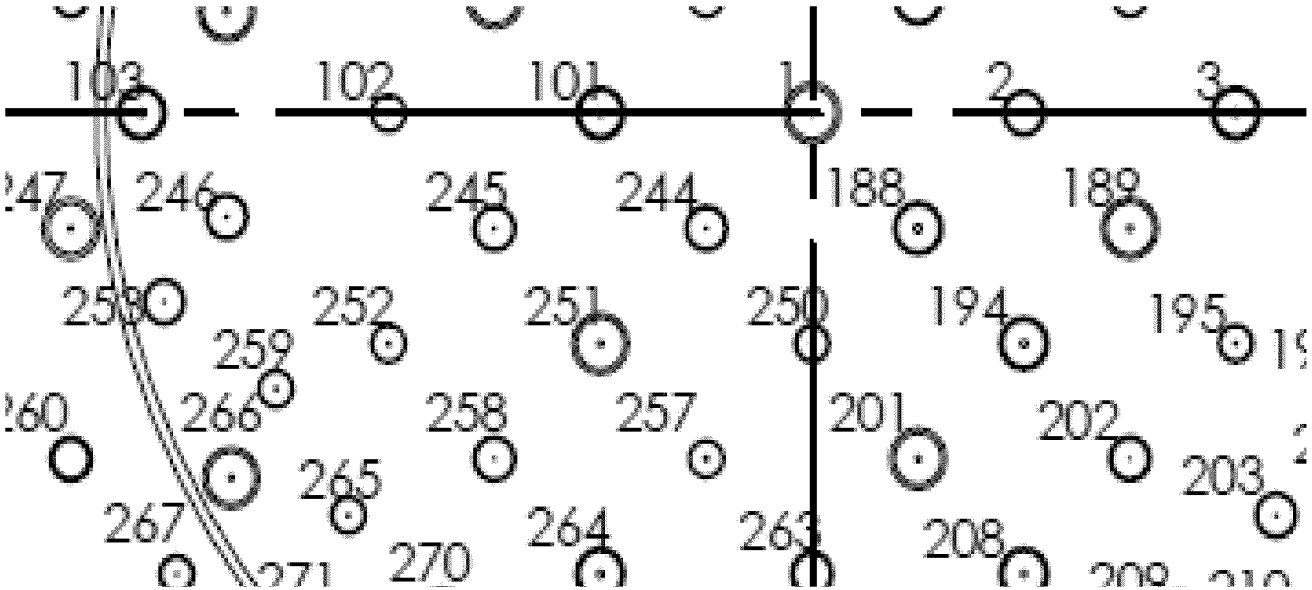

FIG. 4A is a map of bristle locations for the non-limiting hairbrush of FIGS. 1-2. FIGS. 4-4D illustrate certain subregions of the map of FIG. 4A. As may be observed from FIG. 4A, in the example of FIGS. 1-2 the inner field of bristles 560 (which for the particular case of FIGS. 1-2 is the 'selected area' of bristles where the random bristle length pattern may be observed), includes about 300 bristles. This is just for one particular base, and more or fewer bristles may be provided within the 'selected area.'

In different embodiments, the number of bristles of the 'selected area' of bristles where the random bristle length pattern may be observed is at least at least 100 or at least 150 or at least 200 or at least 250 bristles.

Bristles of at least 100 or at least 150 or at least 200 or at least 250 bristles may have specific properties—for example, (i) a bristle thickness/width/diameter of these bristles is at least 0.5 mm or at least 0.7 mm or at least 0.8 mm or at least 0.9 mm and/or (ii) a bristle height that is at least 3 mm or at least 5 mm or at least 7 mm and/or (iii) a bristle height that is at most 25 mm or at most 22 mm or at most 20 mm or at most 18 mm or at most 16 mm.

In some embodiments, at least 50% or at least 70% or least 80% or at least 90% or at least 95% of all bristles in the 'selected area' have a thickness that is at least at least 0.8 mm or at least 0.9 mm or at least 1 mm.

Another salient feature that is may be observed from FIG. 4 is that the bristles are deployed within the inner region at a 'substantially constant density.' In some embodiments, it may be preferred for the density to not be exactly constant, but to permit (or even prefer) relatively small fluctuations' in bristle density.

For example, there may be relatively small regions 1020 within the inner field that are devoid of bristles (or have a much lower density), and there may be relatively small regions 1024 within the inner field that have a relatively higher density—however, these variations are relatively small, and do not cancel the overall 'substantially constant density' pattern of bristles of the 'inner field' and/or 'the field exhibiting the random height and/or width and/or material flexibility pattern.'

In some embodiments, the bristle field comprising at least 100 or at least 150 or at east 200 or at least 250 bristles is deployed on an area of bristle-retaining surface 530 of the hairbrush whose size is between about 20 and 100 cm^2—for example, between about 30 and about 50 cm^2, As will be discussed below, different bristle densities and ranges for bristles of the 'inner field' (or any other random-property field) may be provided.

As noted above, it is evident from FIG. 4 that, in some embodiments, while some spatial fluctuation in bristle density (i.e. for bristles of the 'inner field' and/or for bristles whose height is at least a minimum height that is at least 4 mm or at least 5 mm or at least 6 mm or at least 7 mm or at least 8 mm and/or for bristles whose thickness is at least a minimum thickness that is at least 0.5 mm or at least 0.7 mm or at least 0.85 mm or at least 1 mm or more) may be permitted or even desired (see regions 1024 or 1020 of FIG. 4), it may be desirable for the overall density of bristles of the inner field to be substantially constant.

Figure 5:
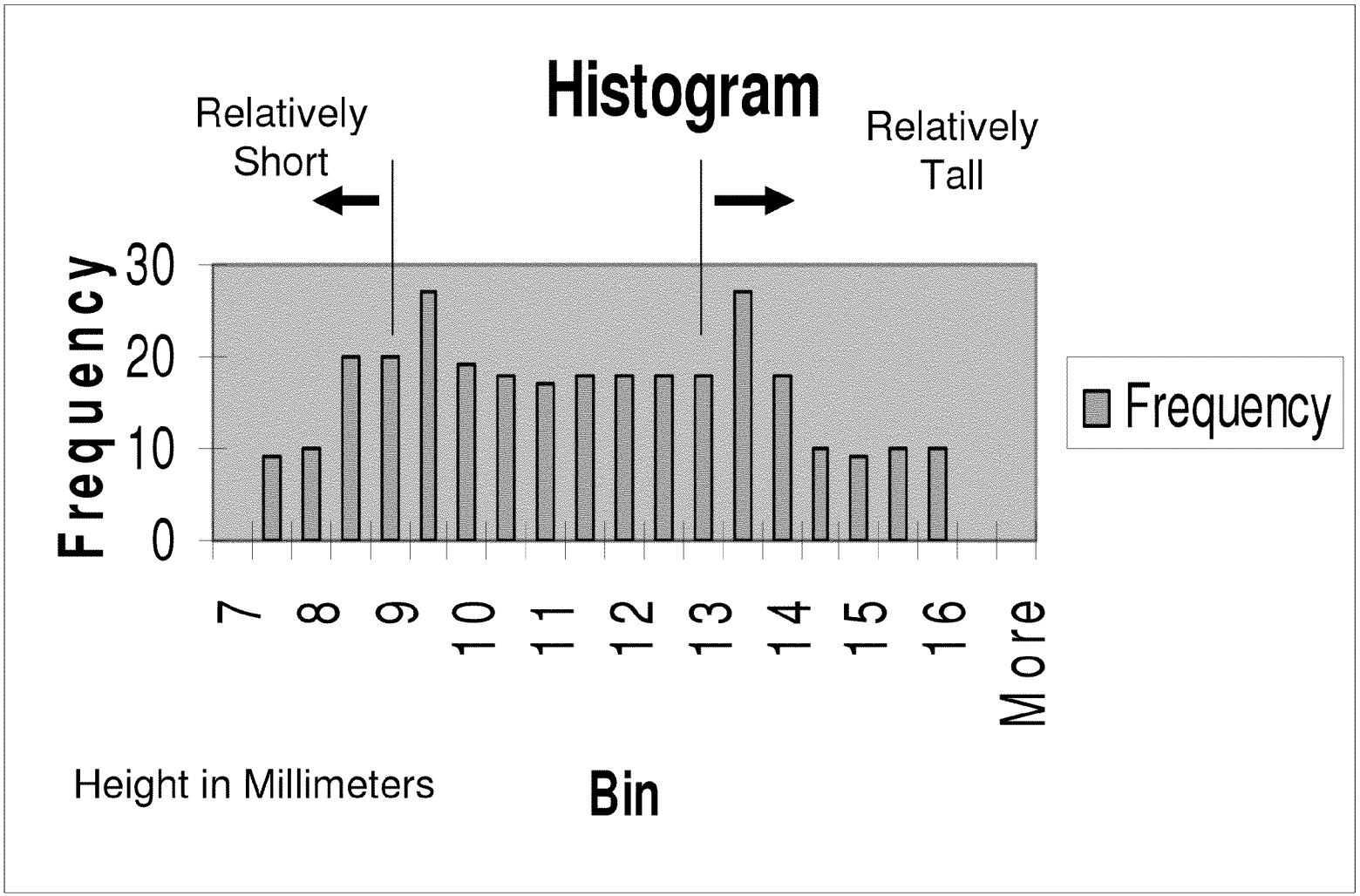
FIGS. 5 and 11 are height histograms.

A Discussion of FIG. 5—Height Features

Statistical properties of bristle heights for the inner field of bristles (i.e. in region 560) for the particular example of FIGS. 1-2 were computed. Table 1 is a summary statistics table for this height distribution.

TABLE 1

| | |
|---|---|
| Mean | 11.34222973 |
| Standard Error | 0.136397356 |
| Median | 11.2 |
| Mode | 11.7 |
| Standard Deviation | 2.346668846 |
| Sample Variance | 5.506854672 |
| Kurtosis | −1.052072931 |
| Skewness | 0.176770335 |
| Range | 8.3 |
| Minimum | 7.5 |
| Maximum | 15.8 |
| Sum | 3357.3 |
| Count | 296 |

For the particular example of FIGS. 1-2 where the inner field includes 296 bristles, the average bristle height is 11.3 mm and the height standard deviation is 2.34 mm. For the example of FIGS. 1-2, the ratio between the height standard deviation and the average height (i.e. the height SD/average height ratio) is 0.21.

FIG. 5 is a 'height histogram' describing the frequency of heights whose values lie within certain 'bins.'

Inspection of FIG. 5 reveals that not all of the heights are the same—instead, there is a certain height 'spread' and a variety of heights are provided. In different embodiments (as can be seen from FIG. 5), a number of different heights (i.e. at least 5 or at least 8 or at least 10 or at least 12 or at least 15 or at least 20 heights) that 'significantly differ from each other' is provided. The term 'significantly different' heights for bristles refers is relative the functionality of brushing the hair, as opposed to very small (e.g. microscopic) height variations, for example, due to the manufacturing process. These significantly different heights are clearly visible to the user who views the brush with his/her naked eye.

In different embodiments, the bristles of the inner field have a 'minimum length' or a 'maximum length' (this relates only to inner field bristles—additional non-inner field bristles may have any other length). Not limited by theory, for the former case, shorter bristles may not be able to function to separate/detangle hair. Not limited by theory, for the later case, longer bristles may 'interfere' with the hair detangling process and/or increase the amount of pain and/or not serve a positive detangling functionality.

In some embodiments, at least 50% or at least 60% or at least 70% or at least 80% or at least 90% or at least 95% or at least 99% (any combination is possible) of the bristles of the inner field (or any 'random properties field') may have a minimum length that is at least 6 mm or at least 7 mm or at least 8 mm or at least 9 mm and/or may have a maximum length that is at most 20 mm or at most 19 mm or at most 18 mm or at most 17 mm or at most 16 mm or at most 15 mm (any combination is possible—for example, at least 60% have a length that is at least 7 mm and at least 80% have a length that is at most 16 mm or any other combination).

FIG. 5 describes a situation where the height range of bristles within area 560 is between about 7 mm and about 16 mm. In different embodiments, the height range for bristles within area 560 may be between about 3.5 mm (in some embodiments between about 6 mm) and about 16 mm—for example—thus, in some embodiments, substantially all (for example, at least 80% or at least 90%) bristles are within this height range—i.e. between any one of the four height ranges: (a) 3.5 mm to 16 mm (b) 3.5 mm to 18 mm (c) 6 mm to 16 mm; and (d) 6 mm to 18 mm.

Inspection of FIG. 5 indicates that even if the height distribution of bristles is exactly not uniform, the height distribution may have some properties of a uniform height distribution. For example, in some embodiments, a first fraction (for example at least 5% or at least 10% or at least 15% or at least 20%) of the bristle population of the inner field are 'short bristles' having a height in a relatively 'short' range (height range 1), a second fraction for example at least 5% or at least 10% or at least 15% or at least 20% or at least 25%) of the bristle population of the inner field are 'medium height bristles' having a height in a relatively 'medium height' range (height range 2), and a third fraction (for example at least 5% or at least 10% or at least 15% or at least 20%) of the bristle population of the inner field are 'tall bristles' having a height in a relatively 'tall height' range (height range 3). Any combination of these percentages may be provided.

In one example, relatively short bristles have a height between 5 mm and 9 mm of bristles of the inner field (height range S1), the 'medium height' bristles have a height between 9 mm and 13 mm (height range M1), and the 'tall bristles' have a height between 13 mm and 18 mm (height range T1). This may be true for 'relatively flat brushes'—for fan brushes, the height numbers may be 10-20% higher. (S1 is a first version of 'short'; M1 is a first version of 'medium'; T1 is a first version of 'tall'; S2 is a second version of 'short'; M2 is a second version of 'medium': T2 is a second version of 'tall'.

In another example, relatively short bristles have a height between 5 mm and 9.5 mm of bristles of the inner field (height range 1), the 'medium height' bristles have a height between 9.5 mm and 12.5 mm (height range 2), and the 'tall bristles' have a height between 12.5 mm and 18 mm (height range 3).

In some embodiments, the number of bristles of the inner field (or field having the 'random' properties) in a height range of S1 and/or M1 and/or T1 and/or S2 and/or M2 and/or T2 (any combination may be provided) is at least 10 bristles and/or at least 20 bristles and/or at least 30 bristles and/or least 40 bristles (any combination may be provided).

The terminology COUNT(S1) is the count of bristles of the inner field (or field having the 'random' properties) whose height is in the S1 height range. This may relate to S1, M1, T1 S2, M2, and/or T2.

In different embodiments, any of the following ratios (any combination of ratios or any combinations of upper/lower bounds) may be) at least 0.2 or at least 0.3 at least 0.4 or at least 0.6 or at least 0.7 or at least 0.8 and/or at most 2 or at most 1.5 or at most 1.2 or at most 1 or at most 0.8 or at most 0.6 or at most 0.4 or at most 0.3 or at most 0.2 L: ratio between COUNT(S1) and COUNT(M1) and/or a ratio between COUNT(S2) and COUNT(M2) and/or a ratio between COUNT(T1) and COUNT(M1) and/or a ratio between COUNT(T2) and COUNT(M2) Any combination may be provided.

This relatively 'uniform' bristle height distribution may apply to the population of bristles of 'meaningful height' for detangling hair deployed within the 'selected area' 560. In different embodiments, this set of bristles having a 'meaningful height for detangling' bristles (defined as bristles having a minimum height of 2.5 mm (or 3 mm or 3.5 mm or 4 mm or 4.5 mm or 5 mm) and a maximum height of 17.5 mm (or 21 mm or 20 mm or 19 mm or 18 mm or 17 mm)—any combination of these number is possible) deployed within the selected area has the minimum count discussed in the previous section—at least 100 or at least 150 or at least 200 or at least 250 bristles and/or also a minimum thicknesses of at least 0.5 mm or at least 0.7 mm or at least 0.8 mm or at least 0.9 mm.

In different embodiments, the height SD/average height ratio bristles of the inner field (or any other field having 'random properties' deployed in any selected area is at least 0.05 or at least 0.075 or at least 0.1 or at least 0.125 or at least 0.15 or at least 0.2 and/or at most 0.6 or at most 0.5 or at most 0.4 or at most 0.3 or at most 0.25. Once again, this indicates a 'height spread.'

In different embodiments, the average height of bristles of the inner field (i.e. for example, bristles in a the 'meaningful height' range of about 2.5 mm to about 17.5 mm) is at least 6 mm at least 7 mm or at least 8 mm or at least 8.5 mm and/or at most 16 mm or at most 15 mm or at most 14 mm or at most 13 mm or at most 12 mm. Any combination of these values may be employed in any embodiment.

In different embodiments, for the bristles of the inner field the height standard deviation of the population of bristles of the inner field may be at least 1 mm or at least 1.5 mm or at least 2 mm and/or at most 5 mm or at most 4 mm or at most 3 mm.

Obviously, any combinations of height standard deviation minimums and any combination of height standard deviation maximums and/or height averages may be provided.

In some embodiments, the bristle field is substantially all of the bristles (i.e. at least 70% or at least 80% or at least 90% or at least 95% or at least 99%) in a given 'selected area' (for example, the region of 560 in FIGS. 2-3) whose height has any height feature or combination of features disclosed herein and/or whose width has any width feature or combination of features disclosed herein.

Figure 6:
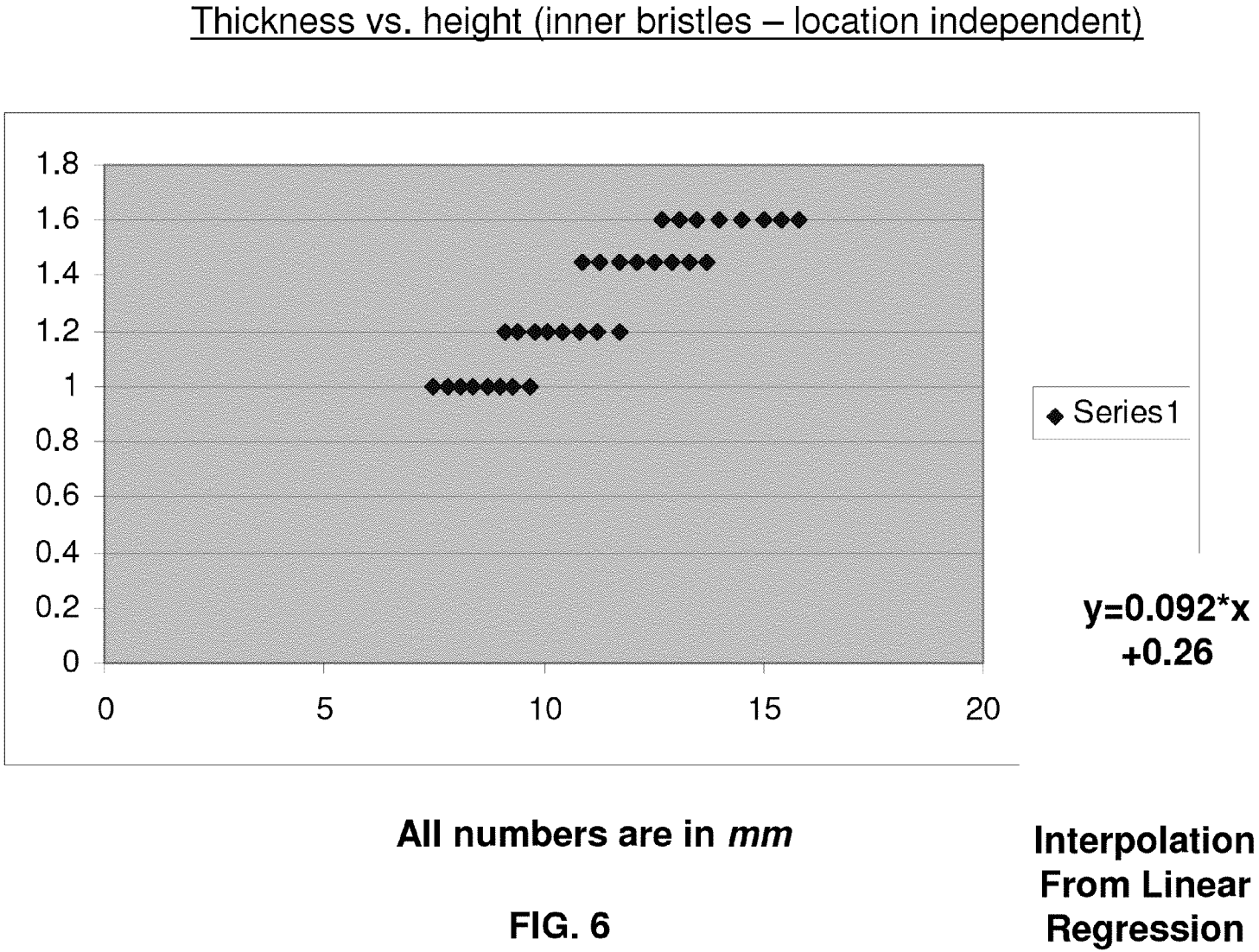
FIG. 6 illustrate bristle thickness properties.

Bristle Width Features—a Discussion of FIG. 6

As noted above, the bristles that have a width that is at least 0.5 mm—for example, this may be the threshold for 'individual' non-bundle bristles (i.e. for most materials from which hairbrushes are typically constructed—e.g. most plastics) where 'non-tuft' and 'non-bundle' bristles (i.e. individually deployed) are thick enough to meaningfully penetrate into the hair region and detangle hair.

In different embodiments, the bristles of the inner field have a 'minimum thickness' or a 'maximum thickness length' (this relates only to inner field bristles—additional non-inner field bristles may have any other length).

In some embodiments, at least 50% or at least 60% or at least 70% or at least 80% or at least 90% or at least 95% or at least 99% (any combination is possible) of the bristles of the inner field (or any 'random properties field') may have a thickness length that is at least 0.5 mm or at least 0.7 mm or at least 0.85 mm or at least 0.9 mm or at least 1 mm or at least 1.1 mm or at least 1.2 mm and/or may have a maximum thickness that is at most 3 mm or at most 2.5 mm or at most 2 mm or at most 1.8 mm or at most 0.5 mm or at most 1.3 mm (any combination is possible).

Furthermore, embodiments of the present invention relate to hairbrushes where a variety of widths (or material flexibilities) are provided. n some embodiments, instead of all of the bristles having the same width (or the same material flexibility), it is possible to provide a variety of bristles widths (for example, at least 2 or at least 3 or at least 4 or at least 5) that significantly differ from each other.

FIG. 6 illustrates bristle width (y-axis) as a function of bristle height (x-axis) for the non-limiting case of FIGS. 1-2 (i.e. for the inner field in region 560 or for any other bristle field providing random height or width or material flexibility properties). As may be observed from FIG. 6:

(i) there are multiple widths that significantly differ from each other—in the example of FIG. 6, some bristles of the inner field have a width that is about 1, some bristles of the inner field have a width that is about 1.2, some bristles of the inner field have a width that is about 1.4, and some bristles of the inner field have a width that is about 1.6;

(ii) there is a clear correlation between the bristle height and the bristle thickness—i.e. taller bristles tend to be thicker.

Alternatively or additionally, the taller bristles may be constructed of a less flexible material.

It is noted that, in general, longer bristles tend to be more flexible than shorter bristles. Not wishing to be limited to by theory, if the inner field (or any 'random properties field') provides a both relatively tall bristles and relatively short bristles, it is possible that are relatively long tall bristles will exhibit a much greater degree of flexibility than the relatively short bristles. In order to mitigate this effect (or for any other reason), it may be useful to configure the hairbrush so that the more taller bristles are 'reinforced' with a greater thickness (alternatively or additionally, constructed of a less flexible material) while shorter bristles are constructed with a lesser thickness or of more flexible material to counteract their tendency to be 'too stiff.'

This may be possible for providing a situation where bristle stiffness varies less than would otherwise be observed and/or may even be substantially constant The skilled artisan would appreciate the difference between 'material stiffness" or 'material flexibility' on the one hand, and 'bristle stiffness' or 'bristle flexibility' on the one hand (i.e. this would be determined by at least the combination of material flexibility/stiffness, bristle height and bristle thickness).

Embodiments of the present invention relate to situations where bristles are deployed to the bristle-retaining surface such that bristle heights vary in a substantially random manner and are substantially independent of bristle location on the bristle-retaining surface. For embodiment where these is a clear correlation between bristle height and bristle thickness (for example, where the taller bristles are thicker as in FIG. 6), then it is clear that the bristle thickness (or alternatively, material flexibility) may also vary in a substantially random manner that is substantially independent of bristle location on the bristle-retaining surface.

In different embodiments, one or more of the following features may be provided for the 'inner field' of bristles (or any field of bristles having any 'random properties'):

(i) the average bristle thickness may be at least 0.85 mm or at least 1 mm or at least 1.15 mm or at least 1.25 mm.

(ii) the average bristle thickness may be at most 2.5 mm or at most 2 mm or at most 1.75 mm or at most 1.5 mm or at most 1.4 mm;

(iii) a variety of thicknesses are provided, with the standard deviation of thickness, with the standard deviation of the bristle thickness being at least 3% or at least 5% or at least 7% or at least 10% or at least 12% or at least 15% of the average bristle thickness;

(iv) in some embodiments, the standard deviation of the bristle thickness is at most 50% or at most 40% or at most 30% or at most 20% of the average bristle thickness;

(v) there is a 'positive correlation' between bristle thickness and bristle heights so that on average, the taller bristles are thicker, and the shorter bristles are thinner (see FIG. 6—where the 'x' axis is bristles height in mm and the 'y' axis is bristle thickness in mm—it is clear from FIG. 6 that the taller bristles tend to be thicker—this may useful for providing a mixture of different bristle flexibilities)

(vi) In some embodiments relating to this 'positive correlation' (see FIG. 6), the tallest 20% of the bristles of the population has an average height denoted by H1 and an average thickness denoted by T1; the shortest 20% of the bristles of the population has an average height denoted by H2 and an average thickness denoted by T2; in this example, a ratio between T1 and T2 may be at least 1.1 or at least 1.2 or at least 1.3 or at least 1.4 or at least 1.5.

(vii) In one example (ie. either in the context of height in general OR in the context of the 'positive correlation between height and width'), the ratio between H1 and H2 may be at least 1.1 or at least 1.3 or at least 1.4 or at least 1.5 and/or at most 3 or at most 2.5 or at most 2 or a 1.75 or at most 1.5.

(viii) some or most or all bristles of the bristle population of inner field 560 may tend to be somewhat or substantially stiff.

In some embodiments, the bristle field is substantially all of the bristles (i.e. at least 70% or at least 80% or at least 90% or at least 95% or at least 99%) in a given 'selected area' (for example, the region of 560 in FIGS. 2-3) whose height has any height feature or combination of features disclosed herein and/or whose width has any width feature or combination of features disclosed herein.

In some embodiments, for a majority (or a substantial majority Of bristles that is at least 60% or at least 70% or at least 80% or at least 90% or at least 95%), a ratio between a bristle length and a bristle width is at least 2.5 at least 3 or at least 4 or at least 5 and/or at most 30 or at most 25 or at most 20 or at most 15 or at most 10.

Figure 7:
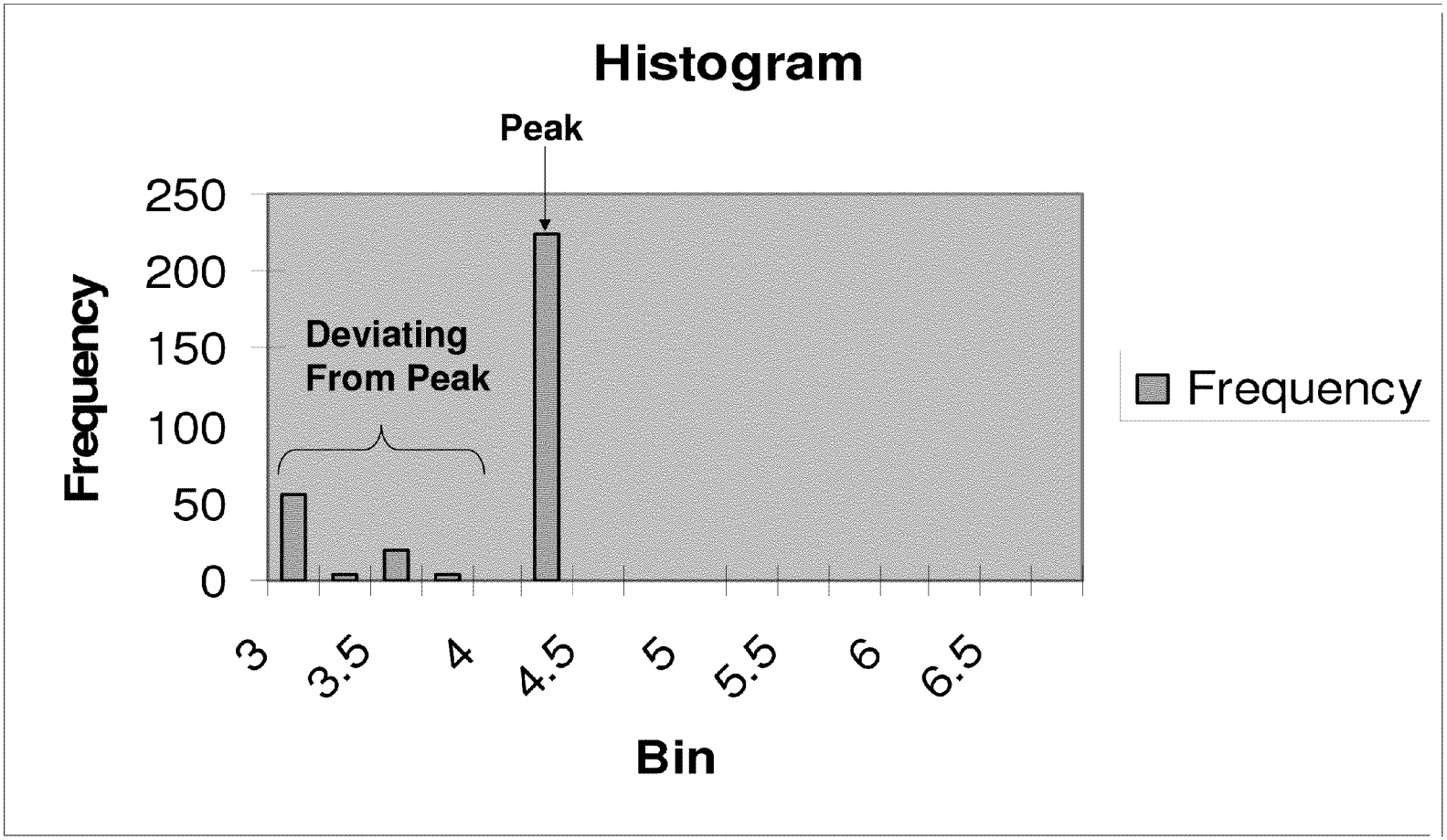
FIGS. 7 and 12A-12D are histograms relating to closest bristle distances.

Nearest Bristle Histogram—a Discussion of FIG. 7

For a field of N bristles (N is a positive integer) deployed to a hairbrush surface, the bristles of the field may be denoted as $\{b_1, b_2, \ldots b_N\}$. For the kth bristle $b_k$, the bristle field provides a set of N−1 numbers $\{\text{DISTANCE}(b_i, b_k), \text{DISTANCE}(b_2, b_k) \ldots \text{DISTANCE}(b_{k-1}, b_k), \text{DISTANCE}(b_{k+1}, b_k) \ldots \text{DISTANCE}(b_N, b_k)\}$—the minimum value of this N−1 number of this distance set is the distance between the bristle $b_k$ and the 'closest distance' other bristle. Thus, each bristle $b_k$ (k is a positive integer between 1 and N) is associated with a respective 'closest bristle distance.'

These numbers were computed for the 'inner field' of bristles for the example of FIGS. 1-2. A histogram of these numbers is presented in FIG. 7—statistical parameters are displayed below:

| | |
|---|---|
| Mean | 3.892409525 |
| Standard Error | 0.034380749 |
| Median | 4.235575522 |
| Mode | 4.242640687 |
| Standard Deviation | 0.600433964 |
| Sample Variance | 0.360520945 |
| Kurtosis | 0.234056063 |
| Skewness | −1.350398162 |
| Range | 2.252640687 |
| Minimum | 1.99 |
| Maximum | 4.242640687 |
| Sum | 1187.184905 |
| Count | 305 |

Thus, for bristles of the 'inner field' and/or field having random properties, the average value of the closest bristle 3.89, and the standard deviation is 0.6. The ratio between the standard deviation and the mean is 0.15. In different embodiments, this ratio may be at least 0.05 or at least 0.075 or at least 0.1 or at most 0.5 or at most 0.4 or at most 0.3 or at most 0.25 or at most 0.2.

In different embodiments, the average value of the closest bristle of bristles of the inner field may be at least 2 mm and/or at least 2.5 mm and/or least 3 mm and/or at most 7 mm and/or at most 6 mm and/or at most 5 mm and/or at most 4 mm.

In different embodiments, the average value of the closest bristle of bristles of the inner field (where the average height of bristles of the inner field is $H_{AVG}$) may be at least $0.15*H_{AVG}$ and/or at least $0.2*H_{AVG}$ and/or at least $0.25*H_{AVG}$ and/or least $0.3*H_{AVG}$ and/or at most $0.7*H_{AVG}$ and/or at most $0.6*H_{AVG}$ and/or at most $0.5*H_{AVG}$ and/or at most $0.4*H_{AVG}$ and/or at most $0.3*H_{AVG}$.

In different embodiments, each bristle of at least 50% or least 60% or at least 70% or at least 90% or at least 95% or bristles of the 'inner field' (or any other field with random bristles properties) may have respective 'closest bristles' value describing to the closets bristles that is also in the 'inner field' (or any other field of bristles having random properties) that is at least 2 mm and/or at least 2.5 mm and/or least 3 mm and/or at most 7 mm and/or at most 6 mm and/or at most 5 mm and/or at most 4 mm.

In different embodiments, each bristle of at least 50% or least 60% or at least 70% or at least 90% or at least 95% or bristles of the 'inner field' (or any other field with random bristles properties) may have respective 'closest bristles' value describing to the closets bristles that is also in the 'inner field' (or any other field of bristles having random properties) that is of the inner field (where the average height of bristles of the inner field is $H_{AVG}$) may be at least $0.15*H_{AVG}$ and/or at least $0.2*H_{AVG}$ and/or at least $0.25*H_{AVG}$ and/or least $0.3*H_{AVG}$ and/or at most $0.7*H_{AVG}$ and/or at most $0.6*H_{AVG}$ and/or at most $0.5*H_{AVG}$ and/or at most $0.4*H_{AVG}$ and/or at most $0.3*H_{AVG}$ In some embodiments, i) each bristle b of the bristle field (i.e. inner field or 'random-property' field) is associated with a respective nearest bristle distance describing the respective closest distance between bristle b and any other bristle of the same bristle field; ii) a ratio between a standard deviation of the nearest bristle distances of the bristle population P and an average of the nearest bristle distances of the bristle population P is at most 0.25 or at most 0.2 (in the example of FIG. 8A it is 0.15).

Figure 8:
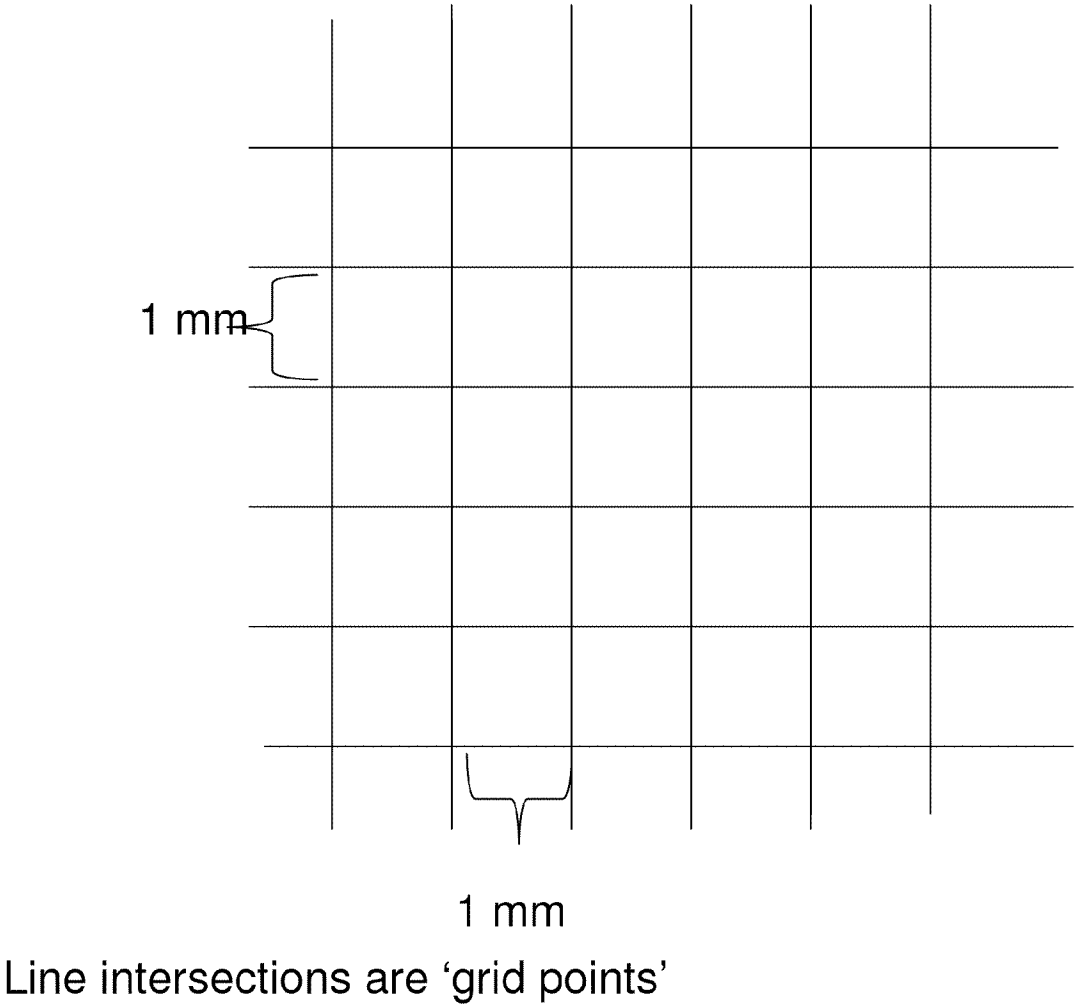
FIG. 8 illustrates grid points in some embodiments.

One salient feature of FIG. 8 is that a majority fraction of bristles of the inner field have a 'closest distance value' that is approximately a peak value or a 'representative closets distance' (i.e. within a tolerance of 5% or 10% or 15%)—this peak value is defined by the frequency of the 'peak value' or 'close' numbers within the tolerance. However, an additional subset of bristles of the field have 'deviating values' that deviate from the representative value RCDV by at least 5% or at least 10% or at least 15% or at least 20% or at least 1.2 times or at least 1.4 or at least 1.5 or at least 1, or at least 2 times 'the tolerance' for the RCDV.

Grid Value—a Discussion of FIG. 8

In some embodiments, it is possible to describe bristle density fluctuations within the region 560 of the 'inner field' (or any other region that 'hosts' a field with any random properties—e.g. height or thickness or material flexibility) as follows: (i) first a 1 mm by 1 mm square grid is placed on the 'hosting region' 560 (see FIG. 8A)—the intersecting points where perpendicular lines intersect each other are the 'grid points.'

It is possible, for each grid point, to measure the number of bristles of the inner field (or any field with the random properties) that are "close to' the grid point (i.e. less than a 'threshold distance')—for example, within 1 cm or within 7.5 mm or within 6.5 mm and/or within a distance that is $H_{AVG}$(recall: the average height of bristles of the 'random-property field' is $H_{AVG}$) or within $0.9*H_{AVG}$ or within $0.8*H_{AVG}$ or within $0.7*H_{AVG}$ or within $0.6*H_{AVG}$ or within $0.5*H_{AVG}$ using the 'bristle-bristle' distance defined with reference to FIG. 4. These distances are referred to as possible 'threshold distances.'

For the case of FIGS. 1-2, a threshold distance of 7.5 mm was used, and the number of grid points within the 'containing region' or 'host region' of the inner field was 3490 —this indicates an area of around 35 cm^2. Each given grid point was associated with a different respective 'close bristles' value describing how many bristles of the inner field (or any random-property field) were respectively less than the 'threshold distance' from the given grid point. Thus, for the example of FIGS. 1-2 having 3490 grid points, 3490 values for the 'number of close bristles' were computed. Statistics were computed on these 3490 values.

The average grid point had 10.13 bristles whose distance from the grid point was less than 'threshold' distance (see the previous paragraphs for possible definitions of the 'threshold distance'—for the example of FIGS. 1-2, the threshold distance was 7.5 mm). While the 'average value' among the grid points was 10.13 bristles, the standard deviation was only 1.31.

The relatively small SD/average ratio of 0.13 is another indication of the 'substantially-constant density of the inner field of bristles. In different embodiments, this value may be less than 0.3 less than 0.25 or less than 0.2 or less than 0.15 and/or most than 0.03 or most than 0.05 or most than 0.07 or most than 0.1.

Also, for the threshold value of 7.5 mm, the average number of bristles was 10.13—this indicates that the inner field (or any other 'random-property field of bristles) is deployed at a density of about 10.13/(3.14*0.75 cm*0.75 cm)=5.7 bristles/cm^2.

In different embodiments, the density (or the substantially constant density) of bristles of the inner field (or any other 'random-property field of bristles) may be at least 2 bristles/cm^2 or at least 3 bristles/cm^2 or at least 4 bristles/cm^2 or at least 5 bristles/cm^2 and/or at most 30 bristles/cm^2 or at most 20 bristles/cm^2 or at most 15 bristles/cm^2 or at most 12 bristles/cm^2 or at most 10 bristles/cm^2 or at most 8 bristles/cm^2 or at most 7 bristles/cm^2—any combination is possible. These inner field bristles may provide the random height and/or random thickness and/or random material flexibility properties. In some embodiments, most (i.e. at least 50% or at least 60% or at least 70% or at least 80% or at least 90%) of these bristles may all have a bristle thickness that is at least 0.5 mm or at least 0.7 mm or at least 0.85 mm and/or a bristle height/length that is at least 5 mm or at least 6 mm or at least 7 mm or at least 8 mm.

In some embodiments, the inner or 'random property' bristle field comprising at least 100 or at least 150 or at east 200 or at least 250 bristles is deployed on an area of bristle-retaining surface 530 of the hairbrush whose size is between about 20 and 100 cm^2—for example, between about 30 and about 50 cm^2, As will be discussed below, different bristle densities and ranges for bristles of the 'inner field' (or any other random-property field) may be provided.

In different embodiments, one or more (i.e. any combination of) the following features related to locations of bristles may be provided:

(i) this inner field bristles is deployed on bristle-retaining surface 530 at a density that ranges between approximately 4 bristles/cm^2 and 12 bristles/cm^2—for example, about 7 bristles/cm^2 within a tolerance of 50%. In some embodiments, this density may be at least 2 bristles/cm^23 at least 3 bristles/cm^2 or at least 4 bristles/cm^2. In some embodiments, this density may be at most 20 bristle/cm^22 or at most 12 bristles/cm^2 or at most 10 bristles/cm^2 o at most 8 bristles/cm^2;

(ii) the inner field of bristles is deployed so that a majority or even a significant majority of bristles (for example, at least 80% or at least 90% or at least 98%) reside on a constant lattice—however, a minority of bristles (for example, at least 2% or 5% or 10%) reside at positions away from the positions defined by the lattice. In one model, the inner field of bristles includes about 300 bristles, which defined about 1080 "neighboring bristle" distances where neighboring bristles were bristles separated by less than 6.5 mm—in this model, approximately 40% of these distances were exactly a first value—for example, 6 mm (within a tolerance of a few percent or even 2% or 1%), and approximately 40% of these distances were exactly a second value which differs from the first value by at least 1 or 2 mm or at least 10% or 20% or 30%—for example, 4.25 mm—however, the other distances had different values;

(iii) Each given bristle may be associated with a 'closest neighboring bristle distance—this relates the closest bristle on the hairbrush from the given bristle. In some embodiments, at least a majority or at least a substantially majority that is at least 75% of the bristles have a 'closet neighboring bristle' distance that is at least 1 mm or at least 1.5 mm or at least 2 mm or at least 2.5 mm. Without limitation, this may relate to the feature where the bristles are 'independently deployed'—i.e. as opposed to tufts or 'bundles of bristles' where the roots of the bristles are in 'bunches.' Thus, in the example, of FIG. 7 most bristles have a 'closest neighboring bristle distance' of around 4.5.

(iv) Each given bristle may be associated with a 'closest neighboring bristle that has a height of at least 5 mm distance' distance—this relates the closest bristle (i.e. among bristles whose height is at least 5 mm) on the hairbrush from the given bristle. In some embodiments, at least a majority or at least a substantially majority that is at least 75% of the bristles have a 'closet neighboring bristle that has a height of at least 5 mm distance' distance that is at least 1 mm or at least 1.5 mm or at least 2 mm or at least 2.5 mm.

(v) In some embodiments, a majority of bristles or substantial majority of at least 60% or at least 70% or at least 80% or at least 90% of the 'inner field' (or any 'random-property field') have a 'closest neighboring bristle' distance that is within 50% or 40% or 30% of an 'average closest neighboring bristle value'—in the example of FIG. 7, most bristles have a 'closest neighboring bristle value' that is about 4.5 mm. In some embodiments, at least a significant minority (for example, at least 2% or at least 5% or at least 10%) have a 'nearest bristle distance' that deviates significantly (for example, by at least 5% or at least 10% or at least 15% or least 20%) from the average and/or most popular 'nearest neighbor distance.'

Figure 9A:
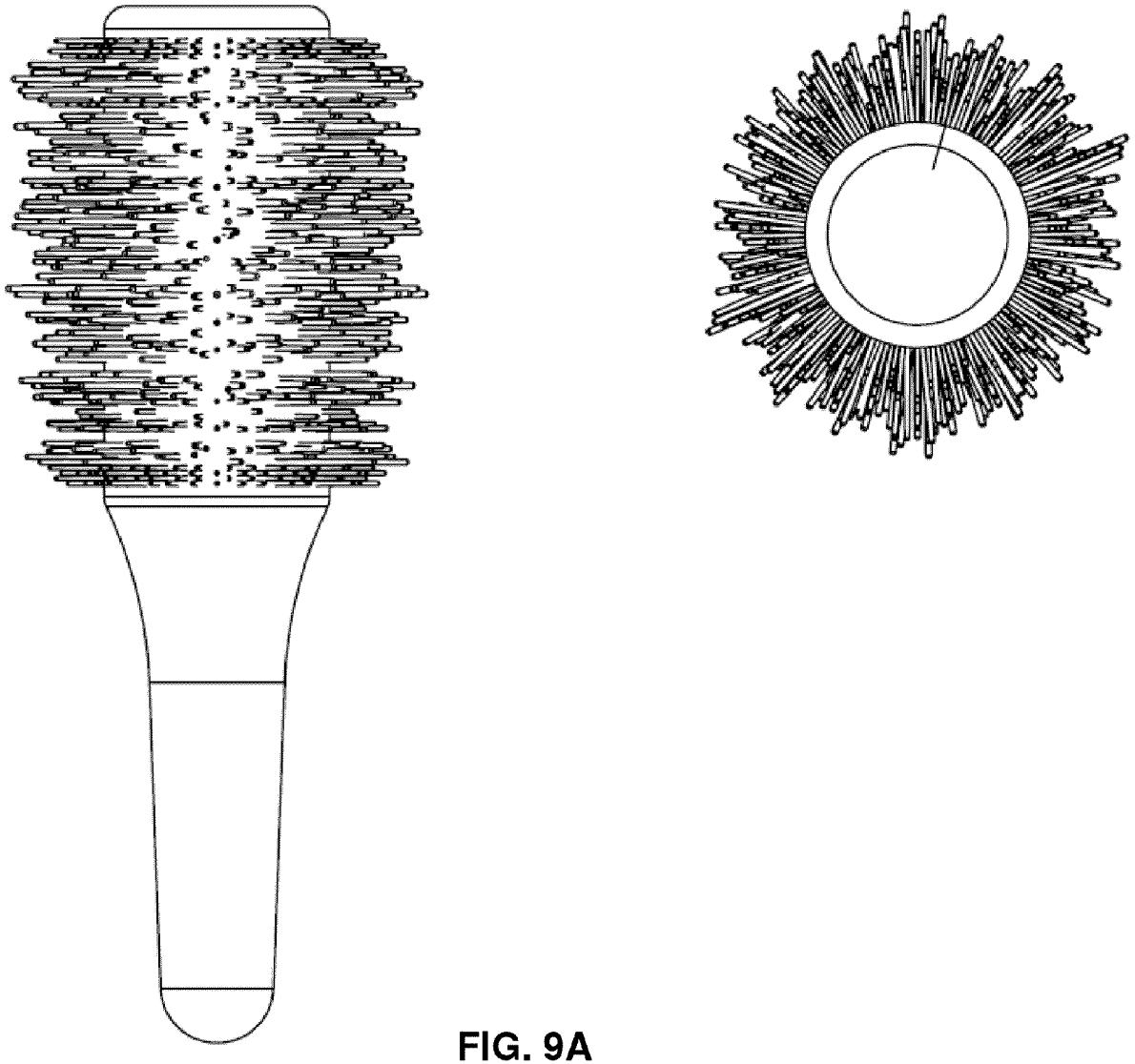
FIGS. 9A-9C illustrate a fan brush in some embodiments.
Figure 9B:
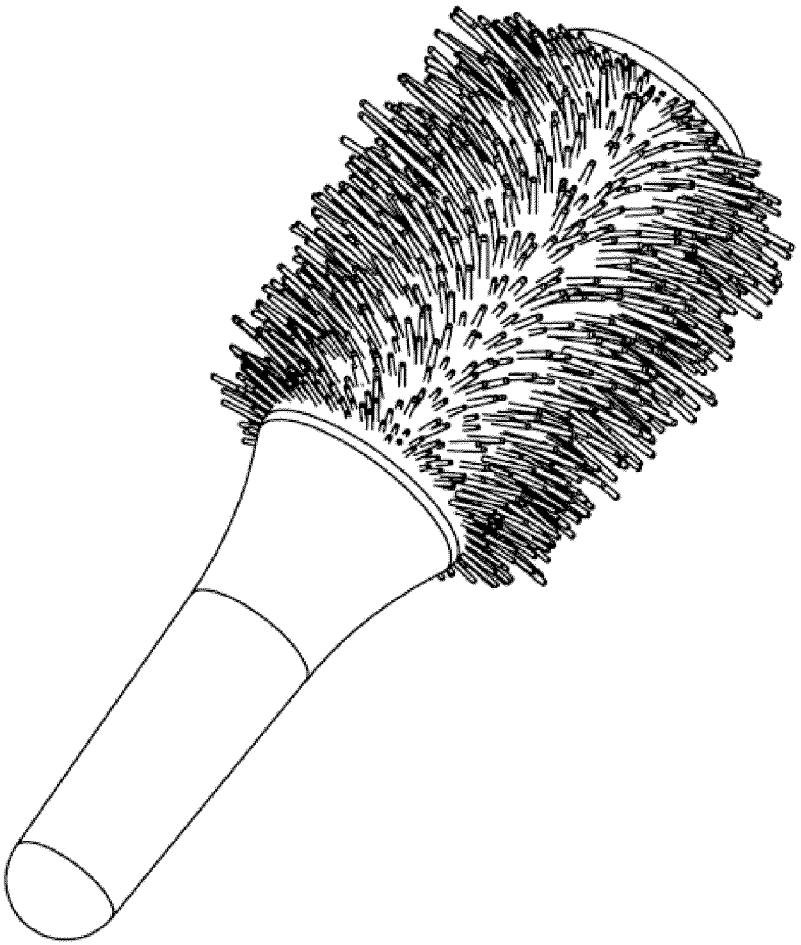
Figure 9C:
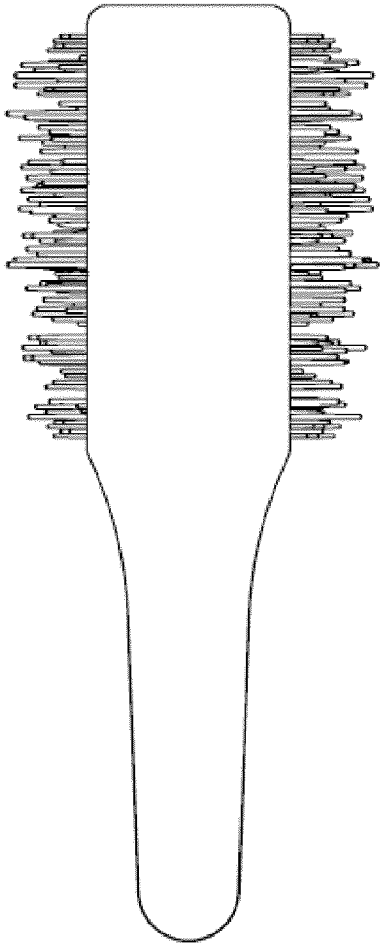

A Discussion of FIG. 9

It is noted that the example of the figures relate to the particular case of a brush with a substantially flat bristle surface to which the bristles are deployed. In some embodiments, the bristle surface may have curvature. In one example, there is visible curvature but the bristle surface may still by mostly flat. In another example (for example, related to so-called 'fan-brushes' or 'hair rollers'—see FIG. 9—or any other brush), the bristle surface may have a round shape or a substantially cylindrical shape where the bristle heights are mostly random (or have any other height feature disclosed herein) along the cylindrical or round surface of the hair brush.

In some embodiments, the brush may have any form factor including but not limited to a form factor of a pet brush (NOT SHOWN)—for example, having plastic bristles.

A Discussion of FIGS. 10A-10E

Figure 10A:
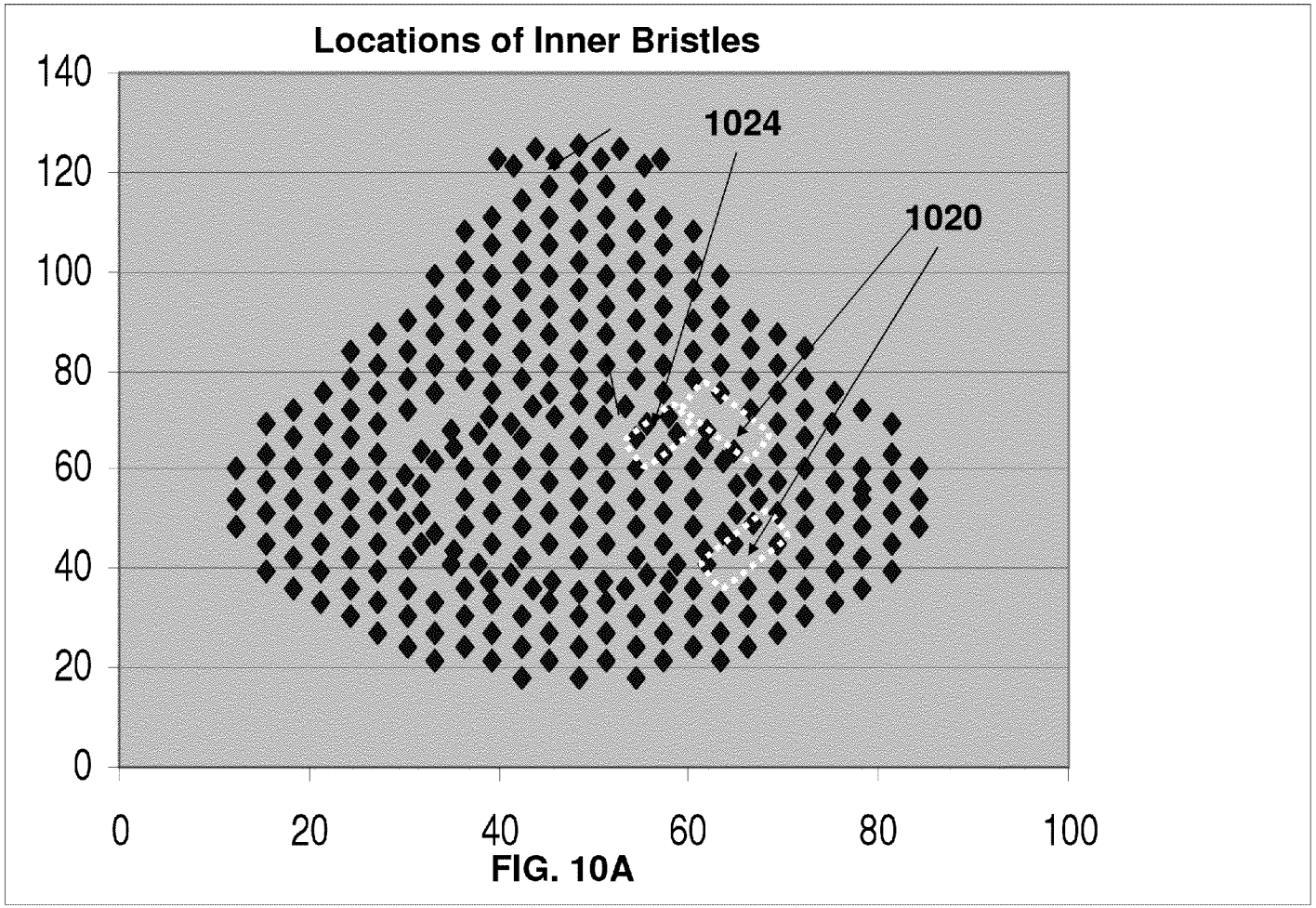
FIGS. 10A-10E and 13 illustrate bristle locations.
Figure 10B:
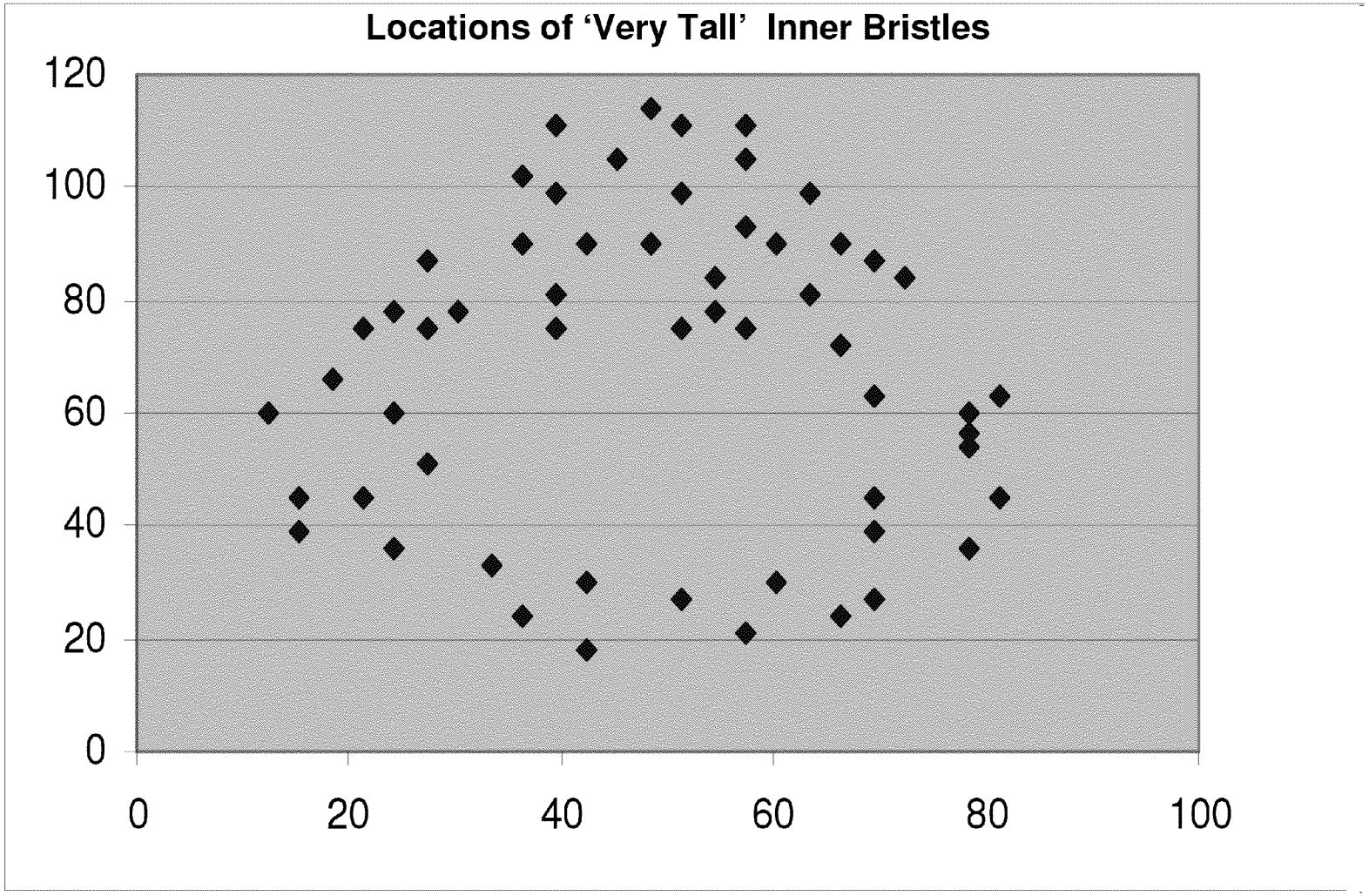
Figure 10C:
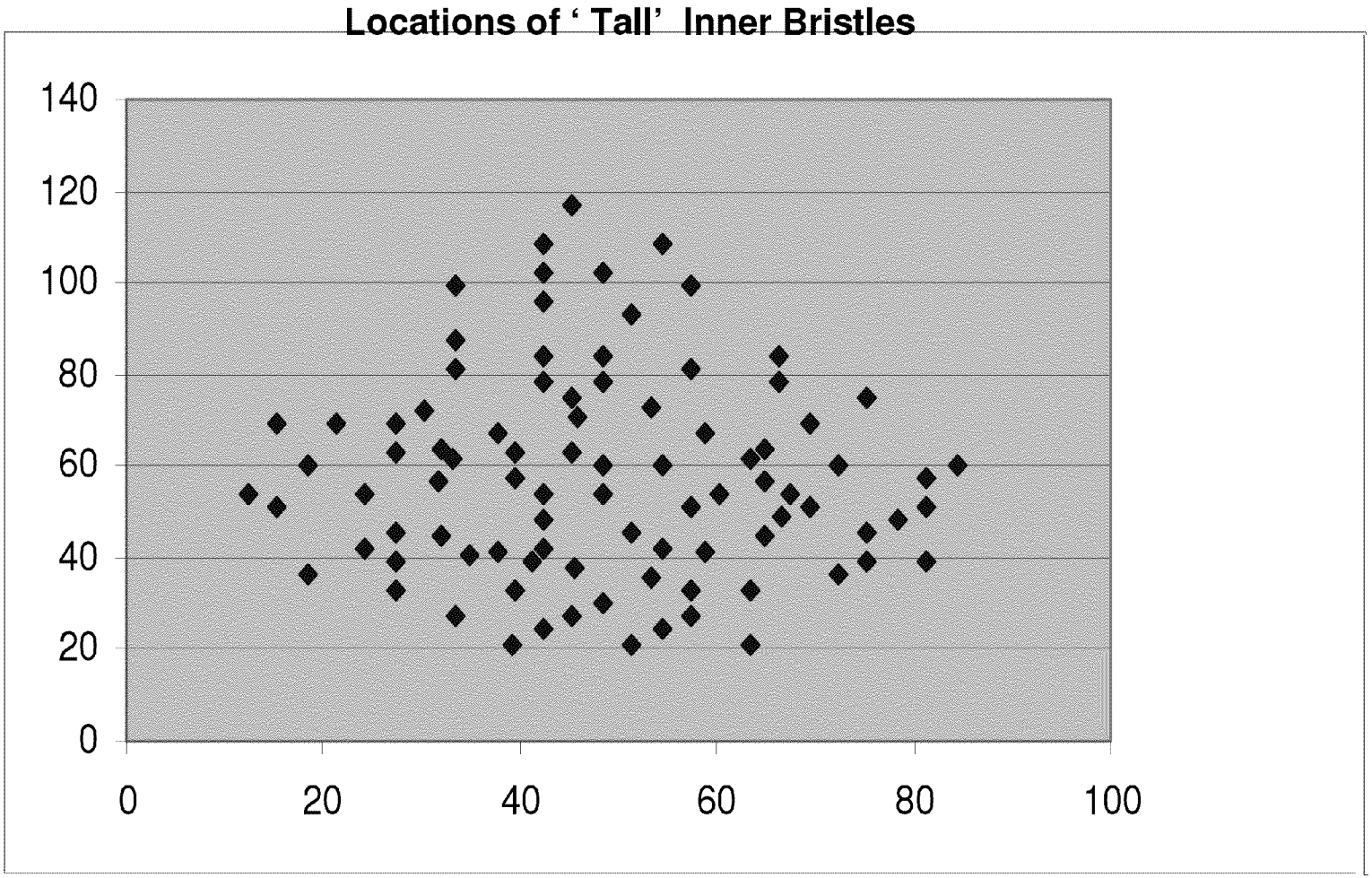
Figure 10D:
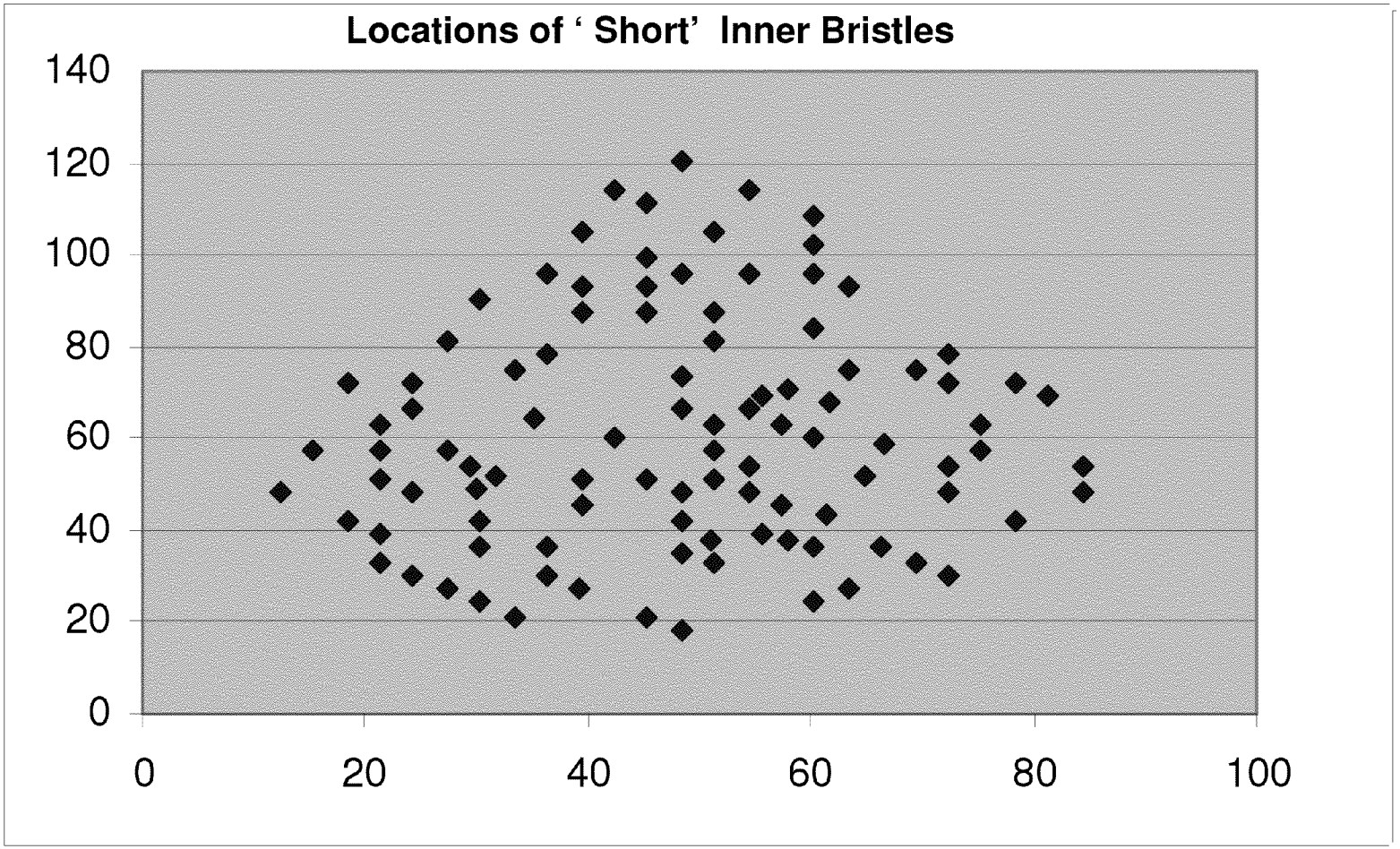
Figure 10E:
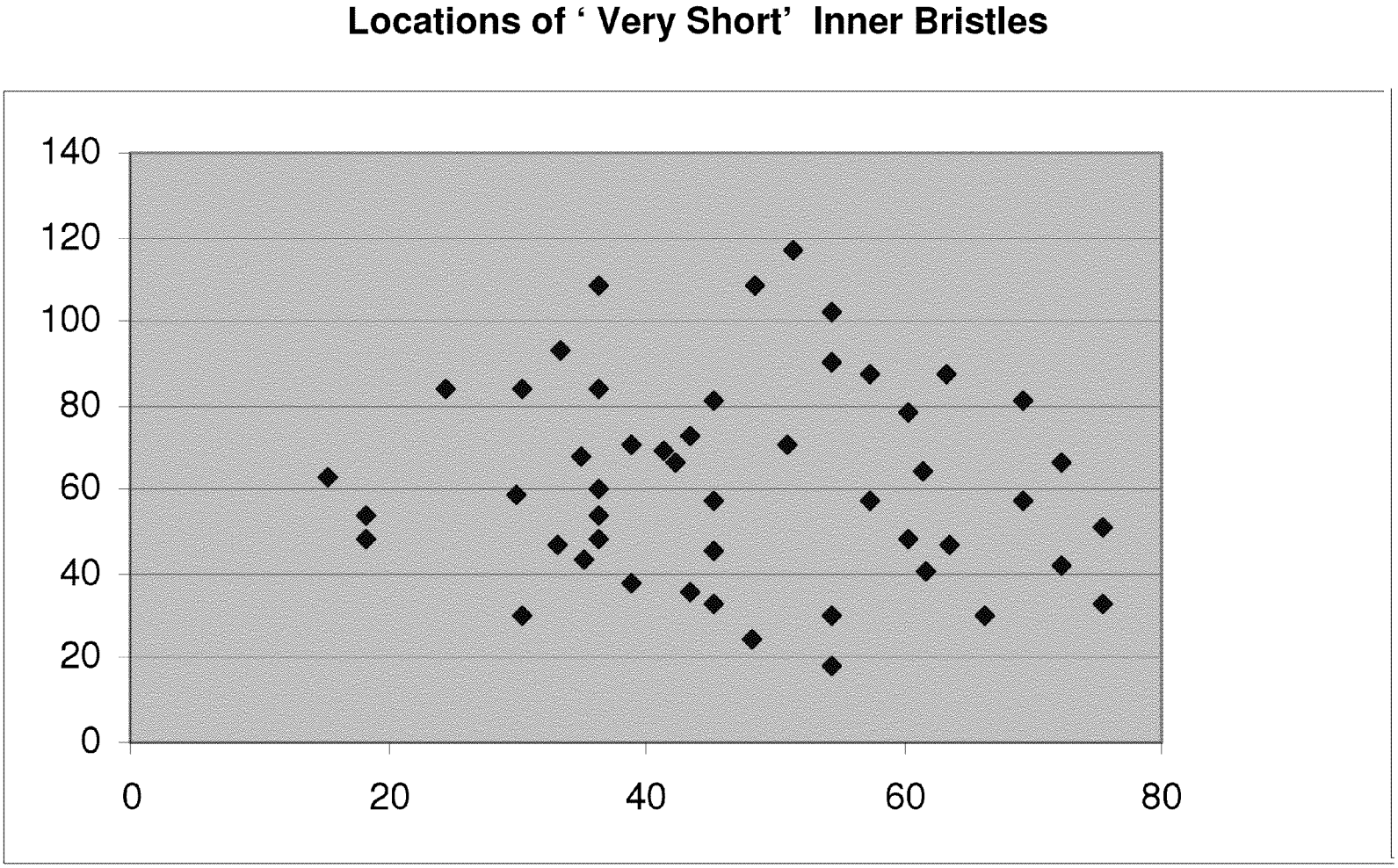

FIG. 10A is a graph of locations (the units are in mm) of bristles for the example of FIGS. 1-2. As is evident from FIG. 10A, despite the presence of relatively small regions with 'more sparse' bristle densities 1020 and 'more dense' bristles densities, taken as a whole, it is clear that the bristle density throughout the 'hosting region' (in this case 560) that hosts the inner field is substantially constant.

The average bristle length/height for the 'inner field of bristles' (or any other field having random-like properties) is defined as $H_{AVG}$ or as HEIGHT_AVG (both are equivalent—the notation just differs slightly). The standard deviation of bristle length/height is denoted as HEIGHT_SD. It is possible to define four height sub-sets for bristles of the field of bristles (e.g. in region 560)—(i) a 'very tall subset' (VTB) of bristles whose height exceeds a sum of HEIGHT_AVG and HEIGHT_SD; (ii) a 'tall subset' (TB) of bristles whose height exceeds HEIGHT_AVG but is less than a sum of HEIGHT_AVG and HEIGHT_SD; (iii) a 'short subset' (SB) of bristles whose height is less than HEIGHT_AVG but exceeds a sum of HEIGHT_AVG and HEIGHT_SD; (iv) a 'very short subset' (VSB) of bristles whose height is less than a difference between HEIGHT_AVG and HEIGHT_SD, The first and the last subsets are referred to as 'height outlier subsets' since they refer to heights that have relatively 'large' deviation from the average height.

In some embodiments, the cardinality of each subset is 'significant'—e.g. at least 7% or at least 10% or at least 12% or at least 15% of the total cardinality of the 'bristle field.'

It is possible to observe the following contrast in 'bristle deployment' between the 'field as a whole' and the various sub-populations: the bristles of bristle field as a whole are deployed at substantially a constant density within a selected 'host' area SA 560 of the bristle-retaining surface, bristles of any one or two or three or four (i.e. any combination) of the aforementioned subsets (VTB, TB, SB, VSB) are individually deployed to the bristle-retaining surface so that there is a contrast between the deployment of the bristle field as a whole and the deployment of at least one height outlier subset HOS, such that while the bristles of the height outlier subset HOS are scattered at irregular and non-periodic locations within the selected area SA.

This contrast may be attributed to the fact that the height distribution of the bristles in some ways resembles a random or semi-random height distribution.

Figure 11:
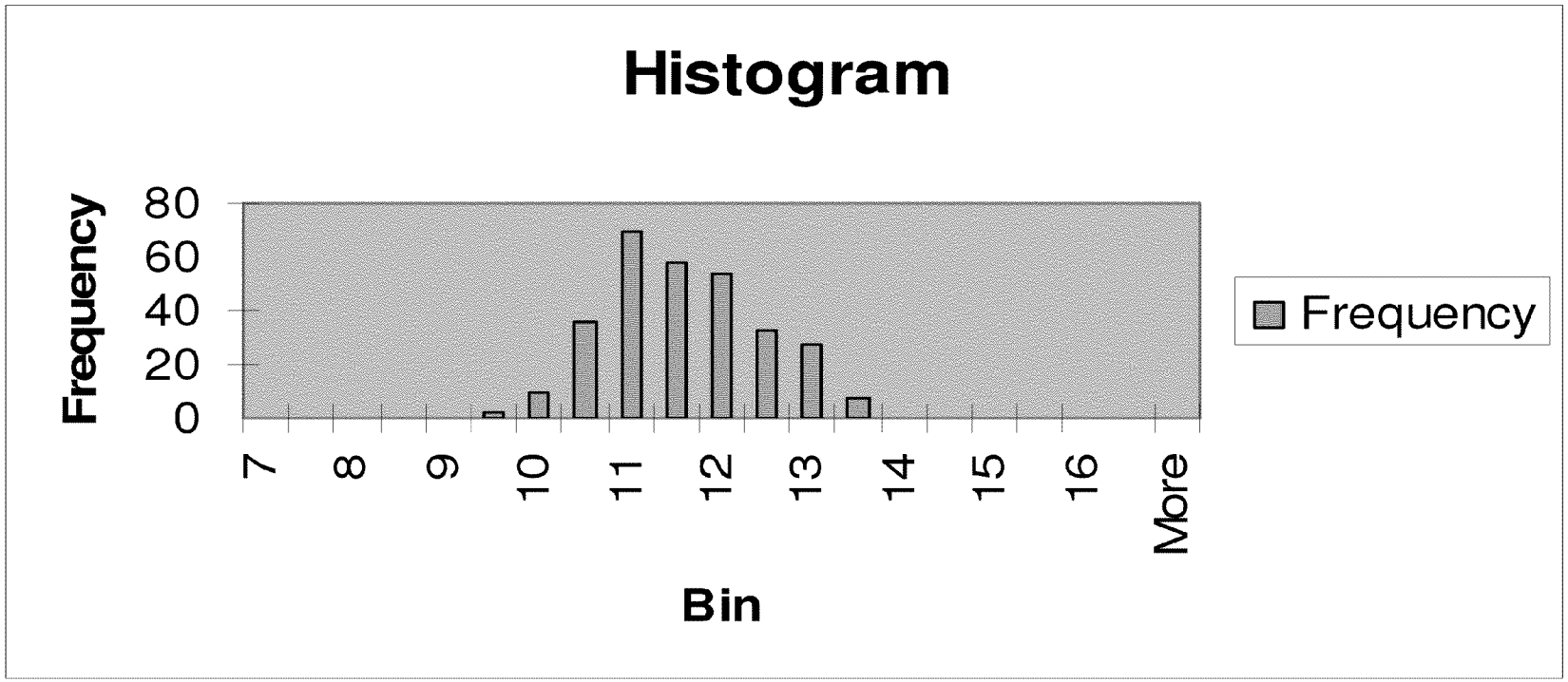
Figure 12A:
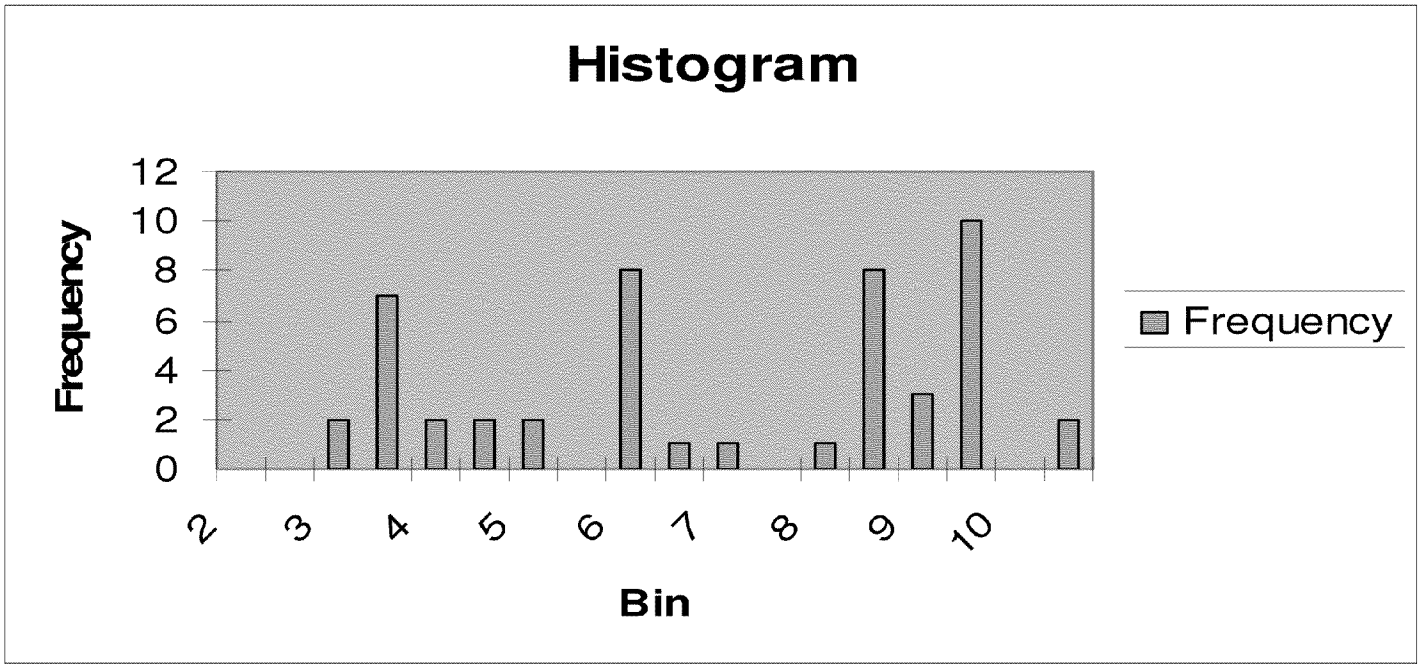
Figure 12B:
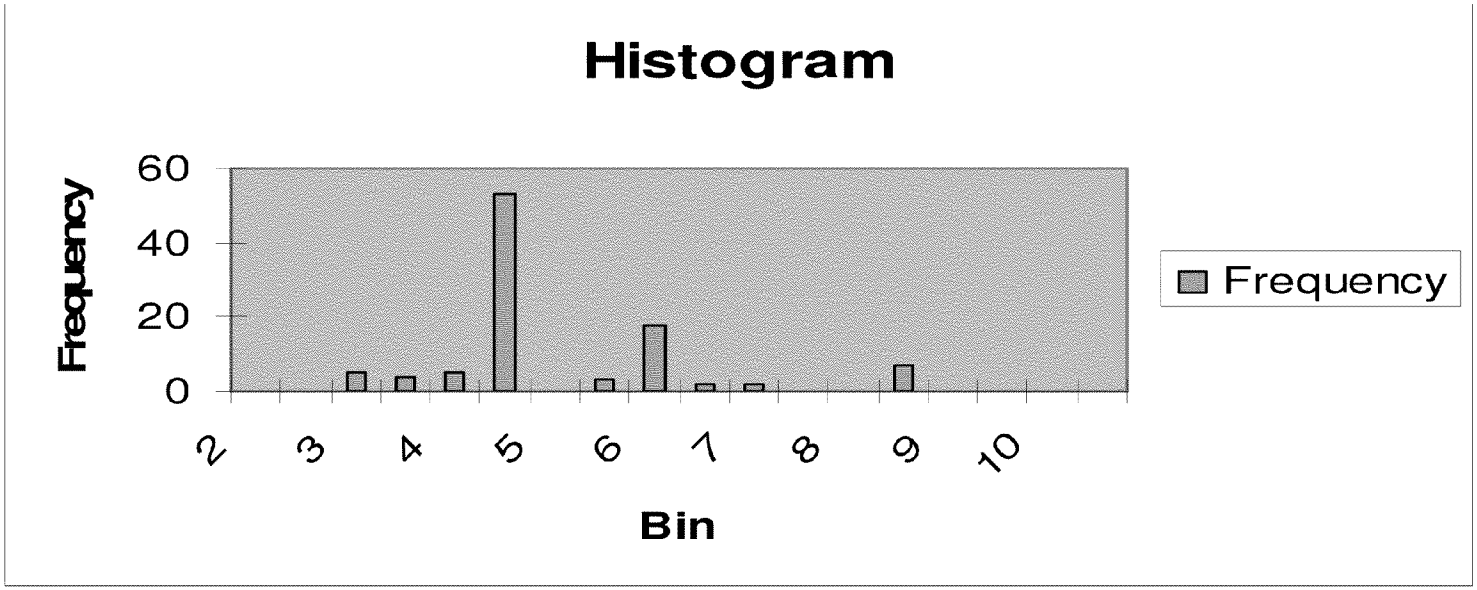
Figure 12C:
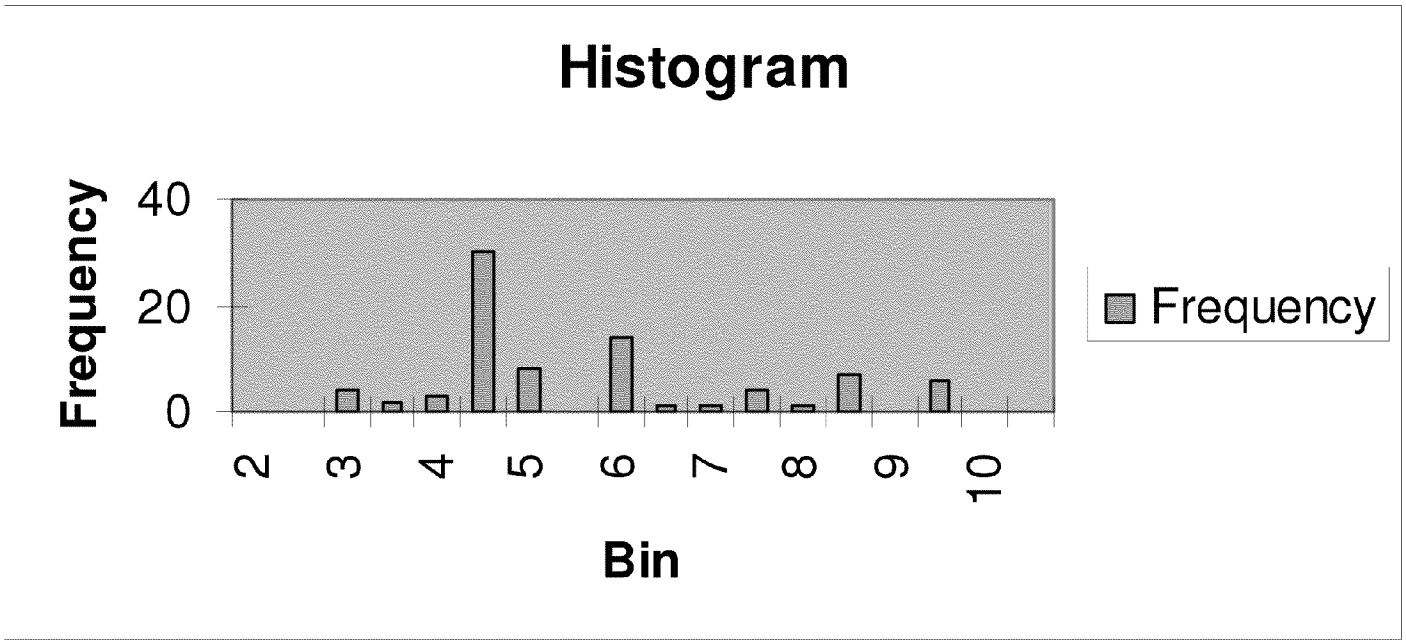
Figure 12D:
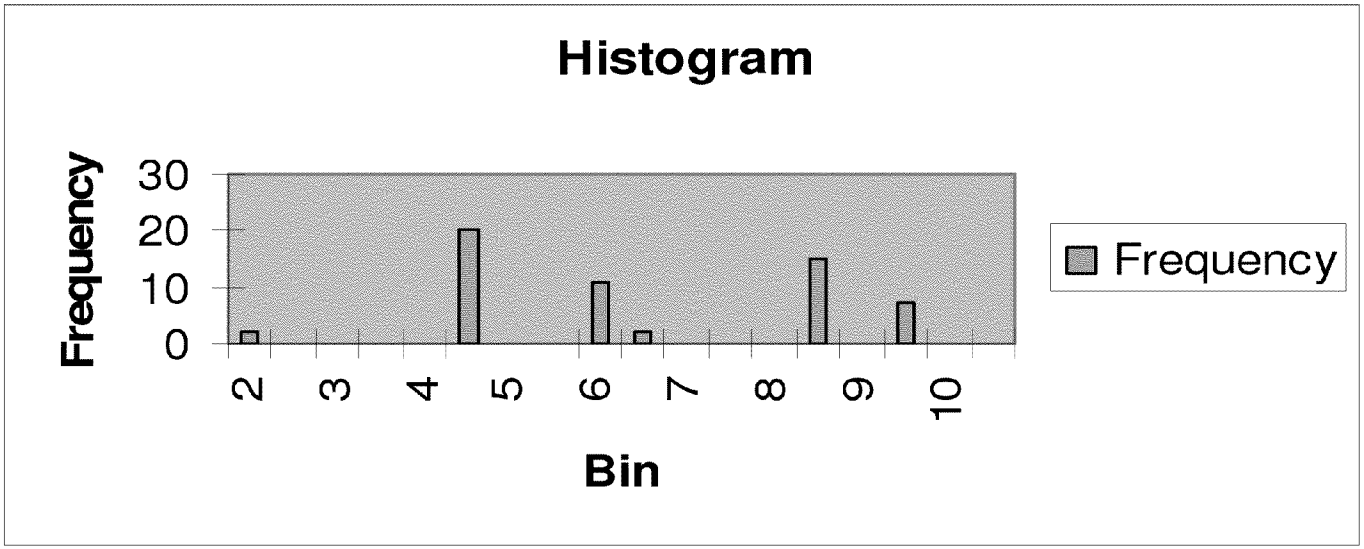

A Discussion of FIG. 11

For the 'inner field of bristles' (or any other 'random property field') is possible to associate each bristle of the 'inner field' with a respective group of 'close bristles' whose distance from the 'each bristle' is less than a threshold maximum distance—for example, within 1 cm or within 7.5 mm or within 6.5 mm and/or within a distance that is $H_{AVG}$(recall: the average height of bristles of the 'random-property field' is $H_{AVG}$) or within $0.9*H_{AVG}$ or within $0.8*H_{AVG}$ or within $0.7*H_{AVG}$ or within $0.6*H_{AVG}$ or within $0.5*H_{AVG}$ and/or optionally greater than a minimum distance (i.e. at least 1 mm and/or at least 1.5 mm or at least 2 mm).

The height of each bristles can be averaged with the 'nearby-bristles' (i.e. whose distance is less than the max threshold and optionally exceeds the minimum threshold). For the value of 7.5 mm (and not minimum), this was one—it is noted that the 'local-average height' tends to be about the same as the average height for the 'inner field' (and/or random-property field) of bristles, while the standard deviation The resulting histogram is illustrated in FIG. 11—the statistical properties obtained are listed below:

| | |
|---|---|
| Mean | 11.33401815 |
| Standard Error | 0.049109417 |
| Median | 11.27 |
| Mode | 11 |
| Standard Deviation | 0.844910352 |
| Sample Variance | 0.713873503 |
| Kurtosis | −0.625787516 |
| Skewness | 0.14288207 |
| Range | 3.99 |
| Minimum | 9.25 |
| Maximum | 13.24 |
| Sum | 3354.869372 |
| Count | 296 |

In contrast to the 'overall field' where the standard deviation was about 0.21 of the height (i.e. Ratio of the SD/average height=0.21), for the 'local-averaged' case the standard deviation was about 0.06 of the height. This is evident by the 'tighter' peak in FIG. 11 as compared to FIG. 5. In different embodiments, the ratio between:

(i) the SD/average ratio for the 'local average case' of the bristles of the inner field and/or random properties field (see FIG. 11) to:

(ii) the SD/average ratio for the 'original case' is at most: 0.5 or at most 0.4 or at most 0.3 or at most 0.2.

Thus (LA is an abbreviation for locally-average'), in some embodiments, for radius R=7.5 mm, for the inner field, (i) the average height of all bristles b of the population P is substantially equal to the local-average height LA(b, 7.5) [radius=7.5 mm] over all bristles b of the inner field(i.e. all bristles within the given region—e.g. 560); (ii) the standard deviation of the local-average height LA(b, 7.5) is significantly less than the standard deviation of the height distribution of all bristles b of population P (e.g. the ratio between the standard deviation of the local-average height LA(b, 7.5) and the standard deviation of the height distribution of all bristles b of population P may be at most 0.6 or at most 0.5 or at most 0.4.

This indicates that the height distribution is relatively homogenous throughout the inner region—this is one indication of a random or semi-random height distribution and of relatively 'high' entropy.

A Discussion of FIGS. 12A-12D

For each given bristle of the population, the respective closest distance between the given bristle of the population and another bristle of the population (i.e. the closest 'other' bristle of the population) is the 'nearest bristle distance within the population.' In FIG. 7, it is evident that the most popular 'closest distance' value (i.e. for a particular example of FIGS. 1-2) is around 4.5 cm.

For each given bristle of any sub-population, the respective distance between the given bristle of the population and another bristle of the sub-population (i.e. the closest 'other' bristle of the sub-population) is the 'nearest bristle distance within the sub-population.'

Because each bristle of a population (or sub-population) may be assigned a respective 'nearest bristle distance,' it is possible to compute statistical properties across a population or sub-population. In FIGS. 12A-12D both the 'average value of the closest distances' (i.e. for a population or sub-population) as well as the 'standard deviation of closest distances' (i.e. for a population or sub-population) are computed and presented. One metric for any population or sub-population is the SD_AVG(CLOSEST_BRISTLE) metric defined the quotient of the standard deviation divided by the average. Smaller values of SD_AVG are indicative of bristles (of a population or sub-population) that are distributed relatively regularly over the bristle-retaining surface of the brush. Larger values of SD_AVG are indicative of bristles (of a population or sub-population) that are distributed less regularly over the bristle-retaining surface of the brush.

In some embodiments, SD_AVG(CLOSEST_BRISTLE) for the population as a whole is less than 0.3 or less than 0.25 or less than 0.2 or less than 0.175.

In the example of FIGS. 12A-12D, (i) for the population as a whole, SD_AVG equals 0.15; (ii) for the sub-population of FIG. 10B (see FIG. 12A), SD_AVG equals 0.37; (iii) for the sub-population of FIG. 10C (see FIG. 12B), SD_AVG equals 0.28; (iv) for the sub-population of FIG. 10D (see FIG. 12C), SD_AVG equals 0.34; (v) for the sub-population of FIG. 10E (see FIG. 12D), SD_AVG equals 0.35.

In some embodiments, the ratio of (i) the SD_AVG(CLOSEST_BRISTLE) parameter for any one or any two or any three or all four of the sub-populations (i.e. at least one or at least two or at least three or all four sub-populations of the group consisting of the 'very short sub-population,' the 'short sub-population,' the 'very tall sub-population,' and the 'tall sub-population') to (ii) the SD_AVG(CLOSEST_BRISTLE) parameter for the population as a whole is at least 1.3 or at least 1.5 or at least 1.7 or at least 2. This indicates that the sub-population(s). When this ratio(s) exceeding one of these values, it may be indicative that the sub-populations are distributed 'less regularly' within the a selected area or given area (e.g. the area of the 'inner field) than the population as a whole.

Another parameter that may be studied, for each given bristles of a population or subpopulation, is the respective 'number bristles within a certain distance (e.g. 1.2 cm or 1 cm or 7.5 mm or 6.5 mm) of the given bristle that are within the 'selected area' and members of the population or sub-population. It is possible to compute statistics of this metric over a population or a sub-population. (FIG. 9 parameter), and to determine averages and standard deviations.

An Additional Discussion Related to FIG. 8

A metric related to the 'FIG. 8 parameter') describing how 'regularly' bristles of a population or sub-populations are distributed in a selected area is, for each given bristle of a population or sub-population is the SD_AVG(LOCAL_BRISTLES, 7.5 mm) or SD_AVG(CLOSEST_BRISTLE,6.5 mm) or SD_AVG(CLOSEST_BRISTLE,1 cm), etc.

In some embodiments (i.e. related to the parameters of FIG. 9), SD_AVG(LOCAL_BRISTLE,7.5) for the population as a whole is less than 0.3 or less than 0.25 or less than 0.2 or less than 0.175 or less than 0.15.

In some embodiments, the ratio of (i) the SD_AVG(LOCAL_BRISTLES,7.5 mm) or SD_AVG(LOCAL_BRISTLES,65 mm) or SD_AVG(LOCAL_BRISTLES,1 mm) parameter for any one or any two or any three or all four of the sub-populations (i.e. at least one or at least two or at least three or all four sub-populations of the group consisting of the 'very short sub-population,' the 'short sub-population,' the 'very tall sub-population,' and the 'tall sub-population') to (ii) the SD_AVG(LOCAL_BRISTLES, 7.5 mm) or SD_AVG (LOCAL_BRISTLES, 65 mm) or SD_AVG(LOCAL_BRISTLES, 1 mm) parameter for the population as a whole is at least 1.5 or at least 1.75 or at least 2 or at least 2.5 or at least 3 or at least 3.5. When this ratio(s) exceeding one of these values, it may be indicative that the sub-populations are distributed 'less regularly' within the a selected area or given area (e.g. the area of the 'inner field) than the population as a whole.

In some embodiments, pattern of 'more regular distribution for the population as a whole; less regular distribution for sub-population(s) may prevail for the 'inner field' 560 only—in some embodiments, there is much less height variation in the outer field 570.

In some embodiments, the bristles of the inner 560 and/or outer 570 field are substantially parallel to each other. In some embodiments, the bristles of the inner 560 and/or outer 570 field are substantially straight and/or deployed substantially normally to the local plane of the bristle retaining surface.

It is noted that because in some embodiments, (i) the height of the bristles may be substantially random and substantially independent of the bristle location (i.e. for bristles within a given area—for example, of the inner field) and (ii) there may be a positive correlation between bristle thickness and bristle height. Thus, some embodiments of the present invention relate to the situation whereby the thickness of the bristles is substantially random and substantially independent of the bristle location. This, in some embodiments, may be another way for the hairbrush to provide one or more 'entropy features' or 'randomality features.'

Figure 13:
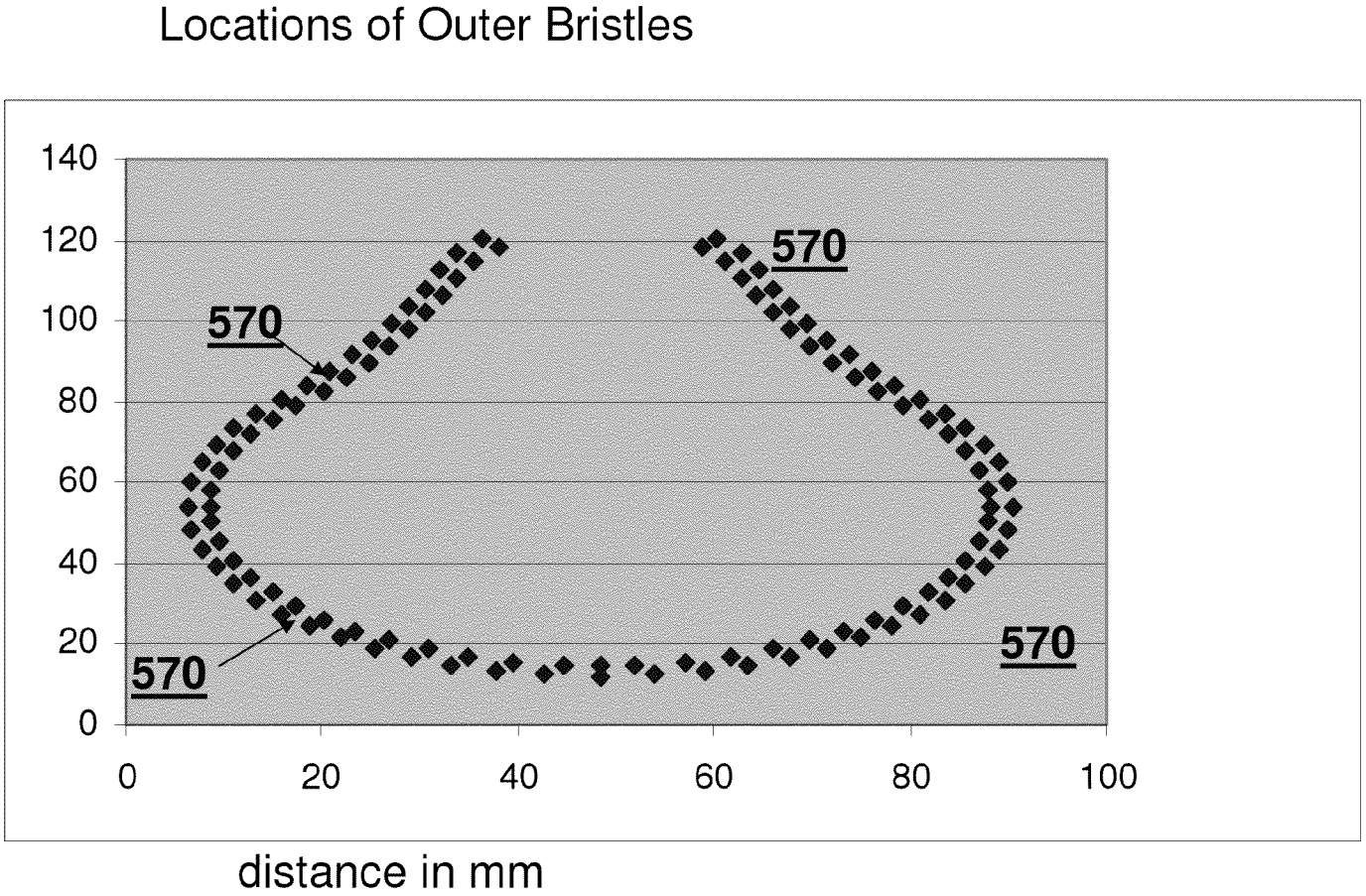

A Discussion of FIG. 13

FIG. 13 illustrates locations of the 'outer field' of bristles—for example, located around and/or confined to a relatively thin or small region around most of the perimeter of the 'inner field.'

In some embodiments, an 'outer field of bristles' is also provided, and has the following features:

(i) the outer field of bristles 570 is also deployed at substantially a constant density of bristles per area on the perimeter of the inner field 560 of bristles, substantially (but not necessarily completely) surrounding the inner field of bristles on the bristle-retaining surface 530—in one example, this density is substantially equal to are maybe a larger than the density of the bristles of the inner field 560;

(ii) the average height of the bristles of the 'outer field' 570 of bristles is at most, for example, 50% or at most 40% or at most 30% or at most 20% or at most 15% the average height of the bristles of the inner field 560 of bristles;

(iii) the 'outer field of bristles' 570 may lack the 'substantially-random height' feature of the inner field of bristles;

(iv) the number of bristles of the outer field of bristles is at least 15% or 20% or 30% the number of bristles of the inner field of bristles;

(v) in some embodiments, there is less (or much less) variation of thicknesses of bristles of the outer field of bristles—thus, the average thickness may be about 1 mm but the standard deviation may be at most 0.1 or at most 0.05 mm (or even less)—for example, at most 30% the standard deviation of the thickness of bristles of the inner field.

(vi) In some embodiments, the outer field of bristles is substantially surrounded by a region that is substantially devoid of bristles—see for example, FIG. 1.

(vii) In some embodiments, a majority of bristles or substantially a majority of at least 60% or at least 70% or at least 80% or at least 90%) of bristles of the 'outer field' (or any field within the 'selected area') are substantially straight.

'In-vitro' Technique for Measuring the Hair-Brush Force

The present inventor is currently conducting experiments whereby hair of a wig is detangled using both (i) a hairbrush according to some embodiments (for example, see FIGS. 1-2); and (ii) a conventional hairbrush as a 'control.' According to these experiments, it is possible to measure the force imposed upon the wig hair by the detangling hairbrush. There are preliminary indications that when detangling wig hair using both brushes that the force imposed by the novel brush provided by embodiments of the invention is less than the force imposed by the conventional brush.

Clinical Trial Results

The present inventor had a model hairbrush constructed and tested the model hairbrush ('brush B') against a prior art 'ordinary' hair brush for approximately 25 women having long hair (see FIG. 14).

Brush B is the prior art brush; brush A was constructed according to some embodiments of the present invention.

As is evident from FIG. 14, the 'invention' brush performed consistently better—fewer hairs shed (i.e. less than 50%) and a significantly faster 'brushing time' (1 minute 33 seconds vs. 45 seconds). The brushing time was the amount of time it took the subject to detangle the hair on his/her head—longer hair brushing time would typically be due to the greater degree of pain felt detangling—when the detangling was less painful, it was possible to brush faster.

Substantially Co-linear Bristles/Blocking Bristles

Figure 15:
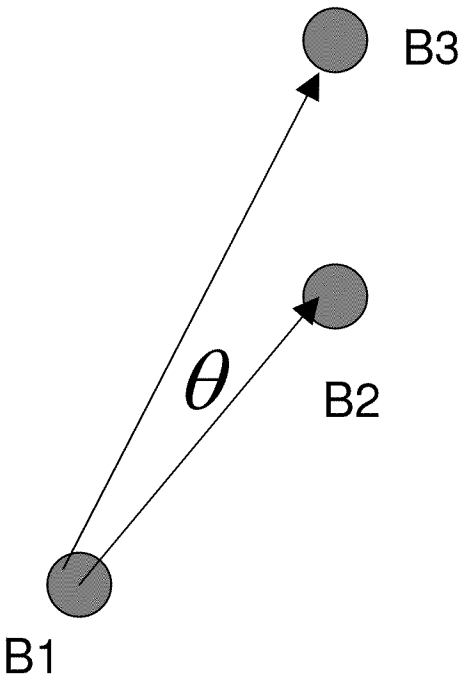
FIG. 15 illustrates the concept of substantially-co-linear bristles in some embodiments.

Reference is made to FIG. 15 which illustrates 3 bristles—B1, B2 and B3. B1 is closer to B1 than B3. Two vectors are illustrated in FIG. 15—B1-B2 and B1-B3. The angle between B1-B2 and B1-B3 is theta. In some embodiments, when theta is equal to zero within a tolerance that is at most 30 degrees or at most 25 degrees or at most 20 degrees or at most 15 degrees or at most 10 degrees or at most 5 degrees, then bristles B1-B2-B3 are considered 'substantially collinear.' This tolerance is referred to as the 'substantially-co-linear bristle tolerance' Although any tolerance can be used in any embodiment, unless otherwise specified, the default 'substantially-co-linear bristle tolerance' is 20 degrees.

In some embodiments, if B2 is closer to B1 than B3, and if B1-B2-B3 is considered substantially collinear, then B3 is considered to be 'blocked' by B2 (relative to bristle BP. In some embodiments, B2 may have to satisfy additional requirements to in addition to the 'substantially collinear requirement' in order to block bristle B3—for example, B2 may have to have a height and/or width in any range (for example, any range disclosed herein), or B2 may have to have a minimum distance from bristle B1 in order to 'block' bristle B3.

Mapping Bristles to Letters According to Height, Thickness or Material Flexibility In some embodiments, it is possible to categorize each bristle of any set of bristles (for example, of the 'inner field' or any other bristle set exhibiting random height or random thickness or random material flexibility properties) into a distinct height categories or distinct thickness categories according to 'categorization schemes.'

According to a first mapping scheme, it is possible to compare the heights of bristles with each other, and to divide the bristles into four height categories—for example, into 'height quartiles'

As Wikipedia writes about quartiles, "In descriptive statistics, a quartile is one of four equal groups, representing a fourth of the distributed sampled population. It is a type of quantile." It is appreciated that when more than one bristle has exactly the same length/height (or when the total number of bristles in the set of bristles is not divisible by four), that the four groups of the 'quartiles' will not necessarily be exactly the same size—in general, they will be approximately the same size.

Thus, according to the "FIRST MAPPING SCHEME," the bristles are divided into four height categories—upper quartile (associated with 'the letter A'), upper-middle quartile, (associated with 'the letter B') lower-middle quartile (associated with 'the letter C') and lower quartile (associated with 'the letter D'). Each bristle is respectively mapped to the letter A or the letter B or the letter C or the letter D. For the non-limiting example of the 'inner field' of the hairbrush of FIGS. 1-2 whose height distribution histogram is presented in FIG. 5, bristles whose height exceeds 13.3 mm may be considered 'upper quartile height' or 'A' bristles; bristles whose height is less than or equal to 13.3 mm and whose height exceeds 11.3 mm may be considered 'upper-middle quartile height' or 'B' bristles; bristles whose height is less than or equal to 11.3 mm and whose height exceeds 9.3 mm may be considered 'lower-middle quartile height' or 'C' bristles; bristles whose height is less than or equal to 9.3 mm may be considered 'lower quartile bristles height' or 'D' bristles;

According to another mapping scheme, (i.e. a "SECOND MAPPING SCHEME"), the bristles are similarly divided into four width categories—for example, 'upper quartile thickness,' 'upper middle quartile thickness,' 'lower middle quartile thickness,' and 'lower quartile thickness.' For the hairbrush of FIGS. 1-2 whose thickness properties are illustrated in FIG. 6, the bristles with a thickness of about 1.6 mm are the "A thickness bristles," the bristles with a thickness of about 1.42 mm are "B thickness bristles,' the bristles with a thickness of about 1.2 mm are "C thickness bristles and the bristles with a thickness of about 1 mm.

It is noted that quartiles is just one example of a quanile. Quartiles (or 4-quaniles) are associated with a 'four letter alphabet'—{A,B,C,D}. 3-Quaniles are associated with a 'three letter alphabet'—{A,B,C}. 5-Quaniles are associated with a 'five letter alphabet'—{A,B,C,D,E}.

It is possible to define a bristle-letter mapping for a set of bristles (e.g. the 'inner field' or any other set of bristles) where each bristle is mapped to a respective letter based upon physical properties—i.e. height or width or material flexibility. We define the following notation:

MAPPING(physical property,N}—where 'physical property' is selected from 'height' or 'thickness' or 'material flexibility' and 'N' is a positive integer defining the number of the quanile—thus, if N=3 this relates to a 3-quanile, if N=4 this relates to 4-quaniles (or quartiles), if N=5 this relates to 5-Quaniles.

The 'quanile border' for an N quanile relates to the value which devices one quanile from another—for the "FIRST MAPPING SCHEME" (which may also be referred to as MAPPING(height,4)) there are three 'quanile borders' for the set of bristles of FIG. 5 (i.e. the inner field)—11.3 mm, 11.3 mm and 9.3 mm. Thus, a mapping scheme MAPPING(physical property,N} would, in general, provide N−1 'bordered.'

A non-exhaustive list of mapping schemes that may be considered includes but is not limited to MAPPING(width,5), MAPPING(height,8), MAPPING(flexibility,2), etc.

These mapping schemes may be applied to any 'mapped set' of bristles including any set of bristles disclosed herein—for example, any combination of features of limitations of any set of bristles disclosed herein (i.e. either explicitly disclosed combination or any other combination).

The term 'mapped set' of bristles does not imply any physical limitations about the bristles whatsoever (i.e. physical property of bristles and/or their distribution or any other feature of the bristle)—instead, the term 'mapped set' of bristles is used to describe the mathematical construct of 'bristle mapping.'

Any set disclosed herein may be a 'mapped set.' A 'mapped set' of bristles may provide any feature or combination of features disclosed herein—these features or combination of features may include but are not limited to any height feature (s) combination and/or any material flexibility feature(s) and/or any width feature(s) and/or density feature(s) describing the density of bristle deployment. Such features include but are not limited to height features, features relating to the density at which bristles are deployed, bristle count features, bristle width features, bristle shape features are any other feature or combination thereof.

Furthermore, alternatively or additionally, in some embodiments, the 'mapped set of bristles may include one or more of the following features:

(i) At least 60% or at least 70% or at least 80% or at least 90% or at least 99% of the bristles have a height that is above a minimum height—for example, at least 3 mm or at least 4 mm or at least 5 mm or at least 6 mm or at least 7 mm; and/or (ii) At least 60% or at least 70% or at least 80% or at least 90% or at least 99% of the bristles have a height that is below a maximum height value—for example, at most 25 mm or at most 22 mm or at most 20 mm or at most 18 mm or at most 17 mm or at most 16 mm or at most 15 mm.

(iii) At least 60% or at least 70% or at least 80% or at least 90% or at least 99% of the bristles have a thickness that is above a minimum thickness—for example, at least 0.3 mm or at least 0.4 mm or at least 0.5 mm or at least 0.6 mm or at least 0.7 mm or at least 0.85 mm or at least 1 mm; and/or (iv) At least 60% or at least 70% or at least 80% or at least 90% or at least 99% of the bristles have a height that is below a maximum height value—for example, at most 25 mm or at most 22 mm or at most 20 mm or at most 18 mm or at most 17 mm or at most 16 mm or at most 15 mm.

A Discussion of Bristle Neighborhoods

In some embodiments, for any 'given bristle b' and any set of bristles BrSet (i.e. including the set of all bristles on the hairbrush or some any subset of bristles—any set disclosed herein having any combination of feature(s) disclosed herein—for example, any 'mapped set' of bristles), it is possible to define a 'bristle neighborhood' for bristle b according to any criteria listed below or any combination (including explicitly enumerated combinations or any other combination) thereof.

(i) 'neighborhood bristles' may be required to satisfy a 'closer than maximum distance' criteria—i.e. bristles whose distance from the bristle b is less than a maximum distance—for example, less than 1.5 mm or less than 1.25 cm or less than 1 cm or less than 7.5 mm or less than 6.5 mm or less than 5 mm or less than 1.5 times the average bristle height for the set BrSet (denoted as AH_BrSet) or less than 1.2 times or less than 1.1 times or less than 1.0 times or less than 0.9 times or less than 0.8 times or less than 0.7 times or less than 0.6 times or less than 0.5 time AH_BrSet; and/or (ii) 'neighborhood bristles' may be required to satisfy a 'further than minimum distance' criteria—i.e. bristles whose distance from the bristle b exceeds a minimum distance—for example, at least 1.5 mm or at least 2 mm or at least 2.5 mm or at least 3 mm or at least 10% or at least 15% or least 20% times AH_BrSet; and/or (iii) 'neighborhood bristles' may be required to satisfy a 'ranked bristle criteria'—i.e. where N is a positive integer, it may be possible to limit 'neighborhood membership' relative to a bristle set BrSet and a 'given bristle' b to the Nth closest bristles to bristle b where N is any positive integer (for example, 2 or 3 or 4 or 5 or 6 or 7 or 8 or 9 or 10 or any other integer)—this is either the absolute Nth closest bristles or the Nth closest bristles whose distance from b exceeds any minimum distance listed above.

The set BrSet can be any set of bristle disclosed herein and/or have any combination of features (for example, bristles of the 'inner field) including but not limited to height features, deployment density features, etc. In one example, BrSet is the set of all bristles in a given region that provides any combination of features disclosed herein—for example, all bristles having any minimum height and/or any minimum thickness and/or any maximum height and/or any maximum thickness disclosed herein. The count of BrSet may be any 'bristle count' disclosed herein—for example, at least 100 or at least 150 or at least 200 or at least 250.

In one particular example, it is possible to define 'neighboring bristles' as bristles within an annularly-shaped region—i.e. the distance exceeds any 'minimum distance' (i.e. the inner radius of the annulus) and also is less than any 'maximum distance (i.e. the outer radius of the annulus).

Referring to FIG. 15, it is noted that optionally, it may be possible to eliminate from a neighborhood bristle B1 any bristle B3 where (i) B2 is a member of the neighborhood of bristle B1; and (ii) B2 'blocks' bristle B3—for example, B1-B2-B3 is 'substantially collinear.'

As noted before, the distance between bristles is along the local surface and not necessarily a Cartesian distance (i.e. for cases where the bristle-retaining surface is not flat).

In one example, the 'inner radius' of the annular region equals 1.5 mm or equals 2 mm or equals 2.5 mm or at equals 3 mm and/or the 'outer radius' of the annular region equals 15 mm or 12 mm or equals 1 cm or equals 8 mm or equals 7.5 mm or equals 6 mm. Any combination is possible.

In one example, the 'inner radius' of the annular region equals 5% or 10% or 15% or 20% or 25% or 30% of AH_BrSet and/or the 'outer radius' of the annular region equals 150% or 120% or 100% or 90% or 80% or 70% or 60% or 50% or 40% of AH_BrSet. Any combination is possible.

Figure 16A:
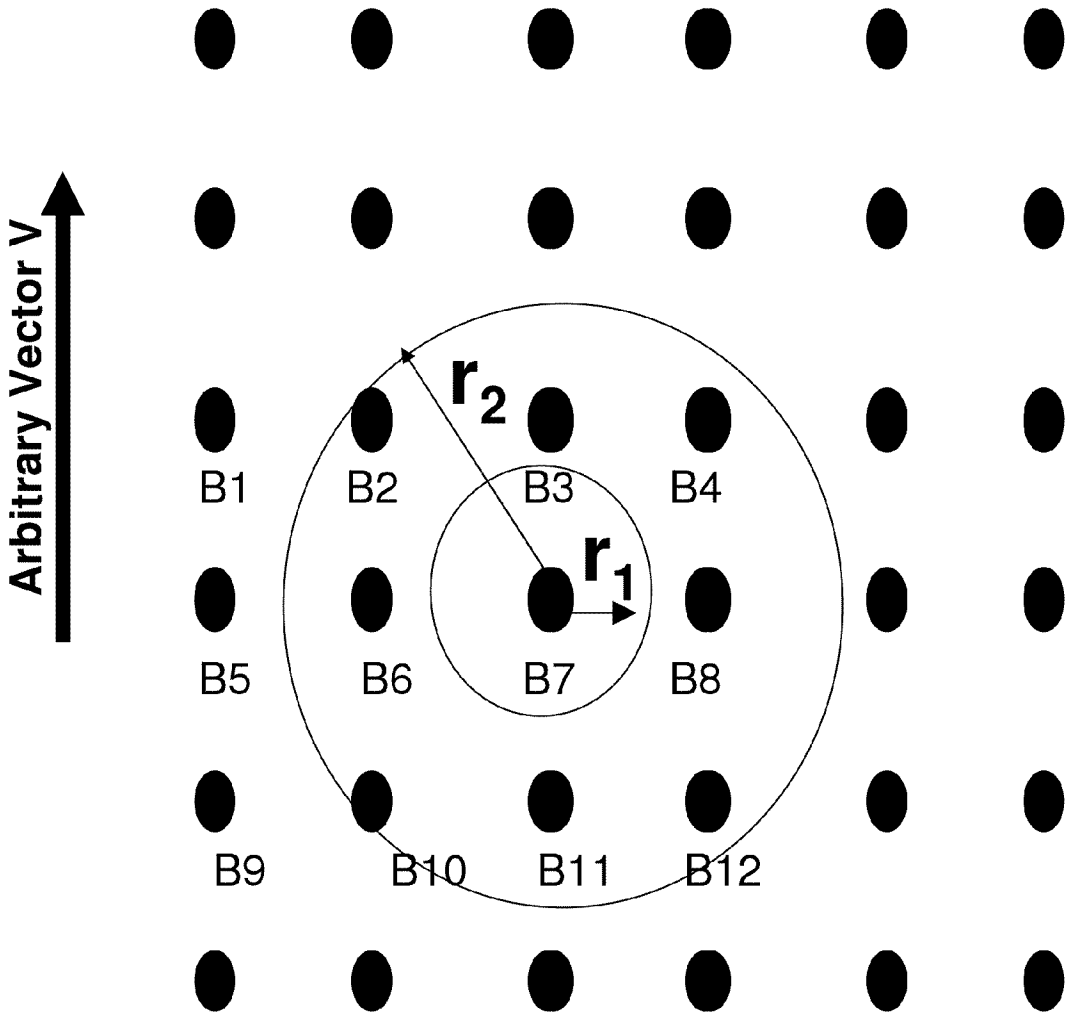
FIGS. 16A-16B illustrate bristle neighborhoods in some embodiments.

FIG. 16A illustrates one such bristle neighborhood of bristle B7 where $r_1$ is the 'inner radius of the annulus' and $r_2$ is the 'outer radius of the annulus.'

Figure 16B:
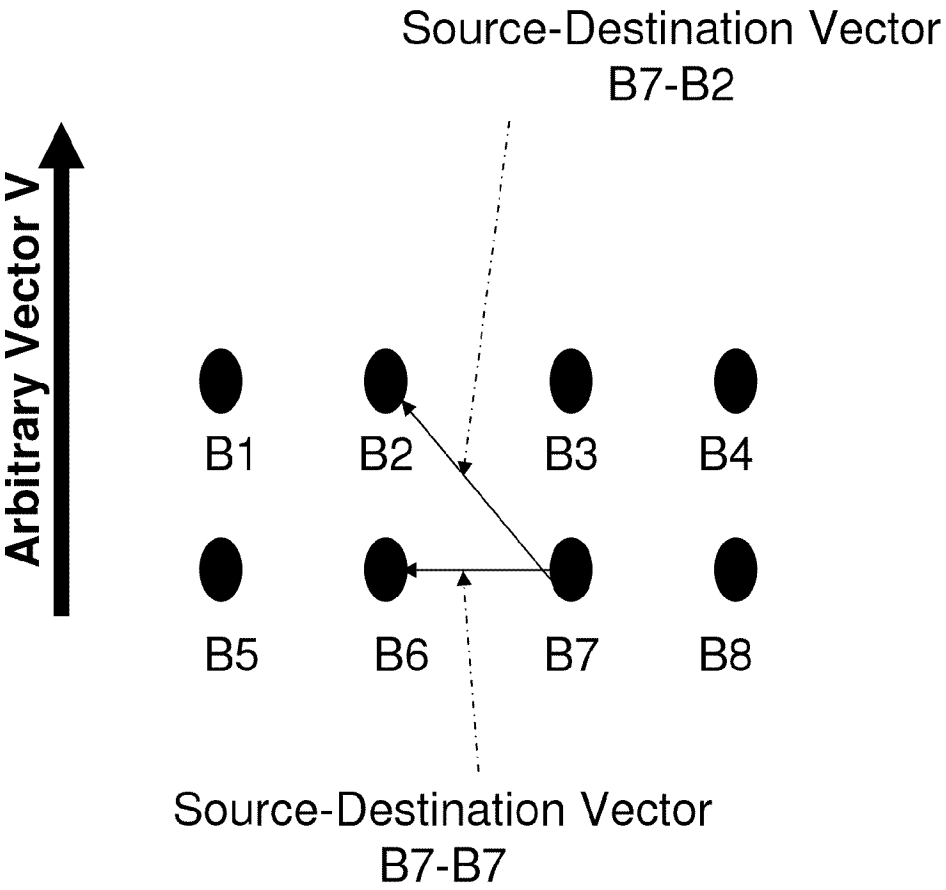

FIG. 16B illustrates a subset of bristles of FIG. 16A—FIG. 16B illustrates the concept of 'source-destination vector.' In FIG. 16B, the vector from B7 to B2 is the 'source-destination vector' of B2 in the neighborhood of B7; B7 to B3 is the 'source-destination vector' of B3 in the neighborhood of B7;

Every bristle in a neighborhood of a 'given bristle' (in FIG. 16 the 'given bristle' is B7) is associated with a respective 'source-destination vector.'

Ordering Bristles of Neighborhood

In some embodiments, it is possible to order bristles of a neighborhood so that the closest bristle in the neighborhood is the 'first bristle' in the neighborhood, the second closest bristles in the neighborhood is the 'second bristle' in the neighborhood, and so on. In the event of a 'tie,' it may be possible to utilize 'arbitrary vector V' as a 'tie-breaker' so that the bristle in the smaller angle from v (in the clockwise direction) is 'earlier in the order' than the bristle with the larger angle from v. In this example, even if DISTANCE(B7, B8)=DISTANCE(B7,B11), B8 would be earlier in a neighborhood order for a neighborhood of bristle B7. (ORDERING SCHEME 1)

In another example (ORDERING SCHEME 2), it is not necessary to utilize distance from the 'given bristle' (in FIG. 16 this is B7) in order to compute an order of bristles in a neighborhood. In ORDERING SCHEME 2, each bristle of the neighborhood are ordered only according to an angle between the 'Arbitrary Vector' and a respective source-destination vector.' The angle is taken from the Arbitrary vector to the source-destination vector of the bristle in the clockwise direction—bristles having a lower angle value (i.e. between the Arbitrary Vector and the bristles' source-destination vector) are given a lower score than bristles having a higher angle value.

Thus, source-vector B7-B4 has a lower value (and thus would be given a preferable or higher ranking) than vector B7-B8. Since B7-B3 is collinear with an in the same direction as the arbitrary vector, it would have an 'angle of zero' and be given the most preference.

Figure 17:
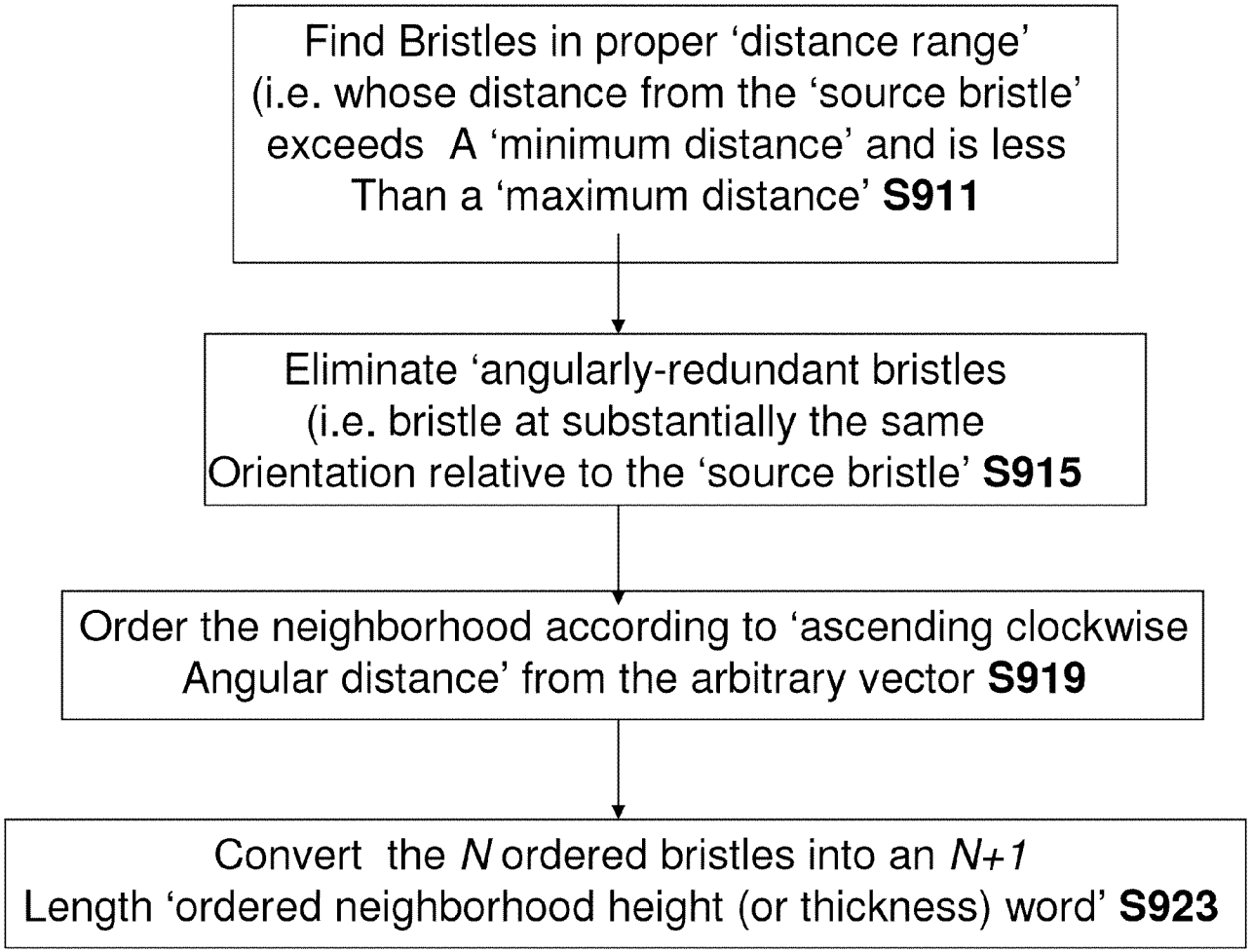
FIG. 17 illustrates a routine for forming words from combinations of bristles and portions (or the entirety of) their neighborhoods.

For FIG. 16A, for the 'ordered neighborhood around bristle B7, the list of bristles 'within the annulus' may be ordered in a 'clockwise manner' relative to an arbitrary vector V to yield the following order: {B3, B4, B8, B12, B11, B10, B6 and B2} bristles (see step s919 of FIG. 17).

B3 is first on the list because the angle between the source-destination vector B7-B3 in this case is zero degrees. For the 'source-destination vector' B7-B4, the angle between the B7-B8 'source-destination vector' and the arbitrary vector is 45 degrees. For the 'source-destination vector' B7-B4, the angle between the B7-B8 'source-destination vector' and the arbitrary vector is 90 degrees.

Mapping Bristles to Words Using Neighborhood Selection, Ordering Bristles Within a Neighborhood FIG. 17 illustrates a routine for word formation.

In some embodiments, for a set of bristles BrSet (which itself may be selected using any criteria and may have any properties of bristle sets or bristle fields disclosed herein—e.g. density, height, thickness or any other properties) and an arbitrary vector V and a direction (i.e. clockwise or counter-clockwise—if no direction is specified, the default is 'clockwise' as was discussed in the previous section), it is possible to map each bristle of the set of bristles BrSet to a respective word as follows:

(i) first a neighborhood of the bristle relative to set BrSet is determined using any technique disclosed herein; (see step S911 of FIG. 17—any other 'neighborhood selection technique may be employed);

(ii) optionally, redundant bristles (see FIG. 15) are eliminated from the neighborhood using any 'substantially-co-linear bristle tolerance' (see step S915 of FIG. 17);

(iii) the neighborhood is ordered according to any criteria—for example, relative to an arbitrary vector V and a direction (default is clockwise)—see step S919.

For a bristle $b_{base}$, and an positive integer N (for example, N=2 or 3 or 4 or 5 or 6 or 7 or any other value) this will yield an ordered sequence $b_{first_neighbor}$; $b_{second_neighbor}$. . . $b_{Nth_neighbor}$ In step S923, the letter of any bristle letter(bristle) may be computed using any mapping scheme described in the previous section entitled "Mapping Bristles to Letters According to Height, Thickness or Material Flexibility" (MAPPING (height,N} or MAPPING(width,N} or MAPPING(material_flexibilty,N} where N is any positive integer.

If the letter of $b_{first_neighbor}$ is letter($b_{first_neighbor}$); the letter of $b_{first_neighbor}$ is letter($b_{second_neighbor}$), and so on, then it is possible in step S923 of FIG. 17 to compute a word WORD ($b_{base}$) as either:

(i) the ordered concatenation of the following letters: letter ($b_{base}$), letter($b_{first_neighbor}$) . . . letter($b_{Nthneighbor}$) (this is "INCLUDE BASE POLICY" that is also in setup S923) OR (ii) the ordered concatenation of the following letters: letter ($b_{first_neighbor}$) . . . letter($b_{Nthneighbor}$) (not including letter ($b_{base}$)) at the beginning (this is "OMMIT BASE POLICY").

Figure 18:
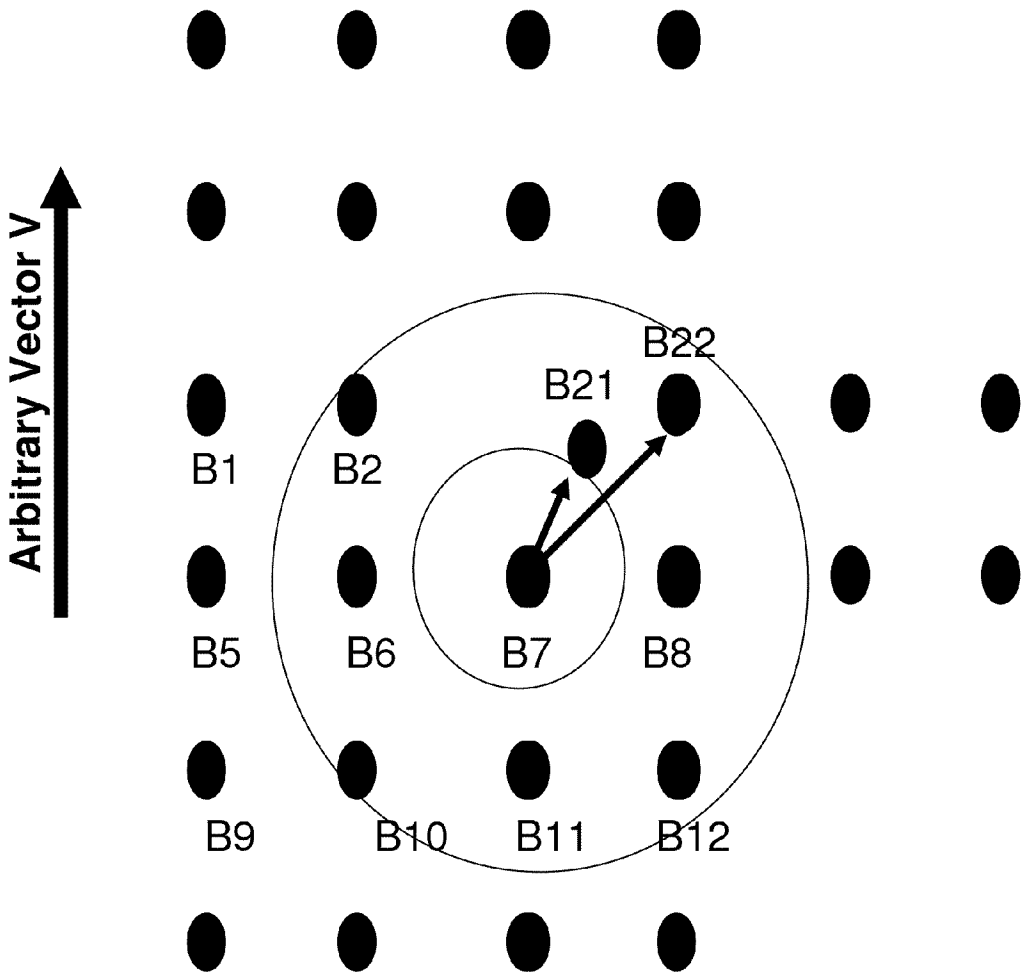
FIG. 18 illustrates ordering of a bristle neighborhood in some embodiments.
Figure 19:
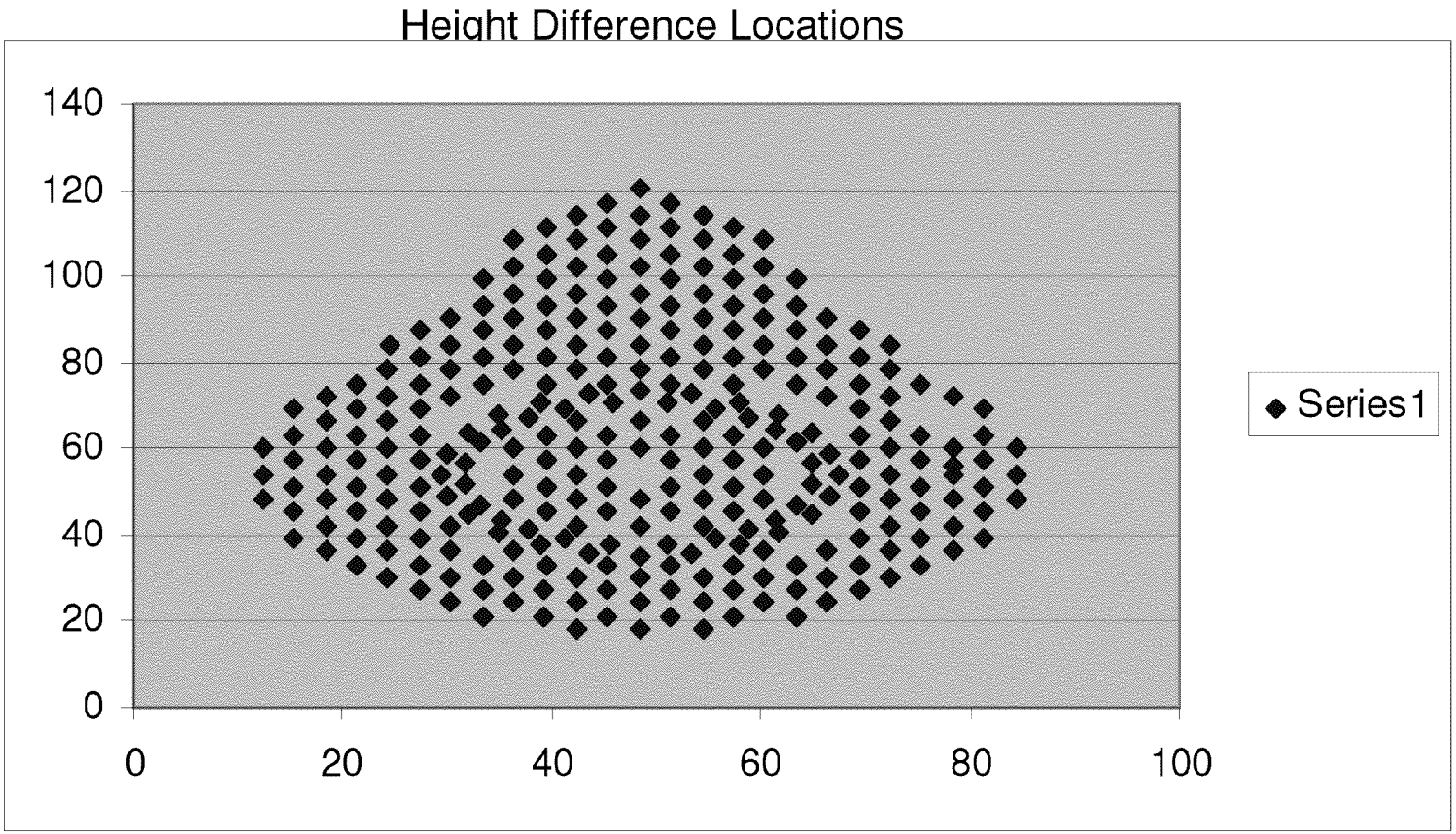
FIGS. 19-23 illustrates height difference object for a pair bristles in the same neighborhood

Referring to FIG. 18, it is noted that optionally (see step S915 of FIG. 17), it is possible to eliminate 'angularly-substantially-redundant neighboring bristles.' Thus, if there are two bristles whose 'source-destination' vector is less than 30 degree or less than 20 degree or less than 15 degrees, it may be possible to disqualify the farther of the 2 bristles. In the example of FIG. 19, it may be possible (according to step S915) to eliminate (i.e. for the 'ordered neighborhood around B7) bristle B22 in favor of bristle b21 because B21 is closed, and the angle between the source-destination vectors is less than 30 degree or less than 20 degree or less than 15 degrees or less than 10 degrees.

For FIG. 16A '2 bristle ordered neighbored' for bristle B7 (i.e. relative to the arbitrary vector in FIG. 16A) is {B7,B3} (since the N bristle always includes the 'given bristles to which other bristles are 'close' as the first bristle of the ordered neighborhood. The 3 bristle ordered neighborhood for bristle B7 is {B7,B3,B4}, etc.

Each bristle (may be mapped to a respective letter A,B,C or D based on height or thickness/width or material flexibility). Thus, it is possible for a neighborhood of N bristles around a 'given bristle' to make an N+1 letter word from the given bristle and its neighbors (i.e. other 'ordered neighborhood). If the height letter of bristle B7 is 'A', the height letter of bristle B3 is 'B', and height letter of bristle B4 is 'D', then the 3-letter word for the neighborhood is "ABD."

A Discussion of Combinatories Associated with Ordered Words

As discussed above, the phrase "bristles are deployed within the selected area such that bristle heights vary in a substantially random manner and are substantially independent of location" (either bristle height or width/thickness or material flexibility) refers to the lack of a visible discernable pattern (other than a 'random' pattern) in the bristle heights is a function of location for a field of bristles (e.g. the 'inner field' for the brush of FIGS. 1-2).

Without limiting this definition, it may be possible, in some embodiments, to provide some sort of mathematical definition characterizing substantially disordered or substantially random variation of heights (or thicknesses or material flexibilities).

One salient feature provided by some embodiments is that for a given set of bristles (for example, inner field or any set BrSet or any set disclosed herein having any feature or combination of features) the 'height words' (i.e. words formed when MAPPING(height,N} is used in step S923) and/or the 'width words' (i.e. words formed when MAPPING(bristle words,N} is used in step S923) and/or the 'material flexibility words' (i.e. words formed when MAPPING(material_flexibility,N} is used in step S923) do not repeat very much. This may be indicative of a high degree of entropy or randomality.

For 3-words of 4 letters, it is possible to make 4^3=64 'ordered' 3 words.

For 4-words of 4 letters, it is possible to make 4^4=256 'ordered' 4 words.

For 5-words of 4 letters, it is possible to make 4^5=1024 'ordered' 5 words.

This low repetition feature may thus indicate semi-random or random height or width or material flexibility variation.

For the particular case of MAPPING(height,4}, for the hairbrush of FIGS. 1-2, for the 'inner field' where the bristles have height distribution of FIG. 5, the number of distinct words in a the region of the 'inner field' was computed. The results of the '3-letter neighborhoods' for the around 300 bristles of FIG. 3 are indicated in Appendix B for the particular case where the 'height' is the physical property of the letter MAPPING function. The results of the '4-letter neighborhoods' for the around 300 bristles of FIG. 3 are indicated in Appendix C for the particular case where the 'height' is the physical property of the letter MAPPING function.

If the height or width or flexibility distribution would be ordered, then most words would be repeats, and only a relatively 'small' number of words would appear even in a larger set.

It is noted that for the hairbrush of FIGS. 1-2 (i.e. for which 'results' are presented in the Appendixes) the hairbrush lengths (or widths or material flexibilities) may have random or semi-random properties (i.e. mathematically random)—as such, there are likely to be relatively few 'repeated words.'

For example, for 3-words of 4 letters, a set of 300 bristles (where the entire 'vocabulary' is 64 words) may include most of the possible words—for example, at least 30 distinct words or at least 40 distinct words or at least 50 distinct words or at least 55 distinct words. This may be true for any physical property for MAPPING(physical_property,4}.

For example, for 4-words of 4 letters, a set of 300 bristles (where the entire 'vocabulary' is 256 words) may include a large number of the possible words—for example, at least 150 distinct words or at least 175 distinct words or at least 200 distinct words or at least 225 distinct words.

Thus, if the bristles have mathematically random properties, there would be few repeats, and the number of 'distinct words' may be on the order of magnitude of the size of the vocabulary.

It may also be possible to analyze 30 or 40 bristle subsets of any 'bristle set' having any combination of features disclosed herein—for example, the sub-set may be deployed at a substantially constant bristle density on the surface of the brush.

Combinatories Features Related to 'Ordered Neighborhoods'

The term 2-word refers to a word of 2 letters; the term 3-word refers to a word of 3 letters; the term 4-word refers to a word of 4 letters, etc.

In one example, for 30 bristle sub-sets of any bristle set, using the mapping function MAPPING(physical_property, 4}, for 3 words, there may be at least 10 or at least 15 or at least 17 distinct 3-words for the 40 bristle subset for any physical property.

For a MAPPING(physical_property,4} (i.e. height or width or material flexibility) and for a 'word length' 3, and for an arbitrary vector V, and for a policy (the "INCLUDE BASE POLICY" is the default), and for a tolerance (i.e. of FIG. 15 and step S915 of FIG. 17—20 degrees is the default for the 'substantially-co-linear bristle tolerance'), and for an ordering direction (default is CLOCKWISE), and for a neighborhood selection policy (see step S911—this may include defining inner and outer radii of the annulus), a set of 40 bristles (e.g. that is a subset of any bristle set) referred to as a 40-SET is considered to have a 'substantially varied set of output words" if there are at least 10 or at least 15 or at least 17 distinct 3-words or at least 22 distinct or at least 25 distinct 3-words for the 40 bristle subset for any physical property (i.e. height or width or material flexibility). If for at least one arbitrary vector v, there are at least 10 distinct 3 words, this is "LEVEL 1 VARIETY for 3-words of an alphabet of 4 letters with respect to a physical property." If there are at least 15 distinct 3 words, this is "LEVEL 2 VARIETY for 3-words of an alphabet of 4 letters." If there are at least 17 distinct 3 words, this is "LEVEL 3 VARIETY for 3-words of an alphabet of 4 letters." If there are at least 22 distinct 3 words, this is "LEVEL 4 VARIETY for 3-words of an alphabet of 4 letters." If there are at least 25 distinct 3 words, this is "LEVEL 5 VARIETY for 3-words of an alphabet of 4 letters." The term 'variety' refers to a many different words within the 40-bristle subset.

This may also be respect to R(inner) and R(outer) radii of an 'neighborhood-defining annulus.'

For a MAPPING(physical_property,4} (i.e. height or width or material flexibility) and for a 'word length' 4, and for an arbitrary vector V, and for a policy (the "INCLUDE BASE POLICY" is the default), and for a tolerance (i.e. of FIG. 15 and step S915 of FIG. 17—20 degrees is the default for the 'substantially-co-linear bristle tolerance'), and for an ordering direction (default is CLOCKWISE), and for a neighborhood selection policy (see step S911—this may include defining inner and outer radii of the annulus), a set of 40 bristles (e.g. that is a subset of any bristle set) referred to as a 40-SET is considered to have a 'substantially varied set of output words" if there are at least 10 or at least 15 or at least 20 distinct 3-words or at least 25 distinct or at least 30 distinct 3-words for the 40 bristle subset for any physical property (i.e. height or width or material flexibility). If for at least one arbitrary vector v, there are at least 10 distinct 4 words, this is "LEVEL 1 VARIETY for 4-words of an alphabet of 4 letters with respect to a physical property." If there are at least 15 distinct 4 words, this is "LEVEL 2 VARIETY for 4-words of an alphabet of 4 letters." If there are at least 20 distinct 4 words, this is "LEVEL 3 VARIETY for 4-words of an alphabet of 4 letters." If there are at least 25 distinct 4 words, this is "LEVEL 4 VARIETY for 4-words of an alphabet of 4 letters." If there are at least 30 distinct 4 words, this is "LEVEL 5 VARIETY for 4-words of an alphabet of 4 letters." The term 'variety' refers to many different words within the 40-bristle subset.

This may also be respect to R(inner) and R(outer) radii of an 'neighborhood-defining annulus.'

In some embodiments, a field of bristles (for example, including at least 100 or at least 150 or at least 200 or at least 250 bristles) having any properties disclosed herein may include multiple distinct sub-sets of 40-bristles, each of which may separately have a level of variety within a neighborhood (for example, defined by R(inner) and R(outer)).

In some embodiments, a field of bristles (for example, including at least 100 or at least 150 or at least 200 or at least 250 bristles), may have any number of not necessarily disjoint sub-set of 40 bristles, each of which may separately have a level of variety within a neighborhood (for example, defined by R(inner) and R(outer)).

If a set SET_COVERED (for example, inner field) is 'substantially covered' by 40 sub-sets (i.e. with respect to a physical property, neighborhood definition scheme, number of letters of a word, numbers of letter), then at least 40% or at least 50% or at least 60% or at least 70% or at least 80% or at least 90% of the bristles of SET_COVERED is a member of a 40 sub-set having any property disclosed herein.

Additional Discussion

Any result or feature of the present section may be true relative to at least one arbitrary vector V (in FIGS. 16, 19 the 'arbitrary vector' is pointed upwards though this is arbitrary). In some embodiments, any result (i.e. related to a number of distinct words) may be true for at least 2 of 4 arbitrary vectors disposed on the unit circle at 90 degree intervals (or at least 3 of or all 4). In some embodiment, any result (i.e. related to a number of distinct words) may be independently true for a majority (or a substantial majority of at least 60% or at least 70% or at least 90%) of a set of 36 arbitrary vectors disposed on the unit circle at 10 degree intervals.

For the case of a 40 bristle subsets of the population P, there may be at least 10 or at least 15 or at least 17 distinct 3-words for the 40 bristle subset—this 'minimum number of distinct 3-words feature (each 3-word maps to an 'ordered neighborhood' around a respective bristle) for a 40 bristle sub-set of the population) may be independently 'repeated' for at least 2 or at least 3 or at least 4 or at least 5 different 40-bristle subsets of the bristle population P where each 40-bristle subset independently exhibits the 'low neighborhood repetition attribute' to independently exhibit at least 10 or at least 15 or at least 17 distinct 3-words for each of at least 2 or at least 3 or at least 4 or at least 5 different 40-bristle subsets of the bristle population P. In some embodiments, at least 40% or at least 50% or at least 60% or at least 70% or at least 80% or at least 90% of all bristles of the 'population of bristles' of the inner field (i.e. within a 'selected area' on the brush surface) are members one or more such 40-bristle subsets the independent a 'low repeat of heights in ordered neighborhood' described in the present paragraph of 3-words (i.e., words of 3 letters).

For the case of a 40 bristle subsets of the population P, there may be at least 10 or at least 25 or at least 30 distinct 4-words for the 40 bristle subset—this 'minimum number of distinct 4-words feature for a 40 bristle sub-set of the population) may be independently 'repeated' for at least 2 or at least 3 or at least 4 or at least 5 different 40-bristle subsets of the bristle population P where each 40-bristle subset independently exhibits the 'low neighborhood repetition attribute' to independently exhibit at least 25 or at least 30 distinct 4-words (each 4-word maps to an 'ordered neighborhood' around a respective bristle) for each of at least 2 or at least 3 or at least 4 or at least 5 different 40-bristle subsets of the bristle population P. In some embodiments, at least 40% or at least 50% or at least 60% or at least 70% or at least 80% or at least 90% of all bristles of the 'population of bristles' of the inner field (i.e. within a 'selected area' on the brush surface) are members one or more such 40-bristle subsets the independent a 'low repeat of heights in ordered neighborhood' described in the present paragraph in terms of 4-words (i.e., words of 4 letters).

For the case of a 100 bristle subsets of the population P, there may be at least 40 or at least 50 or at least 60 or at least 70 or at least 80 distinct 4-words for the 100 bristle subset.

This 'lack of ordered neighborhood repetition feature' discussed in terms of distinct words would be in contrast to height-patterned brushes where the 'words' would repeat themselves.

Some emboldens relate to a hairbrush 500 having specific properties relative to an arbitrary fixed vector comprising:

a) a hairbrush body 510 including a bristle-retaining surface 530 including a selected area SA; and b) a plurality of at least N bristles located within the selected area SA, the plurality having a count that is at least 100, an average bristle thickness whose value is between 0.85 mm and 2 mm, and an average bristle height whose value is between 8 mm and 14 mm, and a height standard deviation whose value is at least 0.1 times the average bristle height, each bristle of the plurality being mappable according to a height-representation character mapping to a respective character of a four-character alphabet={$Q_1$, $Q_2$, $Q_3$, $Q_4$} such that bristles of the upper height quartile, upper middle height quartile, lower middle height quartile, or lower height quartile for the bristle distribution respectively map to $Q_1$, $Q_2$, $Q_3$, or $Q_4$, wherein the bristles are deployed within the selected area such that:

i) each given bristle GB of the plurality is associated with a respective annularly-shaped neighborhood region neighb_region(GB) where the inner radius of the annulus is equal to less than 4 mm and exceeds 1.5 mm and the outer radius of the annulus is exceeds 6 mm and is less than 12 mm;

ii) the given bristle GB is associated with one or more N-member neighbor sets of bristles of the plurality that reside in the neighborhood region neighb_region (GB); N being a positive integer;

iii) at least one of the N-member neighbor bristle sets that is associated with the given bristle GB for the neighborhood region neighb_region(GB) being a distinct-angle bristle set where all source-destination vectors differ from each other by at least 20 degrees, greater than 2;

iv) for each bristle of the plurality, the respective representative ordered N-member neighbor set of bristles of the plurality is defined, relative to the arbitrary vector, as the ordered distinct-angle N-member bristle set for the respective annularly-shaped neighborhood region having a minimum-clockwise-angle-deviation aggregate value relative to the arbitrary vector and ordered in a clockwise-angle-deviation ascending order;

v) each given bristle is mappable to a respective neighborhood-height-descriptive N+1 character word derived from bristle heights of the given bristle and its representative ordered N-member neighbor set, the neighborhood-height-descriptive being a concatenation of:

A) a neighborhood word of length N where each position in the word corresponds to a character representing, according to the height-representative character map, the corresponding position within the representative ordered N-member neighbor set; and B) a character representing a height of the given bristle according to the height-representative character map.

The population may include at least or at least two or three or four or more sub-40-bristle set-sets such that: this 'minimum number of distinct 4-words feature for a 40 bristle sub-set of the population (where the 4-words are derived by analyzing respective neighborhoods of each bristle (i.e. by heights so that each bristle maps to one of 4 letters) of the sub-set—I.e. according to the ordering described by 'clockwise from the 'arbitrary vector' may be at least 20 distinct words or at least 25 distinct words.

The population may include one or more two or three or four or more 40-bristle set-sets of the population such that: the 'minimum number of distinct 3-words feature for a 40 bristle sub-set of the population (where the 4-words are derived by analyzing respective neighborhoods of each bristle (i.e. by heights so that each bristle maps to one of 4 letters) of the sub-set—I.e. according to the ordering described by 'clockwise from the 'arbitrary vector' may be at least 12 distinct words or at least 17 distinct words or at least 22 distinct words. This may be repeated for multiple 'subsets of people that are tested.

Figure 20:
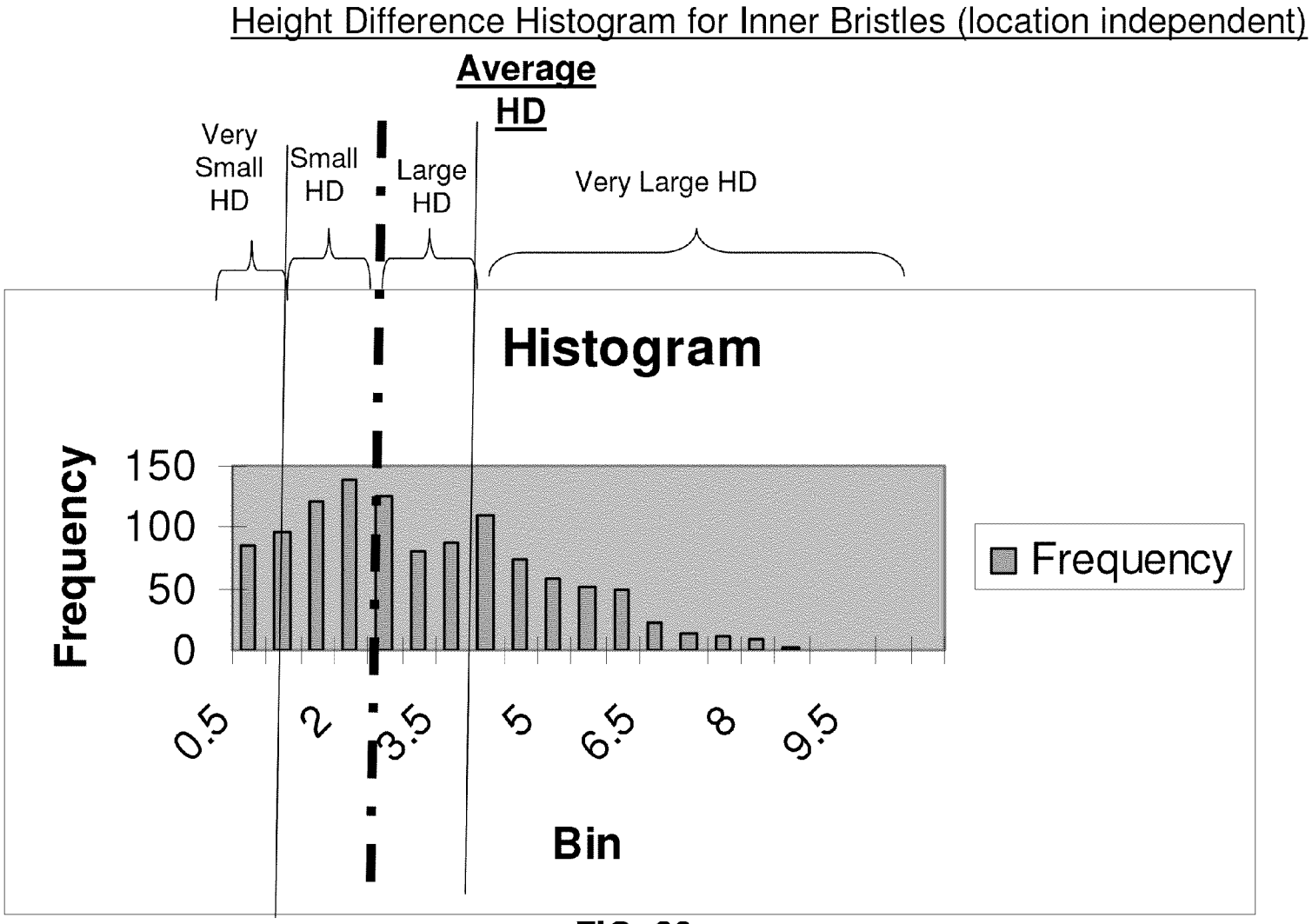

Height Different Objects Discussion of FIGS. 19-21

In some embodiments, it is possible to compute height difference objects for bristles of any 'field' (e.g. the 'inner field of bristles'). The 'height difference object' of a pair of bristles that are in the same neighborhood (for example, separated by any minimum or maximum distance discussed above for the 'annular neighborhood' is the absolute value of the difference between their heights.

The 'height difference object' is not a physical object but rather a mathematical construct. For the brush of FIGS. 1-2, height difference objects were computed for bristles of the 'inner field' (it may be for any field or set of bristles disclosed herein).

FIG. 19 indicates the physical location of the height difference object. Once again, their distribution is substantially constant. FIG. 20 is a histogram of values of the height difference objects. In FIG. 19, the average value height distance object is 4.41 mm, while the standard deviation is 3.04.

In different embodiments, the average value height distance object may be at least 2 mm and/or at least 2.5 mm and/or at least 3 mm and/or at least 20% or at least 30% or at least 40% of the average bristle height in any 'field' and/or at most 8 mm and/or at most 6 mm and/or at most 5 mm and/or at most 7 mm and/or at most least 70% or at most 60% or at most 50% or at most 40% of the average bristle height.

The SD/average ratio is 3.04/4.41=0.68 —in different embodiments this value can be at least 0.3 or at least 0.4 or at least 0.5 and/or at most 1.2 or at most 1 or at most 0.8.

In some embodiments, at least 10% of the height difference objects have a value over 7 mm and/or 1.5 time the average value and at least 10% of the height difference objects have a value under 3 mm or under 2 mm.

Figure 21A:
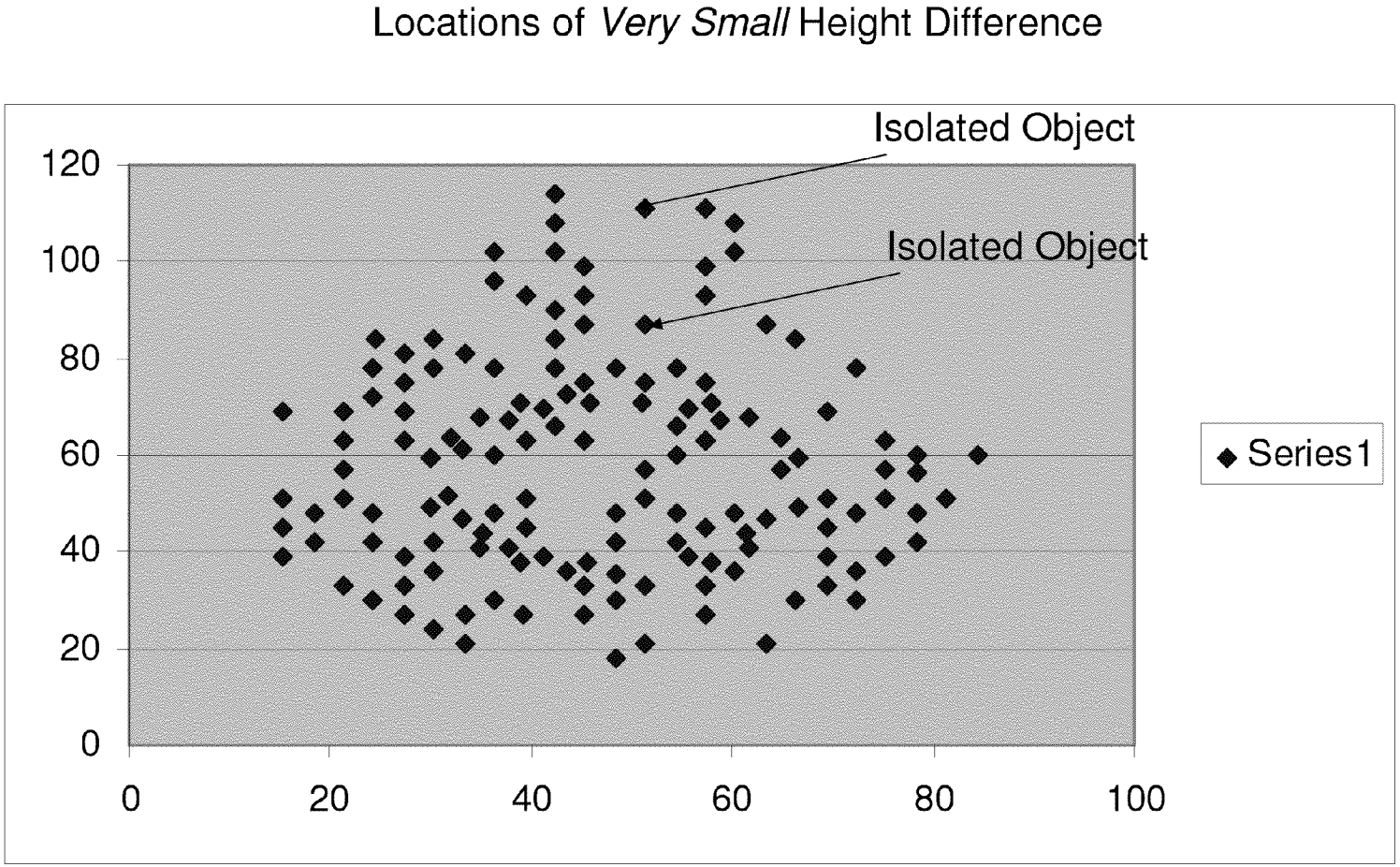
Figure 21D:
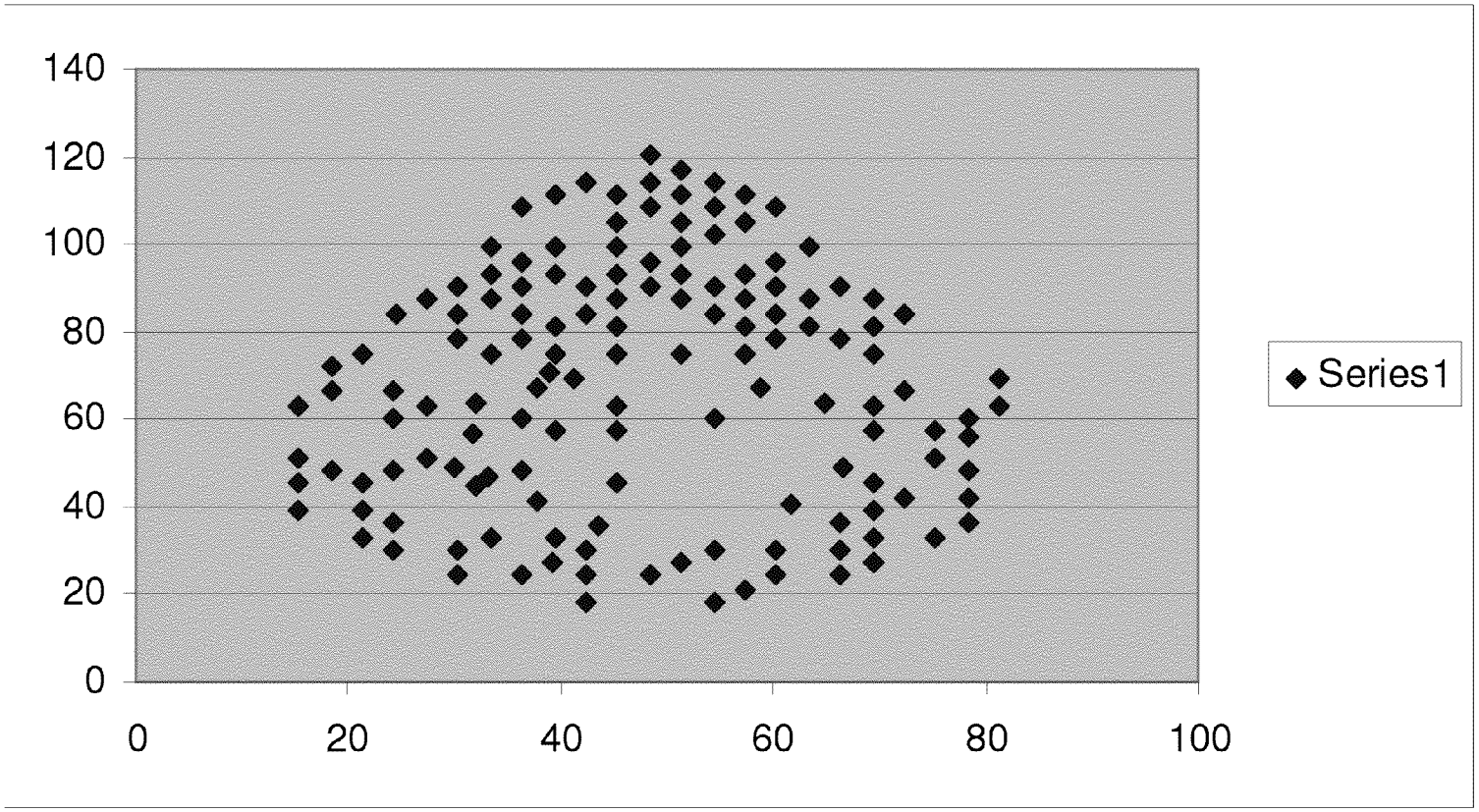
Figure 22B:
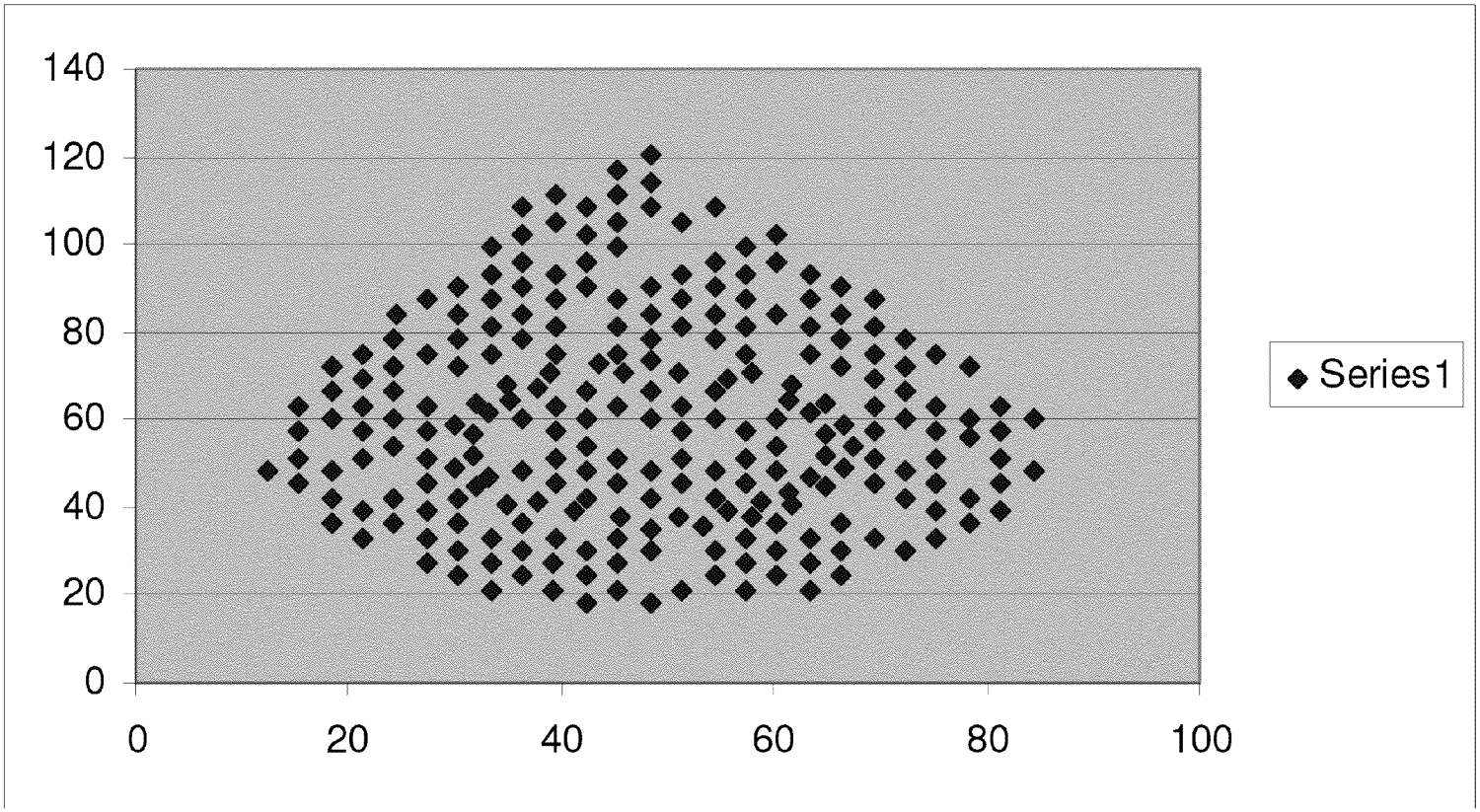
Figure 23C:
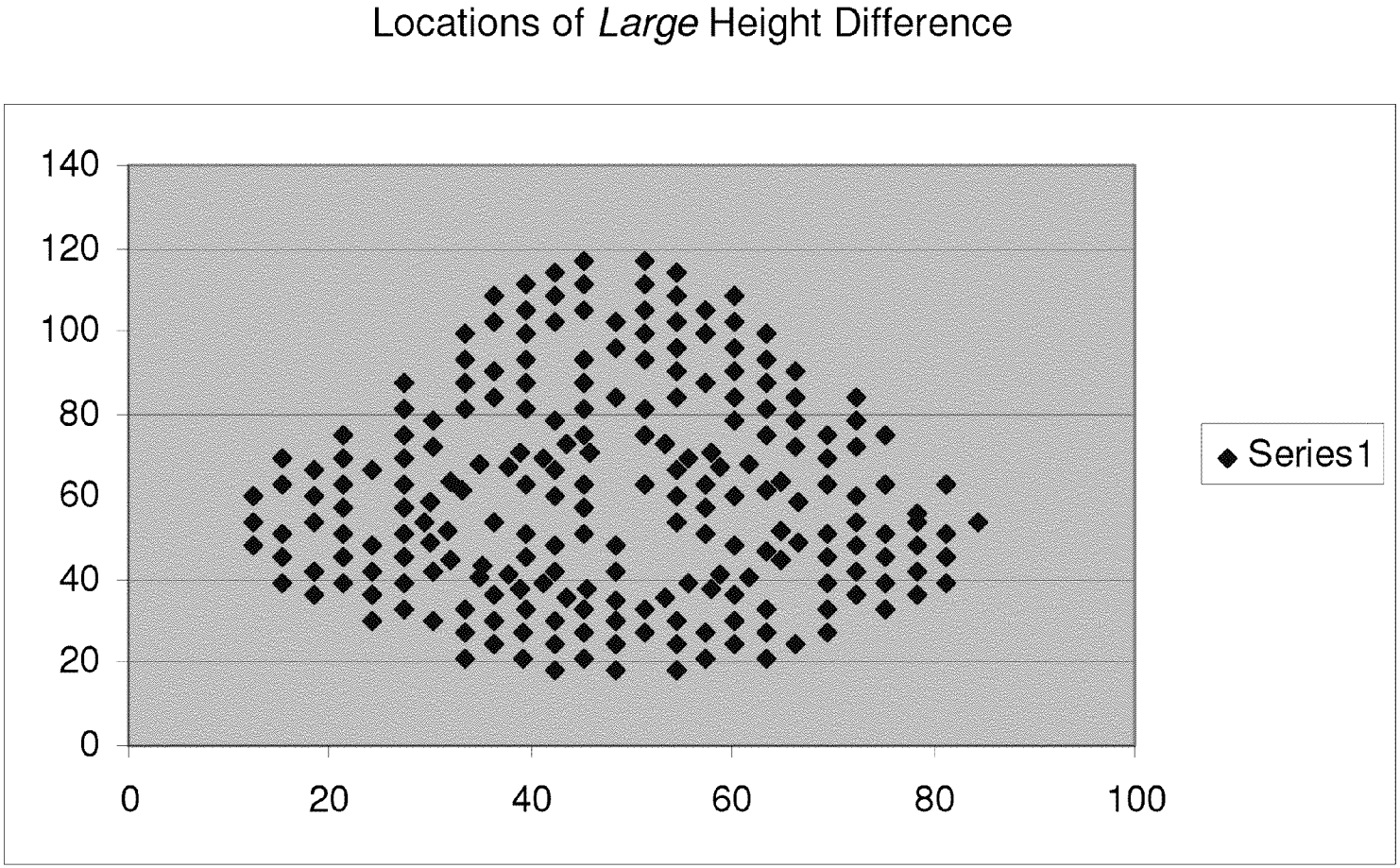

As shown in FIGS. 19-21, even though the overall distribution of the height difference objects may be at a substantially constant density, the pattern for any outlier subset (i.e. whose value differs from the average by more than one SD—in this case, by more than 3.04 mm) may indicate a random-like or random pattern. (see FIG. 21A-21D).

Appendix A

Below is a table of bristle heights for the example of FIGS. 1-2. For the non-limiting example of table 1 relates to around 300 bristles whose locations are mapped in FIG. 4

Bristles labeled "A" are in the 'upper height quartile' for the around 300 bristles in the inner field of the brush, bristles labeled "B" are in the 'upper middle height quartile' for the around 300 bristles in the inner field of the brush, bristles labeled "B" are in the 'upper middle height quartile' for the around 300 bristles in the inner field of the brush, and bristles labeled "C" are in the 'lower middle height quartile' for the around 300 bristles in the inner field of the brush, and bristles labeled "D" are in the 'lower height quartile' for the around 300 bristles in the inner field of the brush, The first column is 'bristle number' relating to the 306 bristles in the inner field see FIG. 4. The second column is 'bristle height' in millimeters. The third column relates to 'height quartile.'

| | | |
|---|---|---|
| 11 | 1 | 7.5 D |
| 23 | 1 | 7.5 D |
| 54 | 1 | 7.5 D |
| 71 | 1 | 7.5 D |
| 95 | 1 | 7.5 D |
| 108 | 1 | 7.5 D |
| 115 | 1 | 7.5 D |
| 135 | 1 | 7.5 D |
| 188 | 1 | 7.5 D |
| 258 | 1 | 7.5 D |
| 88 | 1 | 7.8 D |
| 103 | 1 | 7.8 D |
| 134 | 1 | 7.8 D |
| 157 | 1 | 7.8 D |
| 211 | 1 | 7.8 D |
| 253 | 1 | 7.8 D |
| 256 | 1 | 7.8 D |
| 260 | 1 | 7.8 D |
| 279 | 1 | 7.8 D |
| 299 | 1 | 7.8 D |
| 35 | 1 | 8.1 D |
| 60 | 1 | 8.1 D |
| 68 | 1 | 8.1 D |
| 84 | 1 | 8.1 D |
| 127 | 1 | 8.1 D |
| 169 | 1 | 8.1 D |
| 193 | 1 | 8.1 D |
| 197 | 1 | 8.1 D |
| 232 | 1 | 8.1 D |
| 285 | 1 | 8.1 D |
| 9 | 1 | 8.4 D |
| 106 | 1 | 8.4 D |
| 117 | 1 | 8.4 D |
| 152 | 1 | 8.4 D |
| 159 | 1 | 8.4 D |
| 180 | 1 | 8.4 D |
| 212 | 1 | 8.4 D |
| 230 | 1 | 8.4 D |
| 266 | 1 | 8.4 D |
| 278 | 1 | 8.4 D |
| 33 | 1 | 8.7 D |
| 67 | 1 | 8.7 D |
| 128 | 1 | 8.7 D |
| 130 | 1 | 8.7 D |
| 139 | 1 | 8.7 D |
| 158 | 1 | 8.7 D |
| 196 | 1 | 8.7 D |
| 229 | 1 | 8.7 D |
| 244 | 1 | 8.7 D |
| 293 | 1 | 8.7 D |
| 12 | 1 | 9 D |
| 22 | 1 | 9 D |
| 37 | 1 | 9 D |
| 90 | 1 | 9 D |
| 111 | 1 | 9 D |
| 160 | 1 | 9 D |
| 183 | 1 | 9 D |
| 222 | 1 | 9 D |
| 251 | 1 | 9 D |
| 294 | 1 | 9 D |
| 17 | 1.2 | 9.1 D |
| 21 | 1.2 | 9.1 D |
| 30 | 1.2 | 9.1 D |
| 36 | 1.2 | 9.1 D |

-continued

| | | |
|---|---|---|
| 204 | 1.2 | 9.1 D |
| 214 | 1.2 | 9.1 D |
| 246 | 1.2 | 9.1 D |
| 247 | 1.2 | 9.1 D |
| 46 | 1 | 9.3 D |
| 50 | 1 | 9.3 D |
| 77 | 1 | 9.3 D |
| 79 | 1 | 9.3 D |
| 131 | 1 | 9.3 D |
| 168 | 1 | 9.3 D |
| 213 | 1 | 9.3 D |
| 268 | 1 | 9.3 D |
| 302 | 1 | 9.3 D |
| 303 | 1 | 9.3 D |
| 42 | 1.2 | 9.4 C |
| 56 | 1.2 | 9.4 C |
| 86 | 1.2 | 9.4 C |
| 123 | 1.2 | 9.4 C |
| 191 | 1.2 | 9.4 C |
| 216 | 1.2 | 9.4 C |
| 245 | 1.2 | 9.4 C |
| 254 | 1.2 | 9.4 C |
| 259 | 1.2 | 9.4 C |
| 7 | 1 | 9.7 C |
| 57 | 1 | 9.7 C |
| 142 | 1 | 9.7 C |
| 145 | 1 | 9.7 C |
| 239 | 1 | 9.7 C |
| 255 | 1 | 9.7 C |
| 274 | 1 | 9.7 C |
| 280 | 1 | 9.7 C |
| 296 | 1 | 9.7 C |
| 5 | 1.2 | 9.8 C |
| 16 | 1.2 | 9.8 C |
| 112 | 1.2 | 9.8 C |
| 114 | 1.2 | 9.8 C |
| 167 | 1.2 | 9.8 C |
| 171 | 1.2 | 9.8 C |
| 181 | 1.2 | 9.8 C |
| 199 | 1.2 | 9.8 C |
| 298 | 1.2 | 9.8 C |
| 2 | 1.2 | 10.1 C |
| 85 | 1.2 | 10.1 C |
| 166 | 1.2 | 10.1 C |
| 225 | 1.2 | 10.1 C |
| 228 | 1.2 | 10.1 C |
| 233 | 1.2 | 10.1 C |
| 257 | 1.2 | 10.1 C |
| 264 | 1.2 | 10.1 C |
| 289 | 1.2 | 10.1 C |
| 27 | 1.2 | 10.4 C |
| 63 | 1.2 | 10.4 C |
| 94 | 1.2 | 10.4 C |
| 149 | 1.2 | 10.4 C |
| 172 | 1.2 | 10.4 C |
| 203 | 1.2 | 10.4 C |
| 249 | 1.2 | 10.4 C |
| 305 | 1.2 | 10.4 C |
| 306 | 1.2 | 10.4 C |
| 41 | 1.2 | 10.8 C |
| 45 | 1.2 | 10.8 C |
| 66 | 1.2 | 10.8 C |
| 76 | 1.2 | 10.8 C |
| 126 | 1.2 | 10.8 C |
| 155 | 1.2 | 10.8 C |
| 178 | 1.2 | 10.8 C |
| 221 | 1.2 | 10.8 C |
| 292 | 1.2 | 10.8 C |
| 8 | 1.45 | 10.9 C |
| 29 | 1.45 | 10.9 C |
| 32 | 1.45 | 10.9 C |
| 104 | 1.45 | 10.9 C |
| 189 | 1.45 | 10.9 C |
| 195 | 1.45 | 10.9 C |
| 215 | 1.45 | 10.9 C |
| 284 | 1.45 | 10.9 C |
| 49 | 1.2 | 11.2 C |
| 78 | 1.2 | 11.2 C |
| 113 | 1.2 | 11.2 C |
| 141 | 1.2 | 11.2 C |

-continued

| | | |
|---|---|---|
| 161 | 1.2 | 11.2 C |
| 201 | 1.2 | 11.2 C |
| 236 | 1.2 | 11.2 C |
| 270 | 1.2 | 11.2 C |
| 281 | 1.2 | 11.2 C |
| 3 | 1.45 | 11.3 C |
| 18 | 1.45 | 11.3 C |
| 24 | 1.45 | 11.3 C |
| 64 | 1.45 | 11.3 C |
| 81 | 1.45 | 11.3 C |
| 122 | 1.45 | 11.3 C |
| 154 | 1.45 | 11.3 C |
| 207 | 1.45 | 11.3 C |
| 265 | 1.45 | 11.3 C |
| 13 | 1.2 | 11.7 B |
| 52 | 1.2 | 11.7 B |
| 102 | 1.45 | 11.7 B |
| 138 | 1.2 | 11.7 B |
| 140 | 1.45 | 11.7 B |
| 205 | 1.45 | 11.7 B |
| 209 | 1.45 | 11.7 B |
| 218 | 1.2 | 11.7 B |
| 226 | 1.45 | 11.7 B |
| 238 | 1.2 | 11.7 B |
| 243 | 1.2 | 11.7 B |
| 261 | 1.2 | 11.7 B |
| 269 | 1.45 | 11.7 B |
| 272 | 1.45 | 11.7 B |
| 295 | 1.2 | 11.7 B |
| 297 | 1.45 | 11.7 B |
| 304 | 1.2 | 11.7 B |
| 14 | 1.45 | 12.1 B |
| 20 | 1.45 | 12.1 B |
| 116 | 1.45 | 12.1 B |
| 170 | 1.45 | 12.1 B |
| 179 | 1.45 | 12.1 B |
| 192 | 1.45 | 12.1 B |
| 223 | 1.45 | 12.1 B |
| 276 | 1.45 | 12.1 B |
| 290 | 1.45 | 12.1 B |
| 51 | 1.45 | 12.5 B |
| 58 | 1.45 | 12.5 B |
| 107 | 1.45 | 12.5 B |
| 137 | 1.45 | 12.5 B |
| 148 | 1.45 | 12.5 B |
| 162 | 1.45 | 12.5 B |
| 175 | 1.45 | 12.5 B |
| 194 | 1.45 | 12.5 B |
| 288 | 1.45 | 12.5 B |
| 4 | 1.6 | 12.7 B |
| 25 | 1.6 | 12.7 B |
| 43 | 1.6 | 12.7 B |
| 110 | 1.6 | 12.7 B |
| 129 | 1.6 | 12.7 B |
| 133 | 1.6 | 12.7 B |
| 190 | 1.6 | 12.7 B |
| 271 | 1.6 | 12.7 B |
| 277 | 1.6 | 12.7 B |
| 39 | 1.45 | 12.9 B |
| 74 | 1.45 | 12.9 B |
| 83 | 1.45 | 12.9 B |
| 105 | 1.45 | 12.9 B |
| 119 | 1.45 | 12.9 B |
| 235 | 1.45 | 12.9 B |
| 273 | 1.45 | 12.9 B |
| 283 | 1.45 | 12.9 B |
| 300 | 1.45 | 12.9 B |
| 15 | 1.6 | 13.1 B |
| 31 | 1.6 | 13.1 B |
| 121 | 1.6 | 13.1 B |
| 124 | 1.6 | 13.1 B |
| 202 | 1.6 | 13.1 B |
| 210 | 1.6 | 13.1 B |
| 220 | 1.6 | 13.1 B |
| 252 | 1.6 | 13.1 B |
| 267 | 1.6 | 13.1 B |
| 55 | 1.45 | 13.3 B |
| 61 | 1.45 | 13.3 B |
| 89 | 1.45 | 13.3 B |
| 125 | 1.45 | 13.3 B |

-continued

| | | |
|---|---|---|
| 174 | 1.45 | 13.3 B |
| 219 | 1.45 | 13.3 B |
| 227 | 1.45 | 13.3 B |
| 241 | 1.45 | 13.3 B |
| 286 | 1.45 | 13.3 B |
| 1 | 1.6 | 13.5 A |
| 10 | 1.6 | 13.5 A |
| 109 | 1.6 | 13.5 A |
| 136 | 1.6 | 13.5 A |
| 143 | 1.6 | 13.5 A |
| 156 | 1.6 | 13.5 A |
| 198 | 1.6 | 13.5 A |
| 200 | 1.6 | 13.5 A |
| 250 | 1.6 | 13.5 A |
| 34 | 1.45 | 13.7 A |
| 47 | 1.45 | 13.7 A |
| 69 | 1.45 | 13.7 A |
| 72 | 1.45 | 13.7 A |
| 91 | 1.45 | 13.7 A |
| 151 | 1.45 | 13.7 A |
| 164 | 1.45 | 13.7 A |
| 240 | 1.45 | 13.7 A |
| 263 | 1.45 | 13.7 A |
| 6 | 1.6 | 14 A |
| 19 | 1.6 | 14 A |
| 53 | 1.6 | 14 A |
| 92 | 1.6 | 14 A |
| 146 | 1.6 | 14 A |
| 153 | 1.6 | 14 A |
| 176 | 1.6 | 14 A |
| 206 | 1.6 | 14 A |
| 234 | 1.6 | 14 A |
| 26 | 1.6 | 14.5 A |
| 44 | 1.6 | 14.5 A |
| 48 | 1.6 | 14.5 A |
| 75 | 1.6 | 14.5 A |
| 82 | 1.6 | 14.5 A |
| 150 | 1.6 | 14.5 A |
| 177 | 1.6 | 14.5 A |
| 182 | 1.6 | 14.5 A |
| 275 | 1.6 | 14.5 A |
| 40 | 1.6 | 15 A |
| 87 | 1.6 | 15 A |
| 118 | 1.6 | 15 A |
| 163 | 1.6 | 15 A |
| 217 | 1.6 | 15 A |
| 231 | 1.6 | 15 A |
| 248 | 1.6 | 15 A |
| 262 | 1.6 | 15 A |
| 287 | 1.6 | 15 A |
| 301 | 1.6 | 15 A |
| 59 | 1.6 | 15.4 A |
| 73 | 1.6 | 15.4 A |
| 93 | 1.6 | 15.4 A |
| 132 | 1.6 | 15.4 A |
| 147 | 1.6 | 15.4 A |
| 173 | 1.6 | 15.4 A |
| 224 | 1.6 | 15.4 A |
| 237 | 1.6 | 15.4 A |
| 282 | 1.6 | 15.4 A |
| 291 | 1.6 | 15.4 A |
| 28 | 1.6 | 15.8 A |
| 62 | 1.6 | 15.8 A |
| 65 | 1.6 | 15.8 A |
| 70 | 1.6 | 15.8 A |
| 80 | 1.6 | 15.8 A |
| 120 | 1.6 | 15.8 A |
| 144 | 1.6 | 15.8 A |
| 165 | 1.6 | 15.8 A |
| 208 | 1.6 | 15.8 A |
| 242 | 1.6 | 15.8 A |

APPENDIX B

| | |
|---|---|
| 1 | ACB |
| 2 | CDC |
| 3 | CCD |
| 4 | BDC |
| 5 | CDD |
| 6 | AAD |
| 7 | CDB |
| 8 | CCA |
| 9 | DCC |
| 10 | ADB |
| 11 | DBD |
| 12 | DAC |
| 13 | BAA |
| 14 | BDC |
| 15 | BDC |
| 16 | CCD |
| 17 | DDA |
| 18 | CDA |
| 19 | AAD |
| 20 | BBA |
| 21 | DDC |
| 22 | DBD |
| 23 | DCB |
| 24 | CBC |
| 25 | BCD |
| 26 | ADC |
| 27 | CCD |
| 28 | ABA |
| 29 | CDA |
| 30 | DDD |
| 31 | BCD |
| 32 | CDB |
| 33 | DCA |
| 34 | AAD |
| 35 | DCC |
| 36 | DDD |
| 37 | DBD |
| 38 | DDD |
| 39 | BDB |
| 40 | AAC |
| 41 | CAC |
| 42 | CDD |
| 43 | BBA |
| 44 | ABC |
| 45 | CAD |
| 46 | DCC |
| 47 | AAB |
| 48 | ABA |
| 49 | CBB |
| 50 | DCA |
| 51 | BCD |
| 52 | BAC |
| 53 | AAC |
| 54 | DCA |
| 55 | BCA |
| 56 | CBB |
| 57 | CAB |
| 58 | BAA |
| 59 | ABD |
| 60 | DAC |
| 61 | BCC |
| 62 | ABC |
| 63 | CBD |
| 64 | CAD |
| 65 | ABD |
| 66 | CAB |
| 67 | DCD |
| 68 | DCA |
| 69 | AAA |
| 70 | ACA |
| 71 | DDC |
| 72 | ADA |
| 73 | AAA |
| 74 | BDA |
| 75 | AAD |
| 76 | CDA |
| 77 | DBA |
| 78 | CAB |

-continued

APPENDIX B

| | |
|---|---|
| 79 | DDC |
| 80 | ACD |
| 81 | CCD |
| 82 | ADA |
| 83 | BAD |
| 84 | DCA |
| 85 | CAA |
| 86 | CDB |
| 87 | ADC |
| 88 | DCD |
| 89 | BCA |
| 90 | DDA |
| 91 | ADA |
| 92 | ACD |
| 93 | AAD |
| 94 | CAA |
| 95 | DCD |
| 96 | DDD |
| 97 | DDD |
| 98 | DDD |
| 99 | DDD |
| 100 | DDD |
| 101 | DDD |
| 102 | BDC |
| 103 | DAB |
| 104 | CBD |
| 105 | BDA |
| 106 | DCC |
| 107 | BBA |
| 108 | DBC |
| 109 | ADB |
| 110 | BBD |
| 111 | DCB |
| 112 | CDB |
| 113 | CBB |
| 114 | CDD |
| 115 | DCC |
| 116 | BAB |
| 117 | DBD |
| 118 | ABD |
| 119 | BCC |
| 120 | ACD |
| 121 | BCC |
| 122 | CCB |
| 123 | CCD |
| 124 | BDD |
| 125 | BDA |
| 126 | CAB |
| 127 | DAB |
| 128 | DDB |
| 129 | BDC |
| 130 | DBB |
| 131 | DAB |
| 132 | ACB |
| 133 | BDD |
| 134 | DBD |
| 135 | DDD |
| 136 | ADD |
| 137 | BCD |
| 138 | BCA |
| 139 | DAD |
| 140 | BDA |
| 141 | CAA |
| 142 | CCB |
| 143 | AAB |
| 144 | ABD |
| 145 | CDB |
| 146 | ABC |
| 147 | ACA |
| 148 | BAA |
| 149 | CAC |
| 150 | ACA |
| 151 | ADB |
| 152 | DAB |
| 153 | ABC |
| 154 | CCD |
| 155 | CAD |
| 156 | ADA |

-continued

APPENDIX B

| | |
|---|---|
| 157 | DAB |
| 158 | DBC |
| 159 | DAD |
| 160 | DCA |
| 161 | CAA |
| 162 | BDD |
| 163 | ADD |
| 164 | ADD |
| 165 | ACB |
| 166 | CCA |
| 167 | CAB |
| 168 | DAA |
| 169 | DCC |
| 170 | BCD |
| 171 | CCB |
| 172 | CDB |
| 173 | ABB |
| 174 | BCC |
| 175 | BCA |
| 176 | AAA |
| 177 | ABB |
| 178 | CAA |
| 179 | BCA |
| 180 | DAA |
| 181 | CCB |
| 182 | ADC |
| 183 | DDA |
| 188 | DCA |
| 189 | CCC |
| 190 | BBD |
| 191 | CDB |
| 192 | BAC |
| 193 | DCA |
| 194 | BBD |
| 195 | CDC |
| 196 | DDC |
| 197 | DCB |
| 198 | ABC |
| 199 | CDB |
| 200 | ACD |
| 201 | CBA |
| 202 | BCB |
| 203 | CDB |
| 204 | DCD |
| 205 | BAD |
| 206 | ACA |
| 207 | CAC |
| 208 | ADC |
| 209 | BBC |
| 210 | BBC |
| 211 | DAB |
| 212 | DBA |
| 213 | DBB |
| 214 | DCA |
| 215 | CBD |
| 216 | CDC |
| 217 | ABD |
| 218 | BBD |
| 219 | BAD |
| 220 | BCC |
| 221 | CCB |
| 222 | DCC |
| 223 | BBA |
| 224 | ABB |
| 225 | CBD |
| 226 | BCB |
| 227 | BDC |
| 228 | CDD |
| 229 | DCA |
| 230 | DBC |
| 231 | ACB |
| 232 | DCB |
| 233 | CDA |
| 234 | ADD |
| 235 | BCD |
| 236 | CDA |
| 237 | AAC |
| 238 | BAA |

-continued

APPENDIX B

| | |
|---|---|
| 239 | CAB |
| 240 | AAB |
| 241 | BBA |
| 242 | ACB |
| 243 | BBA |
| 244 | DAA |
| 245 | CDB |
| 246 | DDD |
| 247 | DDD |
| 248 | ACC |
| 249 | CDD |
| 250 | ADC |
| 251 | DDC |
| 252 | BCC |
| 253 | DDD |
| 254 | CDA |
| 255 | CAB |
| 256 | DCA |
| 257 | CAD |
| 258 | DDB |
| 259 | CBD |
| 260 | DBC |
| 261 | BDC |
| 262 | ABD |
| 263 | ACC |
| 264 | CCA |
| 265 | CBD |
| 266 | DCB |
| 267 | BDD |
| 268 | DDB |
| 269 | BBA |
| 270 | CBB |
| 271 | BCC |
| 272 | BBD |
| 273 | BDB |
| 274 | CBA |
| 275 | ACB |
| 276 | BBD |
| 277 | BAD |
| 278 | DBC |
| 279 | DBD |
| 280 | CAB |
| 281 | CBB |
| 282 | ABC |
| 283 | BAC |
| 284 | CBD |
| 285 | DBD |
| 286 | BDA |
| 287 | ACC |
| 288 | BCA |
| 289 | CAC |
| 290 | BCD |
| 291 | ADB |
| 292 | CBA |
| 293 | DAB |
| 294 | DCB |
| 295 | BBA |
| 296 | CAB |
| 297 | BCD |
| 298 | CCA |
| 299 | DDB |
| 300 | BBC |
| 301 | ABB |
| 302 | DCD |
| 303 | DDB |
| 304 | BBA |
| 305 | CAD |
| 306 | CDD |

APPENDIX C

| | |
|---|---|
| 1 | ACDB |
| 2 | CDDC |

-continued

APPENDIX C

| | |
|---|---|
| 3 | CBCD |
| 4 | BDCA |
| 5 | CDCD |
| 6 | AABD |
| 7 | CDAB |
| 8 | CCAB |
| 9 | DCCB |
| 10 | ADDB |
| 11 | DCBD |
| 12 | DAAC |
| 13 | BCAA |
| 14 | BDCB |
| 15 | BDCD |
| 16 | CCDD |
| 17 | DDAC |
| 18 | CDDA |
| 19 | ABAD |
| 20 | BCBA |
| 21 | DDBC |
| 22 | DCBD |
| 23 | DCBB |
| 24 | CBCD |
| 25 | BACD |
| 26 | ADCB |
| 27 | CACD |
| 28 | ABBA |
| 29 | CDAA |
| 30 | DDDD |
| 31 | BCDD |
| 32 | CBDB |
| 33 | DCAB |
| 34 | ABAD |
| 35 | DDCC |
| 36 | DDBD |
| 37 | DBDA |
| 38 | DDDD |
| 39 | BADB |
| 40 | AACD |
| 41 | CDAC |
| 42 | CDDD |
| 43 | BCBA |
| 44 | ADBC |
| 45 | CAAD |
| 46 | DCCB |
| 47 | AADB |
| 48 | ADBA |
| 49 | CBAB |
| 50 | DCAB |
| 51 | BCDC |
| 52 | BADC |
| 53 | AAAC |
| 54 | DCAB |
| 55 | BDCA |
| 56 | CBBD |
| 57 | CABB |
| 58 | BDAA |
| 59 | ABDC |
| 60 | DACA |
| 61 | BCCA |
| 62 | ABCC |
| 63 | CABD |
| 64 | CACD |
| 65 | ABDA |
| 66 | CABA |
| 67 | DCAD |
| 68 | DCCA |
| 69 | AAAD |
| 70 | ACAA |
| 71 | DDCB |
| 72 | ADDA |
| 73 | AAAC |
| 74 | BDAD |
| 75 | AADC |
| 76 | CDAC |
| 77 | DBAD |
| 78 | CABA |
| 79 | DDCA |
| 80 | ACDB |

-continued

APPENDIX C

| | |
|---|---|
| 81 | CACD |
| 82 | ACDA |
| 83 | BADC |
| 84 | DCAC |
| 85 | CBAA |
| 86 | CDBD |
| 87 | ADCA |
| 88 | DCCD |
| 89 | BDCA |
| 90 | DDAA |
| 91 | ABDA |
| 92 | ACDD |
| 93 | AADC |
| 94 | CAAD |
| 95 | DCAD |
| 102 | BDCA |
| 103 | DADB |
| 104 | CBDD |
| 105 | BDAC |
| 106 | DBCC |
| 107 | BBAC |
| 108 | DCBC |
| 109 | ADBB |
| 110 | BBDC |
| 111 | DDCB |
| 112 | CBDB |
| 113 | CBDB |
| 114 | CBDD |
| 115 | DCBC |
| 116 | BDAB |
| 117 | DBBD |
| 118 | ABDC |
| 119 | BCCD |
| 120 | ACBD |
| 121 | BDCC |
| 122 | CDCB |
| 123 | CCDB |
| 124 | BCDD |
| 125 | BDDA |
| 126 | CDAB |
| 127 | DABB |
| 128 | DDCB |
| 129 | BDDC |
| 130 | DDBB |
| 131 | DABC |
| 132 | ACBC |
| 133 | BBDD |
| 134 | DABD |
| 135 | DDDB |
| 136 | ABDD |
| 137 | BCDC |
| 138 | BCAB |
| 139 | DADC |
| 140 | BCDA |
| 141 | CAAB |
| 142 | CBCB |
| 143 | AADB |
| 144 | ABDC |
| 145 | CCDB |
| 146 | AABC |
| 147 | AACA |
| 148 | BDAA |
| 149 | CAAC |
| 150 | ACCA |
| 151 | ADBA |
| 152 | DCAB |
| 153 | AABC |
| 154 | CCAD |
| 155 | CDAD |
| 156 | ADDA |
| 157 | DACB |
| 158 | DBCA |
| 159 | DADC |
| 160 | DACA |
| 161 | CADA |
| 162 | BADD |
| 163 | ACDD |
| 164 | ADCD |

-continued

APPENDIX C

| | |
|---|---|
| 165 | ADCB |
| 166 | CCAA |
| 167 | CAAB |
| 168 | DBAA |
| 169 | DCCC |
| 170 | BCCD |
| 171 | CACB |
| 172 | CBDB |
| 173 | ABBD |
| 174 | BACC |
| 175 | BACA |
| 176 | AAAB |
| 177 | ACBB |
| 178 | CDAA |
| 179 | BCAB |
| 180 | DAAC |
| 181 | CACB |
| 182 | ADDC |
| 183 | DDAA |
| 188 | DCBA |
| 189 | CCCC |
| 190 | BBCD |
| 191 | CCDB |
| 192 | BAAC |
| 193 | DCCA |
| 194 | BCBD |
| 195 | CDBC |
| 196 | DDCC |
| 197 | DCDB |
| 198 | ABBC |
| 199 | CDAB |
| 200 | ACCD |
| 201 | CBAA |
| 202 | BCAB |
| 203 | CDBB |
| 204 | DBCD |
| 205 | BADD |
| 206 | ACDA |
| 207 | CADC |
| 208 | ABDC |
| 209 | BBCD |
| 210 | BBBC |
| 211 | DACB |
| 212 | DCBA |
| 213 | DBAB |
| 214 | DBCA |
| 215 | CBBD |
| 216 | CDDC |
| 217 | ADBD |
| 218 | BBAD |
| 219 | BDAD |
| 220 | BBCC |
| 221 | CCBB |
| 222 | DACC |
| 223 | BBCA |
| 224 | ABDB |
| 225 | CBDD |
| 226 | BCDB |
| 227 | BDDC |
| 228 | CBDD |
| 229 | DCCA |
| 230 | DBAC |
| 231 | ABCB |
| 232 | DCCB |
| 233 | CDAC |
| 234 | ADAD |
| 235 | BACD |
| 236 | CDCA |
| 237 | AAAC |
| 238 | BBAA |
| 239 | CCAB |
| 240 | AABC |
| 241 | BBBA |
| 242 | ABCB |
| 243 | BABA |
| 244 | DAAD |
| 245 | CDBB |
| 246 | DDDD |

-continued

APPENDIX C

| | |
|---|---|
| 247 | DDDC |
| 248 | ACCB |
| 249 | CBDD |
| 250 | ADCD |
| 251 | DDCC |
| 252 | BCDC |
| 253 | DDCD |
| 254 | CDDA |
| 255 | CABC |
| 256 | DDCA |
| 257 | CAAD |
| 258 | DDCB |
| 259 | CBCD |
| 260 | DBDC |
| 261 | BCDC |
| 262 | ACBD |
| 263 | ACDC |
| 264 | CCAD |
| 265 | CCBD |
| 266 | DCCB |
| 267 | BDBD |
| 268 | DDBB |
| 269 | BBBA |
| 270 | CBBC |
| 271 | BCCB |
| 272 | BBCD |
| 273 | BDCB |
| 274 | CABA |
| 275 | ACBC |
| 276 | BBCD |
| 277 | BADC |
| 278 | DBCA |
| 279 | DBDB |
| 280 | CBAB |
| 281 | CBAB |
| 282 | ABBC |
| 283 | BDAC |
| 284 | CBCD |
| 285 | DBAD |
| 286 | BDAC |
| 287 | ACCC |
| 288 | BCDA |
| 289 | CACC |
| 290 | BCDD |
| 291 | ADBB |
| 292 | CBBA |
| 293 | DABB |
| 294 | DCCB |
| 295 | BBDA |
| 296 | CABC |
| 297 | BCAD |
| 298 | CCAD |
| 299 | DDDB |
| 300 | BBDC |
| 301 | ACBB |
| 302 | DCCD |
| 303 | DDCB |
| 304 | BCBA |
| 305 | CABD |
| 306 | CDDD |

Having thus described the foregoing exemplary embodiments it will be apparent to those skilled in the art that various equivalents, alterations, modifications, and improvements thereof are possible without departing from the scope and spirit of the claims as hereafter recited. In particular, different embodiments may include combinations of features other than those described herein. Accordingly, the claims are not limited to the foregoing discussion.

What is claimed is:

1. A hairbrush comprising a bristle-retaining surface and a bristle field of at least 100 bristles that are individually deployed to the bristle-retaining surface such that bristle heights vary in a substantially random manner and are substantially independent of bristle location on the bristle-retaining surface, the bristle field providing the following properties: (i) height properties such that at least 5 different heights that significantly differ from each other are represented; (ii) width properties such that each bristle has a width that is at least 0.5 mm; and (iii) bristle end properties such that at least 60% of the bristles have a rounded end.

2. The hairbrush of claim 1 wherein: i) the bristle field further provides width variation properties such that a ratio between a bristle width standard deviation and a bristle width average is at least 0.07 and such that there a is positive correlation between bristle height and bristle thickness for bristles of the bristle field such that, on average, taller bristles of the field are thicker than shorter bristles; and ii) bristles of the bristle field are each deployed substantially normally to a respective local plane of bristle-retaining surface.

3. The hairbrush of claim 2 wherein bristles of the bristle field are deployed at a substantially constant density on the bristle-retaining surface.

4. The hairbrush of claim 3 wherein the range of heights for the bristle field substantially is between about 3.5 mm and about 16 mm.

5. The hairbrush of claim 2 wherein bristles of the bristle field are deployed at a substantially constant density of at least 4 bristles/cm 2 on the bristle-retaining surface.

6. The hairbrush of claim 5 wherein the range of heights for the bristle field substantially is between about 3.5 mm and about 16 mm.

7. The hairbrush of claim 1 wherein the bristle field further provides width variation properties such that a ratio between a bristle width standard deviation and a bristle width average is at least 0.07 and such that there a is positive correlation between bristle height and bristle thickness for bristles of the bristle field such that, on average, taller bristles of the bristle field are thicker than shorter bristles.

8. The hairbrush of claim 1 wherein bristles of the bristle field are each deployed substantially normally to a respective local plane of bristle-retaining surface.

9. The hairbrush of claim 1 wherein bristles of the bristle field are deployed at a substantially constant density that is at least 4 bristles/cm 2.

10. The hairbrush of claim 1 wherein the range of heights for the bristles field substantially is between about 3.5 mm and about 16 mm.

11. The hairbrush of claim 1 wherein a ratio between a height standard deviation and the average height of the bristle field is at least 0.075.

12. The hairbrush of claim 1 wherein the average bristle thickness for the field exceeds 0.85 mm.

13. The hairbrush of claim 1 wherein the average height of the bristles of the field is at least about 8.5 mm.

14. The hairbrush of claim 1 wherein bristles of the bristle field are deployed at a density that is at most 12 bristles/cm 2.

15. The hairbrush of claim 1 wherein the average height of the bristles of the bristle field is between 8 mm and 14 mm.

16. The hairbrush of claim 1 wherein the field of bristles are deployed within the selected area so that: i) at least 80% of the bristles substantially reside on a constant lattice; and ii) at least 2% of the bristles of the field reside in positions that reside away from the lattice.

17. The hairbrush of claim 1 wherein bristles of the field are deployed so that they are substantially parallel to each other.

18. The hairbrush of claim 1 wherein: i) an average height of the bristle field is defined as HEIGHT_AVG, a height standard deviation of the bristle field is defined as HEIGHT_SD; ii) the bristle field includes a very-short-bristles (VSB) subset of bristles whose height is less than a difference between HEIGHT_AVG and HEIGHT_SD, iii) a majority of bristles of the very-short-bristles (VSB) subset of bristles has a height that is at least 5 mm and/or that is at least 0.33*HEIGHT_AVG.

19. The hairbrush of claim 1 wherein at least 10% of bristles of the bristle field have a height between 5 mm and 9 mm, at least 25% of the bristles have a height that is between 9 mm and 13 mm, and at least 10% of the bristles have a height that is between 13 mm and 18 mm.

20. The hairbrush of claim 1 wherein: i) each bristle b of the field of bristles is associated with a respective nearest bristle distance describing the respective closest distance $d_{CLOSEST}$ (b) between bristle b and a different bristle of the bristle field $b_{CLOSEST}$ that is closer to the bristle b than any other bristle of the bristle field ($d_{CLOSEST}$ (b)=DISTANCE(b, $b_{CLOSEST}$)), thereby establishing a one-to-one mapping between each bristle b of the bristle field and a closest distance $d_{CLOSEST}$ (b) to form a set of numbers CLOSEST_BRISTLE_DISTANCE whose members are the closest distances d CLOSEST (b) for the field of bristles; and ii) an SD/AVG ratio between a standard deviation of the set of numbers CLOSEST_BRISTLE-_DISTANCE and an average value of the set of numbers CLOSEST_BRISTLE_DISTANCE is at most 0.25.

21. The hairbrush of claim 1 wherein the bristle-retaining surface is flat.

22. The hairbrush of claim 1 wherein at least 8 different bristle heights that significantly differ from each other are represented in the bristle field.

* * * * *